US008087429B2

(12) United States Patent
Cedrone et al.

(10) Patent No.: US 8,087,429 B2
(45) Date of Patent: Jan. 3, 2012

(54) SYSTEM AND METHOD FOR A PUMP WITH REDUCED FORM FACTOR

(75) Inventors: James Cedrone, Braintree, MA (US); George Gonnella, Pepperell, MA (US); Iraj Gashgaee, Marlborough, MA (US)

(73) Assignee: Entegris, Inc., Billerica, MA (US)

( * ) Notice: Subject to any disclaimer, the term of this patent is extended or adjusted under 35 U.S.C. 154(b) by 1063 days.

(21) Appl. No.: 11/602,464

(22) Filed: Nov. 20, 2006

(65) Prior Publication Data

US 2007/0128050 A1 Jun. 7, 2007

Related U.S. Application Data

(63) Continuation-in-part of application No. PCT/US2005/042127, filed on Nov. 21, 2005.

(60) Provisional application No. 60/742,435, filed on Dec. 5, 2005.

(51) Int. Cl.
*F04B 17/03* (2006.01)

(52) U.S. Cl. ..... 137/884; 417/413.1; 417/244

(58) Field of Classification Search ..... 417/18, 417/244, 265, 413.1; 137/884
See application file for complete search history.

(56) References Cited

U.S. PATENT DOCUMENTS

| | | | | |
|---|---|---|---|---|
| 269,626 | A | | 12/1882 | Bodel et al. |
| 826,018 | A | | 7/1906 | Concoff |
| 1,664,125 | A | | 3/1928 | Lowrey |
| 2,153,664 | A | | 4/1939 | Freedlander |
| 2,215,505 | A | | 9/1940 | Hollander |
| 2,328,468 | A | | 8/1943 | Laffly |
| 2,457,384 | A | | 12/1948 | Krenz |
| 2,631,538 | A | | 3/1953 | Johnson |
| 2,673,522 | A | | 3/1954 | Dickey |
| 2,757,966 | A | | 8/1956 | Samiran |
| 3,072,058 | A | | 1/1963 | Christopher et al. |
| 3,227,279 | A | | 1/1966 | Bockelman |
| 3,250,225 | A | * | 5/1966 | Taplin ..... 417/413.1 |
| 3,327,635 | A | | 6/1967 | Sachnik |
| 3,623,661 | A | | 11/1971 | Wagner |

(Continued)

FOREIGN PATENT DOCUMENTS

AU B-78872/87 4/1988

(Continued)

OTHER PUBLICATIONS

Notification of Transmittal of International Preliminary Report on Patentability for PCT/US07/17017. Eight pages, dated Jan. 13, 2009.

(Continued)

*Primary Examiner* — Charles G Freay
*Assistant Examiner* — Patrick Hamo
(74) *Attorney, Agent, or Firm* — Sprinkle IP Law Group

(57) ABSTRACT

Embodiments of the present invention provide pumps with features to reduce form factor and increase reliability and serviceability. Additionally, embodiments of the present invention provide features for gentle fluid handling characteristics. Embodiments of the present invention can include a pump having a motor driven feed stage pump and a motor driven dispense stage pump. The feed stage motor and the feed stage motor can include various types of motors and the pumps can be rolling diaphragm or other pumps. According to one embodiment, a dispense block defining the pump chambers and various flow passages can be formed out of a single piece of material.

31 Claims, 28 Drawing Sheets

U.S. PATENT DOCUMENTS 3,741,298 A 6/1973 Canton
3,895,748 A 7/1975 Klingenberg
3,954,352 A 5/1976 Sakai
4,023,592 A 5/1977 Patzke
4,093,403 A 6/1978 Schrimpf
4,452,265 A 6/1984 Lonnebring
4,483,665 A 11/1984 Hauser
4,541,455 A 9/1985 Hauser
4,597,719 A 7/1986 Tano
4,597,721 A 7/1986 Santefort
4,601,409 A 7/1986 DiRegolo
4,614,438 A 9/1986 Kobayashi
4,671,545 A 6/1987 Miyazaki
4,690,621 A 9/1987 Swain
4,705,461 A 11/1987 Clements
4,797,834 A 1/1989 Honganen et al.
4,808,077 A * 2/1989 Kan et al. ..... 417/2
4,810,168 A 3/1989 Nogami et al.
4,821,997 A 4/1989 Zdeblick
4,824,073 A 4/1989 Zdeblick
4,865,525 A 9/1989 Kern
4,913,624 A 4/1990 Seki et al.
4,915,126 A 4/1990 Gyllinder
4,943,032 A 7/1990 Zdeblick
4,950,134 A 8/1990 Bailey et al.
4,952,386 A 8/1990 Davison
4,966,646 A 10/1990 Zdeblick
5,061,156 A 10/1991 Kuehne
5,061,574 A 10/1991 Henager, Jr.
5,062,770 A 11/1991 Story
5,134,962 A 8/1992 Amada
5,135,031 A 8/1992 Burgess
5,167,837 A 12/1992 Snodgrass
5,192,198 A 3/1993 Gebauer
5,230,445 A 7/1993 Rusnak
5,261,442 A 11/1993 Kingsford
5,262,068 A * 11/1993 Bowers et al. ..... 210/767
5,312,233 A 5/1994 Tanny et al.
5,316,181 A 5/1994 Burch
5,318,413 A * 6/1994 Bertoncini ..... 417/475
5,336,884 A 8/1994 Khoshnevisan et al.
5,344,195 A 9/1994 Parimore, Jr. et al.
5,350,200 A 9/1994 Peterson et al.
5,380,019 A 1/1995 Hillery
5,434,774 A 7/1995 Seberger
5,476,004 A 12/1995 Kingsford
5,490,765 A * 2/1996 Bailey et al. ..... 417/2
5,511,797 A 4/1996 Nikirk
5,516,429 A 5/1996 Snodgrass
5,527,161 A 6/1996 Bailey
5,546,009 A 8/1996 Raphael
5,575,311 A 11/1996 Kingsford
5,580,103 A 12/1996 Hall
5,599,100 A 2/1997 Jackson et al.
5,599,394 A 2/1997 Yabe
5,645,301 A 7/1997 Kingsford
5,652,391 A 7/1997 Kingsford
5,653,251 A 8/1997 Handler
5,743,293 A 4/1998 Kelly
5,762,795 A 6/1998 Bailey
5,772,899 A 6/1998 Snodgrass
5,784,573 A 7/1998 Szczepanek et al.
5,785,508 A 7/1998 Bolt
5,793,754 A 8/1998 Houldsworth et al.
5,839,828 A 11/1998 Glanville
5,848,605 A 12/1998 Bailey
5,947,702 A 9/1999 Biederstadt
5,971,723 A 10/1999 Bolt
5,991,279 A 11/1999 Haugli et al.
6,033,302 A 3/2000 Ahmed et al.
6,105,829 A 8/2000 Snodgrass
6,190,565 B1 2/2001 Bailey
6,210,745 B1 4/2001 Gaughan et al.
6,238,576 B1 5/2001 Yajima
6,250,502 B1 6/2001 Cote
6,251,293 B1 6/2001 Snodgrass
6,298,941 B1 10/2001 Spadafora
6,302,660 B1 10/2001 Kurita
6,318,971 B1 11/2001 Ota
6,325,032 B1 12/2001 Sekiya et al.
6,325,932 B1 12/2001 Gibson
6,330,517 B1 12/2001 Dobrowskli
6,348,124 B1 2/2002 Garbett
6,474,950 B1 11/2002 Waldo
6,478,547 B1 11/2002 Savard
6,506,030 B1 1/2003 Kottke
6,520,519 B2 2/2003 Howard
6,540,265 B2 4/2003 Turk
6,554,579 B2 4/2003 Martin
6,575,264 B2 6/2003 Spadafora
6,592,825 B2 7/2003 Pelc
6,635,183 B2 10/2003 Gibson
6,722,530 B1 4/2004 King et al.
6,742,992 B2 6/2004 Davis
6,742,993 B2 6/2004 Savard
6,766,810 B1 7/2004 Van Cleemput
6,767,877 B2 7/2004 Kuo
6,837,484 B2 1/2005 Kingsford
6,901,791 B1 6/2005 Frenz et al.
6,925,072 B1 8/2005 Grohn
6,952,618 B2 10/2005 Davlin et al.
7,013,223 B1 3/2006 Zhang et al.
7,029,238 B1 * 4/2006 Zagars et al. ..... 417/26
7,063,785 B2 6/2006 Hiraku et al.
7,083,202 B2 8/2006 Eberle et al.
7,156,115 B2 1/2007 Everett et al.
7,247,245 B1 7/2007 Proulx et al.
7,249,628 B2 7/2007 Pillion et al.
7,272,452 B2 9/2007 Coogan et al.
7,383,967 B2 6/2008 Gibson
7,454,317 B2 11/2008 Karasawa
7,476,087 B2 1/2009 Zagars et al.
7,494,265 B2 2/2009 Niermeyer et al.
7,547,049 B2 6/2009 Gashgaee
7,684,446 B2 3/2010 McLoughlin
7,878,765 B2 2/2011 Gonnella et al.
7,897,196 B2 3/2011 Cedrone et al.
2001/0000865 A1 5/2001 Gaughen et al.
2002/0044536 A1 4/2002 Izumi et al.
2002/0095240 A1 7/2002 Sickinger
2003/0033052 A1 2/2003 Hillen et al.
2003/0040881 A1 2/2003 Steger
2003/0148759 A1 8/2003 Leliveld
2003/0222798 A1 12/2003 Floros
2004/0041854 A1 3/2004 Saito et al.
2004/0050771 A1 3/2004 Gibson
2004/0072450 A1 4/2004 Collins
2004/0133728 A1 7/2004 Ellerbrock et al.
2004/0172229 A1 9/2004 Aragones et al.
2004/0208750 A1 10/2004 Masuda
2004/0265151 A1 12/2004 Bertram
2005/0061722 A1 3/2005 Takao et al.
2005/0113941 A1 5/2005 Ii et al.
2005/0126985 A1 6/2005 Campbell
2005/0151802 A1 7/2005 Neese et al.
2005/0173463 A1 8/2005 Wesner
2005/0182497 A1 8/2005 Nakano
2005/0184087 A1 8/2005 Zagars
2005/0197722 A1 9/2005 Varone et al.
2005/0232296 A1 10/2005 Schultze et al.
2005/0238497 A1 10/2005 Holst
2005/0244274 A1 11/2005 Wustman et al.
2005/0244276 A1 11/2005 Pfister et al.
2006/0015294 A1 1/2006 Yetter, Jr. et al.
2006/0070960 A1 4/2006 Gibson
2006/0083259 A1 4/2006 Metcalf et al.
2007/0104586 A1 5/2007 Cedrone
2007/0125796 A1 6/2007 Cedrone
2007/0125797 A1 6/2007 Cedrone
2007/0126233 A1 6/2007 Gashgaee
2007/0127511 A1 6/2007 Cedrone
2007/0128046 A1 6/2007 Gonnella
2007/0128047 A1 6/2007 Gonnella
2007/0128048 A1 6/2007 Gonnella
2007/0206436 A1 9/2007 Niermeyer et al.
2007/0217442 A1 9/2007 McLoughlin
2007/0254092 A1 11/2007 Lin et al.

| | | | |
|---|---|---|---|
| 2008/0089361 | A1 | 4/2008 | Metcalf et al. |
| 2008/0131290 | A1 | 6/2008 | Magoon et al. |
| 2009/0047143 | A1 | 2/2009 | Cedrone |

FOREIGN PATENT DOCUMENTS

| | | | |
|---|---|---|---|
| CA | 1271140 | | 7/1990 |
| CN | 1331783 | A | 1/2002 |
| CN | 1590761 | A | 3/2005 |
| DE | 299 09 100 | U1 | 8/1999 |
| EP | 0 249 655 | A | 12/1987 |
| EP | 0 410 394 | A | 1/1991 |
| EP | 0261972 | B1 | 12/1992 |
| EP | 0863538 | A2 | 9/1998 |
| EP | 0867649 | A2 | 9/1998 |
| EP | 0892204 | A2 | 1/1999 |
| EP | 1133639 | B1 | 6/2004 |
| GB | 661 522 | A | 11/1951 |
| JP | 58203340 | A | 11/1983 |
| JP | 6-58246 | | 3/1994 |
| JP | 11 026430 | A | 1/1999 |
| JP | 2004-293443 | | 10/2004 |
| WO | 96/35876 | A | 11/1996 |
| WO | WO 99/37435 | | 7/1999 |
| WO | WO 99/66415 | A1 | 12/1999 |
| WO | WO 00/31416 | A1 | 6/2000 |
| WO | WO 0140646 | A3 | 6/2001 |
| WO | WO 02/90771 | A2 | 11/2002 |
| WO | WO 2006057957 | A2 | 6/2006 |
| WO | WO 2009/059324 | A2 | 5/2009 |

OTHER PUBLICATIONS

International Preliminary Report on Patentability, Chap. I, issued in PCT/US2006/044981, mailed Nov. 6, 2008, 7 pgs.
International Preliminary Report on Patentability, Chap. II, issued in PCT/US2006/044981, mailed Feb. 2, 2009, 9 pgs.
Office Action issued in U.S. Appl. No. 11/365,395, mailed Feb. 2, 2009, McLoughlin, 18 pgs.
Office Action issued in U.S. Appl. No. 11/292,559, mailed Dec. 24, 2008, Gonnella, 18 pgs.
Office Action issued Chinese Patent Appl. No. 200680050665.7, dated Mar. 11, 2010 (with English translation) 6 pgs.
Office Action issued in U.S. Appl. No. 11/364,286 mailed Apr. 7, 2010, 23 pgs.
Office Action issued in U.S. Appl. No. 11/292,559 mailed Apr. 14, 2010, 20 pgs.
Office Action issued in U.S. Appl. No. 11/602,508 mailed Apr. 15, 2010, 20 pgs.
Two-page brochure describing a Chempure Pump—A Furon Product.
Fifteen-page publication regarding "Characterization of Low Viscosity Photoresist Coating," Murthy S. Krishna, John W. Lewellen, Gary E. Flores. Advances in Resist Technology and Processing XV (Proceedings of SPIE (The International Society of Optical Engineering), Feb. 23-25, 1998, Santa Clara, California. vol. 3333 (Part Two of Two Parts), Feb. 23-25, 1998.
U.S. Patent Office Official Action issued Dec. 13, 2007 in U.S. Appl. No. 11/051,576, Raymond A. Zagars, Dec. 13. 2007.
Office Action issued in Chinese Patent Application No. CN 200680050801.2, mailed Mar. 26, 2010, 13 pgs. (with English translation).
International Search Report and Written Opinion, PCT/US2006/045176, Apr. 21, 2008.
Office Action issued in U.S. Appl. No. 11/602,513, dated May 22, 2008.
International Search Report and Written Opinion issued in PCT/US07/05377 mailed Jun. 4, 2008.
Chinese Patent Office Official Action, Chinese Patent Application No. 2005101088364 dated May 23, 2008.
International Search Report and Written Opinion issued in PCT/US06/44981, dated Aug. 8, 2008, 10 pages.
Chinese Patent Office Official Action, Chinese Patent Application No. 200410079193.0, Mar. 23, 2007.
International Search Report and Written Opinion, PCT/US2006/045127, May 23, 2007.
International Search Report and Written Opinion, PCT/US2006/044908, Jul. 16, 2007.
International Search Report and Written Opinion, PCT/US2006/045175, Jul. 25, 2007.
International Search Report and Written Opinion, PCT/US2006/044907, Aug. 8, 2007.
International Search Report and Written Opinion, PCT/US2006/045177, Aug. 9, 2007.
Office Action issued in U.S. Appl. No. 11/365,395, dated Aug. 19, 2008, McLoughlin, 19 pages.
Office Action issued in U.S. Appl. No. 11/292,559, dated Aug. 28, 2008, Gonnella, 19 pages.
International Preliminary Report on Patentability, Chapter I, issued in PCT/US2006/044985, mailed Jun. 23, 2008, 5 pgs.
Office Action issued in U.S. Appl. No. 11/292,559, mailed Apr. 17, 2009, 20 pgs.
Office Action issued in U.S. Appl. No. 11/273,091, mailed Feb. 17, 2006, 8 pgs.
Office Action issued in U.S. Appl. No. 11/273,091, mailed Jul. 3, 2006, 8 pgs.
Office Action issued in U.S. Appl. No. 11/273,091, mailed Oct. 13, 2006, 8 pgs.
Office Action issued in U.S. Appl. No. 11/273,091, mailed Feb. 23, 2007, 6 pgs.
Office Action issued in U.S. Appl. No. 11/273,091, mailed Oct. 15, 2007, 8 pgs.
Office Action issued in U.S. Appl. No. 11/386,427, mailed Nov. 13, 2007, 11 pgs.
Office Action issued in U.S. Appl. No. 11/364,286 mailed Jun. 1, 2009, 14 pgs.
International Preliminary Report on Patentability and Written Opinion, Ch. I, issued in PCT/US2006/045176 dated Apr. 9, 2009, 5 pgs.
Intellectual Property Office of Singapore, Written Opinion, Patent Application No. 200803948-9, dated Jul. 2, 2009, 10 pgs.
International Search Report, PCT/US99/28002, mailed Mar. 14, 2000, Millipore Corp., 5 pgs.
Written Opinion issued in PCT/US99/28002, mailed Oct. 25, 2000, 8 pgs.
International Preliminary Examination Report, PCT/US99/28002, mailed Feb. 21, 2001, 9 pgs.
International Search Report and Written Opinion, PCT/US06/44907, mailed Aug. 8, 2007, 9 pgs.
International Preliminary Report on Patentability, Ch. I, PCT/US06/044906, mailed Jun. 5, 2008, 7 pgs.
International Preliminary Report on Patentability, Ch. I, PCT/US2006/044907, mailed Jun. 5, 2008, 7 pgs.
International Preliminary Report on Patentability, Ch. I, PCT/US2006/044980, mailed Jun. 12, 2008, 7 pgs.
International Preliminary Report on Patentability, Ch. I, PCT/US2006/044908, mailed Jun. 12, 2008, 8 pgs.
International Preliminary Report on Patentability, Ch. I, PCT/US2006/045175, mailed Jun. 12, 2008, 6 pgs.
International Preliminary Report on Patentability, Ch. I, PCT/US2006/045127, mailed Jun. 12, 2008, 8 pgs.
International Preliminary Report on Patentability, Ch. I, PCT/US2006/045177, mailed Jun. 12, 2008, 5 pgs.
International Preliminary Report on Patentability, Ch. II, PCT/US07/05377, mailed Oct. 14, 2008, 14 pgs.
European Search Report, European Application No. 06838223.3, dated Aug. 12, 2009, 8 pgs.
Japanese Laid Open Publication No. JP-2009-528631, published Aug. 6, 2009, with International Search Report, Japanese Patent Office, 38 pgs.
Office Action issued in U.S. Appl. No. 09/447,504 mailed Feb. 27, 2001, 4 pgs.
Office Action issued in U.S. Appl. No. 09/447,504 mailed Nov. 18, 2003, 4 pgs.
Office Action issued in U.S. Appl. No. 09/447,504 mailed Jul. 13, 2004, 5 pgs.
Japanese Laid Open Publication No. JP-2009-529847, published Aug. 20, 2009, with International Search Report, Japanese Patent Office, 21 pgs.

Intellectual Property Office of Singapore, Written Opinion issued in Patent Application No. 200703671-8 dated Jul. 20, 2009, 4 pages.
Chinese Patent Office Official Action, Chinese Patent Application No. 200580039961.2, dated Aug. 21, 2009 with English translation, 33 pgs.
European Patent Office Official Action, European Patent Application No. 00982386.5, Sep. 4, 2007.
International Search Report and Written Opinion, PCT/US2006/044906, Sep. 5, 2007.
International Search Report and Written Opinion, PCT/US2005/042127, Sep. 26, 2007.
International Search Report and Written Opinion, PCT/US2006/044980, Oct. 4, 2007.
Intellectual Property Office of Singapore, Written Opinion issued in Patent Application No. 200806425-5 dated Oct. 14, 2009, 8 pgs.
Office Action issued in U.S. Appl. No. 11/602,507 mailed Oct. 28, 2009, 12 pgs.
Office Action issued in U.S. Appl. No. 11/292,559 mailed Nov. 3, 2009, 17 pgs.
Office Action issued in U.S. Appl. No. 11/364,286 mailed Nov. 9, 2009, 19 pgs.
Office Action issued in U.S. Appl. No. 11/364,286 dated Nov. 14, 2008, Gonella, 11 pages.
Office Action issued in U.S. Appl. No. 11/602,513, dated Nov. 14, 2008, Gashgaee, 7 pages.
Supplementary European Search Report and European Written Opinion in Application No. EP06838071.6, dated Apr. 28, 2010, 5 pgs.
Office Action issued in U.S. Appl. No. 11/602,485 mailed Jun. 9, 2010, 9 pgs.
Office Action issued in U.S. Appl. No. 11/602,507 mailed Jun. 14, 2010, 13 pgs.
Office Action issued in U.S. Appl. No. 11/602,472 mailed Jun. 18, 2010, 13 pgs.
Office Action issued in U.S. Appl. No. 11/602,465 mailed Jun. 18, 2010, 14 pgs.
Office Action issued in Chinese Patent Application No. CN 200680045074.0, mailed Jun. 7, 2010, 8 pgs. (with English translation).
Office Action issued in Chinese Patent Application No. CN 200680050814.X (with English translation), mailed Aug. 6, 2010, 10 pgs.
Notice of Allowance issued in U.S. Appl. No. 11/364,286 mailed Sep. 21, 2010, 11 pgs.
Notice of Allowance issued in U.S. Appl. No. 11/602,507 mailed Oct. 14, 2010, 8 pgs.
Office Action issued in Chinese Patent Application No. CN 200780046952.5, mailed Sep. 27, 2010, 8 pgs. (English Translation).
Office Action issued in U.S. Appl. No. 11/602,485 mailed Nov. 19, 2010, 9 pgs.
Notice of Allowance for U.S. Appl. No. 11/602,508, mailed Dec. 14, 2010, 10 pgs.
International Search Report and Written Opinion issued in PCT/US06/44985, 7 pages, dated Jun. 23, 2008.
International Search Report and Written Opinion issued in PCT/US07/17017, dated Jul. 3, 2008, 9 pages.
Official Action for Chinese Patent Application No. 200680051448.X, mailed Dec. 1, 2010, with English translation, 20 pgs.
Notice of Allowance for U.S. Appl. No. 11/602,465, mailed Jan. 12, 2011, 19 pgs.
Office Action for Chinese Patent Application No. 200680050801.2, dated Jan. 6, 2011, with English translation, 7 pgs.
Notice of Allowance for U.S. Appl. No. 11/602,508, mailed Mar. 4, 2011, 8 pgs.
Office Action for Japanese Patent Application No. 2007-543342, dated Feb. 25, 2011, mailed Mar. 1, 2011, Japanese Patent Office, 12 pgs. with English translation.
Office Action for U.S. Appl. No. 11/602,472, mailed Mar. 21, 2011, 11 pgs.
European Search Report and Written Opinion for European Patent Application No. 06838070.8, dated Mar. 18, 2011, 7 pgs.
European Office Action for European Patent Application No. 06838071.6, dated Mar. 18, 2011, 5 pgs.
Office Action for U.S. Appl No. 11/602,485, mailed Apr. 27, 2011, 16 pgs.
Chinese Office Action for Chinese Patent Application No. 200680050665.7, mailed Apr. 26, 2011, Chinese Patent Office, 11 pgs. (English translation).
Office Action for U.S. Appl. No. 11/948,585, mailed May 19, 2011, 59 pgs.
Notice of Allowance for U.S. Appl. No. 11/602,465, mailed Jun. 8, 2011, 15 pgs.
Chinese Office Action for Chinese Patent Application No. 200680045074.0, Chinese Patent Office, dated Jun. 2, 2011, 10 pgs.
Office Action for Chinese Patent Application No. 200680043297.3, Chinese Patent Office, dated Jul. 27, 2011 (English translation), 8 pgs.

* cited by examiner

| SYSTEM SEGMENT NAME | SYSTEM SEGMENT NUMBER | VALVE DELAY NUMBER | BLDCM FORWARD | BLDCM REVERSE | BLDCM DISPENSE | STEPPER FORWARD | STEPPER REVERSE | VALVE INLET | VALVE PURGE | VALVE VENT | VALVE ISOLATE | VALVE BARRIER |
|---|---|---|---|---|---|---|---|---|---|---|---|---|
| P.C. 2A | 29 | | | | ▨ | | | | | | | |
| | 28 | 15 | | | | | | ▨ | | | | |
| PRS ZERO B | 27 | 14 | | | | | | ▨ | ▨ | | | |
| ST PRG | 26 | 13 | | | | | | ▨ | ▨ | | | |
| PURGE | 25 | | | | | | | ▨ | ▨ | | | |
| | 24 | 12 | ▨ | | | | | ▨ | ▨ | | | |
| | 23 | 11 | | | | | | ▨ | ▨ | ▨ | | |
| | 22 | 10 | | | | | | ▨ | ▨ | ▨ | | ▨ |
| | 21 | 9 | | | | | | ▨ | ▨ | ▨ | ▨ | ▨ |
| | 20 | 8 | | | | | | ▨ | | ▨ | ▨ | ▨ |
| PRS ZERO A | 19 | 7 | | | | | | | | ▨ | ▨ | ▨ |
| | 18 | 6 | | | | | | | | ▨ | ▨ | ▨ |
| VENT | 17 | | | | | ▨ | | | | ▨ | ▨ | ▨ |
| | 16 | 5 | | | | | | | | ▨ | ▨ | ▨ |
| | 15 | 4 | | | | | | | | | ▨ | ▨ |
| FILTRATION | 14 | | | ▨ | | ▨ | | | | | ▨ | ▨ |
| PRE FILTR | 13 | | | | | ▨ | | | | | ▨ | ▨ |
| | 12 | 3 | | | | | | | | | ▨ | ▨ |
| | 11 | 2 | | | | | | ▨ | | | ▨ | ▨ |
| | 10 | 1 | | | | | | ▨ | | | ▨ | |
| | 9 | 0 | | | | | | ▨ | | | | |
| END FILL | 8 | | | | | | ▨ | ▨ | | | | |
| CLOSE ADJ | 7 | | | | ▨ | | ▨ | ▨ | | | | |
| DISPENSE AND FILL | 6 | | ▨ | | ▨ | | ▨ | ▨ | | | | |
| | 5 | | ▨ | | ▨ | | ▨ | ▨ | | | | |
| | 4 | | ▨ | | ▨ | | ▨ | ▨ | | | | |
| | 3 | | ▨ | | ▨ | | ▨ | ▨ | | | | |
| | 2 | | ▨ | | ▨ | | ▨ | ▨ | | | | |
| OPEN ADJ | 1 | | | | ▨ | | | | | | | |
| READY | | | | | | | | | | | | |

*FIG. 20A*

SYSTEM AND METHOD FOR A PUMP WITH REDUCED FORM FACTOR

RELATED APPLICATIONS

The present Application is a Continuation in Part and claims under 35 U.S.C. 120 benefit of and priority to PCT Patent Application No. PCT/US2005/042127 entitled "SYSTEM AND METHOD FOR A VARIABLE HOME POSITION DISPENSE SYSTEM" by Applicant Entegris Inc, and inventors Laverdiere et al, filed Nov. 21, 2005 in the United States Receiving Office, and under 35 U.S.C. 119(e) benefit of and priority to U.S. Provisional Patent Application No. 60/742,435 entitled "SYSTEM AND METHOD FOR MULTI-STAGE PUMP WITH REDUCED FORM FACTOR" by Cedrone et al., filed Dec. 5, 2005, both of which are hereby incorporated by reference.

TECHNICAL FIELD OF THE INVENTION

This invention relates generally to fluid pumps. More particularly, embodiments of the present invention relate to multi-stage pumps. Even more particularly, embodiments of the present invention relate to a multi-stage pump with reduced form factor.

BACKGROUND OF THE INVENTION

There are many applications for which precise control over the amount and/or rate at which a fluid is dispensed by a pumping apparatus is necessary. In semiconductor processing, for example, it is important to control the amount and rate at which photochemicals, such as photoresist chemicals, are applied to a semiconductor wafer. The coatings applied to semiconductor wafers during processing typically require a flatness across the surface of the wafer that is measured in angstroms. The rates at which processing chemicals are applied to the wafer has to be controlled in order to ensure that the processing liquid is applied uniformly.

Many photochemicals used in the semiconductor industry today are very expensive, frequently costing as much as $1000 a liter. Therefore, it is preferable to ensure that a minimum but adequate amount of chemical is used and that the chemical is not damaged by the pumping apparatus. Current multiple stage pumps can cause sharp pressure spikes in the liquid. Such pressure spikes and subsequent drops in pressure may be damaging to the fluid (i.e., may change the physical characteristics of the fluid unfavorably). Additionally, pressure spikes can lead to built up fluid pressure that may cause a dispense pump to dispense more fluid than intended or dispense the fluid in a manner that has unfavorable dynamics.

Some previous pump designs for photo-resist dispense pumps relied on flat diaphragms in the feed and dispense chambers to move exert pressure on the process fluid. Hydraulic fluid was typically used to assert pressure on one side of the diaphragm to cause the diaphragm to move, thereby displacing the process fluid. The hydraulic fluid could either be put under pressure by a pneumatic piston or a stepper motor driven piston. In order to get the displacement volume required by dispense pumps, the diaphragm had to have a relatively large surface area, and therefore diameter. Moreover, in previous pumps the various plates defining various portions of the pump were held together by external metal plates that were clamped or screwed together. The spaces between the various plates increased the likelihood of fluid leakage. Additionally, valves were distributed throughout the pump, making replacement and repair more difficult.

SUMMARY OF THE INVENTION

Embodiments of the present invention provide a multi-stage pump with a reduced form factor, gentler fluid handling capabilities and various features to reduce fluid usage and increase reliability. One embodiment of the present invention includes a multi-stage pump comprising an pump inlet flow path, a pump outlet flow path, a feed pump in fluid communication with the pump inlet flow path, a dispense pump in fluid communication with the feed pump and the pump outlet flow path, and a set of valves to selectively allow fluid flow through the multi-stage pump. The feed pump can comprise a feed stage diaphragm movable in a feed chamber, a feed piston to move the feed stage diaphragm and a feed motor coupled to the feed piston to reciprocate the feed piston. The dispense pump can comprise a dispense rolling diaphragm movable in a dispense chamber, a dispense piston to move the dispense diaphragm and a dispense motor coupled to the dispense piston to reciprocate the dispense piston. According to various embodiments of the present invention the feed stage diaphragm can also be a rolling diaphragm. Additionally, the feed motor and dispense motor can each be stepper motors or brushless DC motors or, for example, the feed motor can be a stepper motor and the dispense motor a brushless DC motor. The multi-stage pump, according to one embodiment can include a single piece dispense block that at least partially defines the dispense chamber, the feed chamber and various flow paths in the multi-stage pump.

Another embodiment of the present invention includes a multi-stage pump comprising a pump inlet flow path, a pump outlet flow path, a single piece dispense block defining at least a portion of a dispense chamber in fluid communication with the pump outlet flow path, and at least a portion of a feed chamber in fluid communication with the pump inlet flow path. The pump can further comprise a filter in fluid communication with the feed chamber and the dispense chamber, a feed stage diaphragm movable in the feed chamber, a feed piston to move the feed stage diaphragm, a feed motor coupled to the feed piston to reciprocate the feed piston, a dispense diaphragm movable in the dispense chamber, a dispense piston to move the dispense diaphragm and a dispense motor coupled to the dispense piston to reciprocate the dispense piston.

The dispense block can further define a first and second portion of the pump inlet flow path, a first and second portion of the feed stage outlet flow path, a first and second portion of the dispense stage inlet flow path, a first and second portion of a vent flow path, a first and second portion of a purge flow path and at least a portion of the pump outlet flow path. According to one embodiment the flow paths can be configured as follows: the first portion of the pump inlet flow path leads from an inlet to an inlet valve and the second portion of the pump inlet path leads from the inlet valve to the feed chamber; the first portion of the feed stage outlet flow path leads from the feed chamber to an isolation valve and the second portion of the feed stage outlet flow path leads to the filter; the first portion of the dispense stage inlet flow path leads from the filter to a barrier valve and the second portion of the dispense stage inlet flow path leads from the barrier valve to the dispense chamber; the first portion of the vent flow path leads from the filter to a vent valve and the second portion of the vent flow path leads from the vent valve to a vent outlet; the first portion of the purge flow path leads from the dispense chamber to a purge valve and the second portion of the purge flow path leads from the purge valve to the feed chamber.

Yet another embodiment of the present invention includes a multi-stage pump method comprising: forming a dispense block of a single piece of material, the dispense block at least partially defining a feed chamber, a dispense chamber, a pump inlet flow path and a pump outlet flow path, mounting a dispense rolling diaphragm between the dispense block and a dispense pump piston housing, mounting a feed stage rolling diaphragm between the dispense block and a feed pump piston housing, coupling a feed pump piston to a feed pump motor via a feed pump lead screw, coupling a dispense pump piston to a dispense pump motor via a dispense pump lead screw, coupling the feed motor to the feed pump piston housing, coupling the dispense motor to the dispense motor piston housing and coupling a filter to the dispense block such that the filter is in fluid communication with the dispense chamber and the feed chamber.

Still another embodiment of the present invention includes a pump comprising, a pump inlet flow path, a pump outlet flow path, a single piece dispense block defining at least a portion of a pump chamber in fluid communication with the pump outlet flow path and the pump inlet flow path, a diaphragm movable in the feed chamber, a piston to move the diaphragm; and a motor coupled to the piston to reciprocate the piston.

Various embodiments of the present invention can include features to make the pump drip proof, such as offsets at intersections between PTFE and metal parts, features to guide drips away from electronics and various seals. Additionally, embodiments of the present invention can include features to reduce the effects of heat on the fluid in the pump. For example, electronic components that generate heat, such as solenoids or microchips, can be positioned away from the dispense block to the extent allowed by space constraints.

Embodiments of the present invention provide a multi-stage pump that has a small-form factor (e.g., approximately ½ the size of previous multi-stage pumps) with gentler fluid handling properties and a wider range of operation. Multi-stage pumps according to embodiments of the present invention have 35% fewer parts than previous multi-stage pumps, leading to a reduction in cost and complication, and do not require significant if any hydraulics. Multi-stage pumps, according to embodiments of the present invention, are easily maintained in the field, use less process chemical for dispense operations, reduce outgassing for sensitive chemistries and provide for more precise control. Other advantages include increased resist savings, increased uptime, higher yield and lower maintenance costs. Additionally, multi-stage pumps according to embodiments of the present invention provide significant space savings, allowing more pumps to be fit in the same amount of space as previous pumps.

These and other aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

A more complete understanding of the present invention and the advantages thereof may be acquired by referring to the following description, taken in conjunction with the accompanying drawings in which like reference numbers indicate like features and wherein:

FIGS. 20A, 20C, 20D, 20E and 20F are chart diagrams illustrating cycle timing of a stepper motor and a BLDCM in various stages, according to one embodiment of the invention and FIG. 20B is chart diagram illustrating one embodiment of configuring a stepper motor and BLDCM;

FIGS. 21A-1, 21A-2, 21B and 21C are diagrammatic representations of a rolling diaphragm and a dispense chamber;

DETAILED DESCRIPTION

Preferred embodiments of the present invention are illustrated in the FIGUREs, like numerals being used to refer to like and corresponding parts of the various drawings. To the extent dimensions are provided, they are provided by way of example for particular implementations and are not provided by way of limitation. Embodiments can be implemented in a variety of configurations.

Embodiments of the present invention are related to a pumping system that accurately dispenses fluid using a multiple stage ("multi-stage") pump with reduced form factor. Embodiments of the present invention can be utilized for the dispense of photo-resist and other photosensitive chemicals in semiconductor manufacturing.

Figure 1:
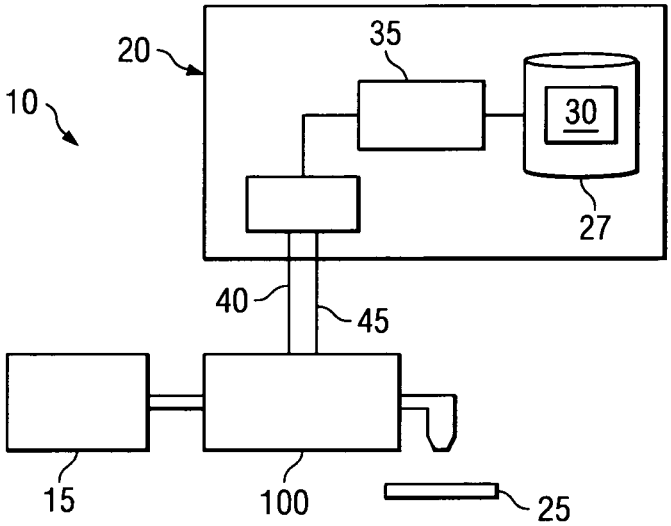
FIG. 1 is a diagrammatic representation of one embodiment of a pumping system.

FIG. 1 is a diagrammatic representation of a pumping system 10. The pumping system 10 can include a fluid source 15, a pump controller 20 and a multi-stage pump 100, which work together to dispense fluid onto a wafer 25. The operation of multi-stage pump 100 can be controlled by pump controller 20, which can be onboard multi-stage pump 100 or connected to multi-stage pump 100 via a one or more communications links for communicating control signals, data or other information. Additionally, the functionality of pump controller 20 can be distributed between an onboard controller and another controller. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC, DSP or other processor) can execute the instructions. One example of a processor is the Texas Instruments TMS320F2812PGFA 16-bit DSP (Texas Instruments is Dallas, Tex., based company). In the embodiment of FIG. 1, controller 20 communicates with multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Controller 20 can be implemented as an onboard PCB board, remote controller or in other suitable manner. Pump controller 20 can include appropriate interfaces (e.g., network interfaces, I/O interfaces, analog to digital converters and other components) to controller to communicate with multi-stage pump 100. Additionally, pump controller 20 can include a variety of computer components known in the art including processors, memories, interfaces, display devices, peripherals or other computer components not shown for the sake of simplicity. Pump controller 20 can control various valves and motors in multi-stage pump to cause multi-stage pump to accurately dispense fluids, including low viscosity fluids (i.e., less than 100 centipoise) or other fluids. An I/O interface connector as described in U.S. Provisional Patent Application No. 60/741,657, entitled "I/O INTERFACE SYSTEM AND METHOD FOR A PUMP," by Cedrone et al., filed Dec. 2, 2005, which is hereby fully incorporated by reference herein, can be used to connected pump controller 20 to a variety of interfaces and manufacturing tools.

Figure 2:
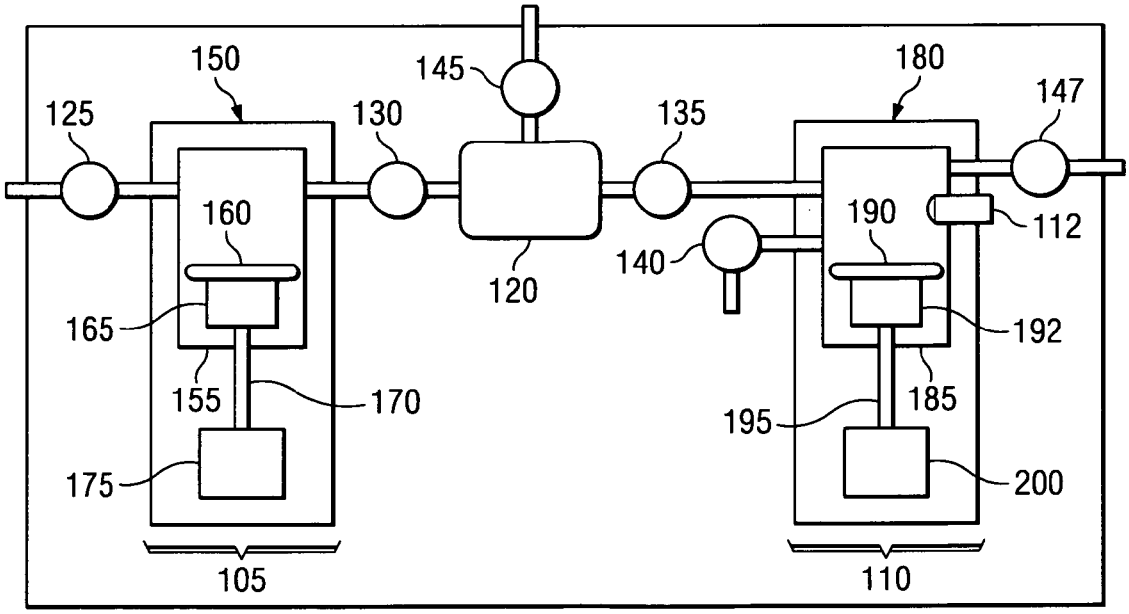
FIG. 2 is a diagrammatic representation of a multiple stage pump ("multi-stage pump") according to one embodiment of the present invention.

FIG. 2 is a diagrammatic representation of a multi-stage pump 100. Multi-stage pump 100 includes a feed stage portion 105 and a separate dispense stage portion 110. Located between feed stage portion 105 and dispense stage portion 110, from a fluid flow perspective, is filter 120 to filter impurities from the process fluid. A number of valves can control fluid flow through multi-stage pump 100 including, for example, inlet valve 125, isolation valve 130, barrier valve 135, purge valve 140, vent valve 145 and outlet valve 147. Dispense stage portion 110 can further include a pressure sensor 112 that determines the pressure of fluid at dispense stage 110. The pressure determined by pressure sensor 112 can be used to control the speed of the various pumps as described below. Example pressure sensors include ceramic and polymer pesioresistive and capacitive pressure sensors, including those manufactured by Metallux AG, of Korb, Germany. According to one embodiment, the face of pressure sensor 112 that contacts the process fluid is a perfluoropolymer. Pump 100 can include additional pressure sensors, such as a pressure sensor to read pressure in feed chamber 155.

Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a stepper motor 175. Lead screw 170 couples to stepper motor 175 through a nut, gear or other mechanism for imparting energy from the motor to lead screw 170. According to one embodiment, feed motor 170 rotates a nut that, in turn, rotates lead screw 170, causing piston 165 to actuate. Dispense-stage pump 180 ("dispense pump 180") can similarly include a dispense chamber 185, a dispense stage diaphragm 190, a piston 192, a lead screw 195, and a dispense motor 200. Dispense motor 200 can drive lead screw 195 through a threaded nut (e.g., a Torlon or other material nut).

According to other embodiments, feed stage 105 and dispense stage 110 can be a variety of other pumps including pneumatically or hydraulically actuated pumps, hydraulic pumps or other pumps. One example of a multi-stage pump using a pneumatically actuated pump for the feed stage and a stepper motor driven hydraulic pump is described in U.S. patent application Ser. No. 11/051,576 entitled "PUMP CONTROLLER FOR PRECISION PUMPING APPARATUS" by inventors Zagars et al., filed Feb. 4, 2005, hereby incorporated by reference. The use of motors at both stages, however, provides an advantage in that the hydraulic piping, control systems and fluids are eliminated, thereby reducing space and potential leaks.

Figure 17:
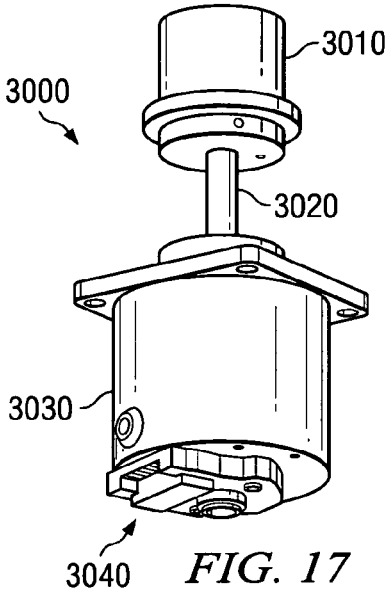
FIG. 17 is a diagrammatic representation of a motor assembly with a brushless DC motor, according to one embodiment of the invention.
Figure 18:
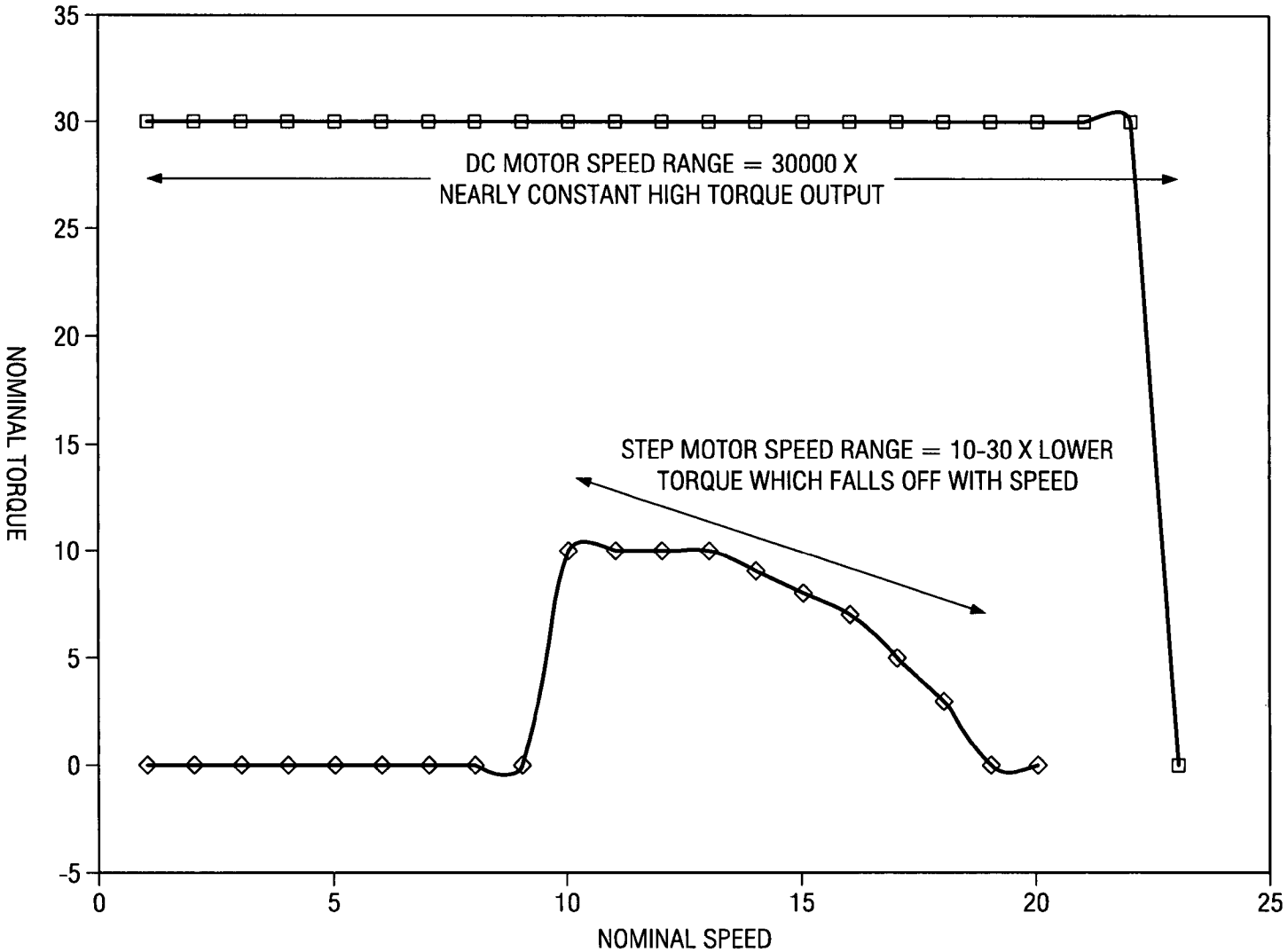
FIG. 18 is a plot diagram comparing average torque output and speed range of a brushless DC motor and a stepper motor, according to one embodiment of the invention.
Figure 19:
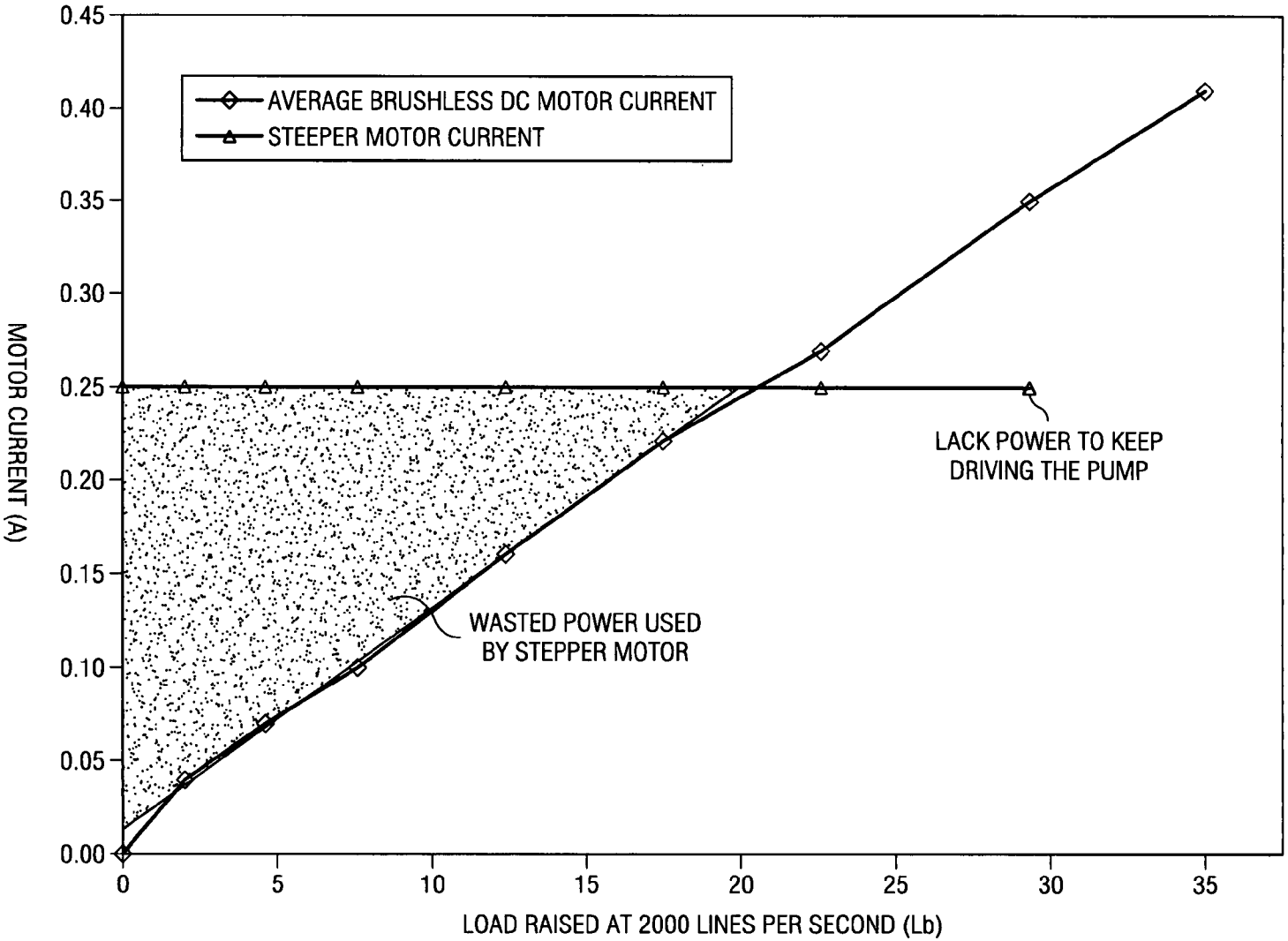
FIG. 19 is a plot diagram comparing average motor current and load between a brushless DC motor and a stepper motor, according to one embodiment of the invention.

Feed motor 175 and dispense motor 200 can be any suitable motor. According to one embodiment, dispense motor 200 is a Permanent-Magnet Synchronous Motor ("PMSM"). The PMSM can be controlled by a digital signal processor ("DSP") utilizing Field-Oriented Control ("FOC") or other type of position/speed control known in the art at motor 200, a controller onboard multi-stage pump 100 or a separate pump controller (e.g. as shown in FIG. 1). PMSM 200 can further include an encoder (e.g., a fine line rotary position encoder) for real time feedback of dispense motor 200's position. FIGS. 17-19 describe one embodiment of a PMSM motor. The use of a position sensor gives accurate and repeatable control of the position of piston 192, which leads to accurate and repeatable control over fluid movements in dispense chamber 185. For, example, using a 2000 line encoder, which according to one embodiment gives 8000 pulses to the DSP, it is possible to accurately measure to and control at 0.045 degrees of rotation. In addition, a PMSM can run at low velocities with little or no vibration. Feed motor 175 can also be a PMSM or a stepper motor. It should also be noted that the feed pump can include a home sensor to indicate when the feed pump is in its home position.

During operation of multi-stage pump 100, the valves of multi-stage pump 100 are opened or closed to allow or restrict fluid flow to various portions of multi-stage pump 100. According to one embodiment, these valves can be pneumatically actuated (i.e., gas driven) diaphragm valves that open or close depending on whether pressure or a vacuum is asserted. However, in other embodiments of the present invention, any suitable valve can be used. One embodiment of a valve plate and corresponding valve components is described below in conjunction with FIGS. 9-16.

The following provides a summary of various stages of operation of multi-stage pump 100. However, multi-stage pump 100 can be controlled according to a variety of control schemes including, but not limited to those described in U.S. Provisional Patent Application No. 60/741,682 entitled "SYSTEM AND METHOD FOR PRESSURE COMPENSATION IN A PUMP" by Inventors Cedrone et al., filed Dec. 2, 2005; U.S. patent application Ser. No. 11/502,729 entitled "SYSTEMS AND METHODS FOR FLUID FLOW CONTROL IN AN IMMERSION LITHOGRAPHY SYSTEM" by Inventors Clarke et al., filed Aug. 11, 2006; U.S. patent application Ser. No. 11/602,472, entitled "SYSTEM AND METHOD FOR CORRECTING FOR PRESSURE VARIATIONS USING A MOTOR" by Inventors Gonnella et al., filed Nov. 20, 2006, U.S. patent application Ser. No. 11/292,559 entitled "SYSTEM AND METHOD FOR CONTROL OF FLUID PRESSURE" by Inventors Gonnella et al., filed Dec. 2, 2005; U.S. patent application Ser. No. 11/364,286 entitled "SYSTEM AND METHOD FOR MONITORING OPERATION OF A PUMP" by Inventors Gonnella et al., filed Feb. 28, 2006, U.S. patent application Ser. No. 11/602,508, entitled "SYSTEM AND METHOD FOR PRESSURE COMPENSATION IN A PUMP" by Inventors Cedrone et al., filed Nov. 20, 2006; U.S. patent application Ser. No. 11/602,449, entitled "I/O SYSTEMS, METHODS AND DEVICES FOR INTERFACING A PUMP CONTROLLER" by Inventors Cedrone et al., filed Nov. 20, 2006, each of which is fully incorporated by reference herein, to sequence valves and control pressure. According to one embodiment, multi-stage pump 100 can include a ready segment, dispense segment, fill segment, pre-filtration segment, filtration segment, vent segment, purge segment and static purge segment. During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. According to other embodiments, both isolation valve 130 and barrier valve 135 can be opened and the feed pump moved to build pressure on the dispense side of the filter. During the filtration segment, dispense pump 180 can be brought to its home position. As described in U.S. Provisional Patent Application No. 60/630,384, entitled "SYSTEM AND METHOD FOR A VARIABLE HOME POSITION DISPENSE SYSTEM" by Laverdiere, et al, filed Nov. 23, 2004 and PCT Application No. PCT/US2005/042127, entitled "SYSTEM AND METHOD FOR VARIABLE HOME POSITION DISPENSE SYSTEM", by Applicant Entegris Inc, and Inventors Laverdiere et al., filed Nov. 21, 2005, both of which are hereby incorporated by reference, the home position of the dispense pump can be a position that gives the greatest available volume at the dispense pump for the dispense cycle, but is less than the maximum available volume that the dispense pump could provide. The home position is selected based on various parameters for the dispense cycle to reduce unused hold up volume of multi-stage pump 100. Feed pump 150 can similarly be brought to a home position that provides a volume that is less than its maximum available volume.

At the beginning of the vent segment, isolation valve 130 is opened, barrier valve 135 closed and vent valve 145 opened. In another embodiment, barrier valve 135 can remain open during the vent segment and close at the end of the vent segment. During this time, if barrier valve 135 is open, the pressure can be understood by the controller because the pressure in the dispense chamber, which can be measured by pressure sensor 112, will be affected by the pressure in filter 120. Feed-stage pump 150 applies pressure to the fluid to remove air bubbles from filter 120 through open vent valve 145. Feed-stage pump 150 can be controlled to cause venting to occur at a predefined rate, allowing for longer vent times and lower vent rates, thereby allowing for accurate control of the amount of vent waste. If feed pump is a pneumatic style pump, a fluid flow restriction can be placed in the vent fluid path, and the pneumatic pressure applied to feed pump can be increased or decreased in order to maintain a "venting" set point pressure, giving some control of an other wise uncontrolled method.

At the beginning of the purge segment, isolation valve 130 is closed, barrier valve 135, if it is open in the vent segment, is closed, vent valve 145 closed, and purge valve 140 opened and inlet valve 125 opened. Dispense pump 180 applies pressure to the fluid in dispense chamber 185 to vent air bubbles through purge valve 140. During the static purge segment, dispense pump 180 is stopped, but purge valve 140 remains open to continue to vent air. Any excess fluid removed during the purge or static purge segments can be routed out of multi-stage pump 100 (e.g., returned to the fluid source or discarded) or recycled to feed-stage pump 150. During the ready segment, inlet valve 125, isolation valve 130 and barrier valve 135 can be opened and purge valve 140 closed so that feed-stage pump 150 can reach ambient pressure of the source (e.g., the source bottle). According to other embodiments, all the valves can be closed at the ready segment.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening, followed by forward fluid motion caused by motor action. In other embodiments, outlet valve 147 can be opened and dispense begun by dispense pump 180 simultaneously.

An additional suckback segment can be performed in which excess fluid in the dispense nozzle is removed. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

Figure 3:
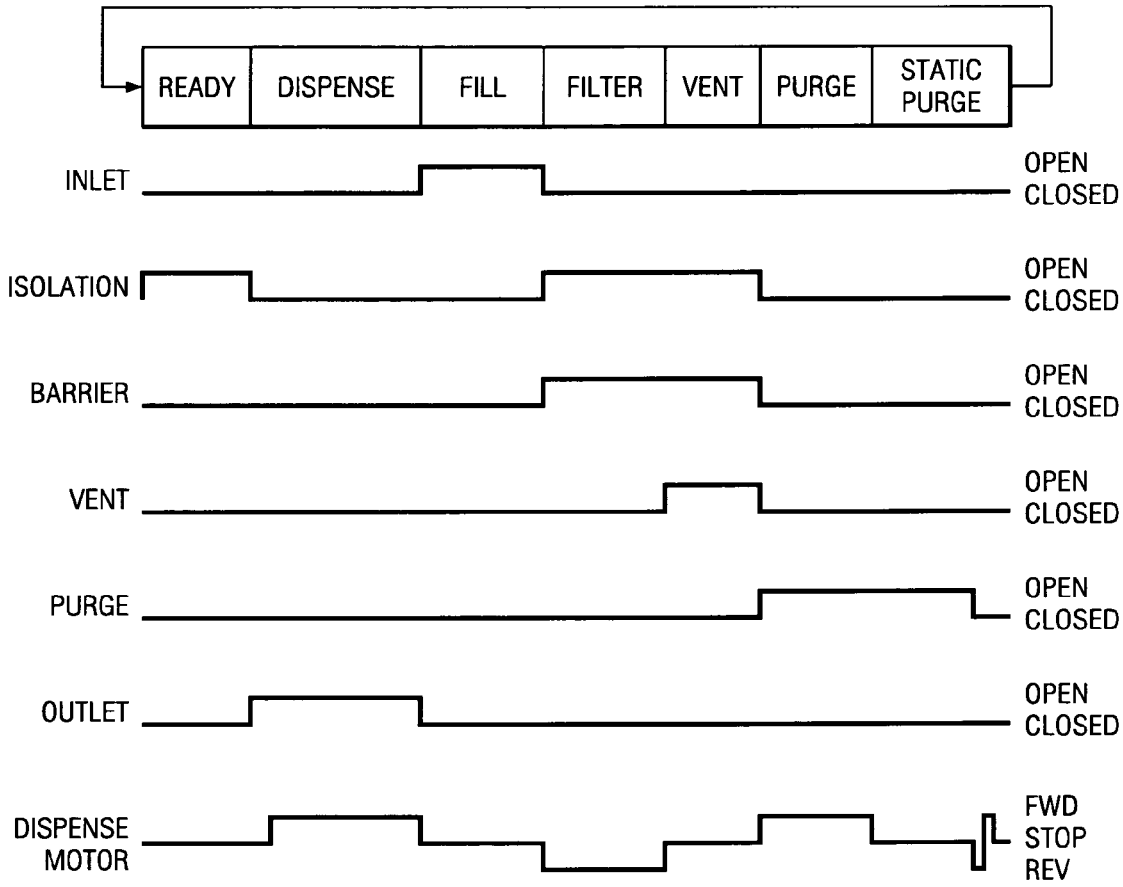
FIG. 3 is a diagrammatic representation of valve and motor timings for one embodiment of the present invention.

Referring briefly to FIG. 3, this figure provides a diagrammatic representation of valve and dispense motor timings for various segments of the operation of multi-stage pump 100 of FIG. 2. Other sequences are shown in FIGS. 20A and 20C-F.

While several valves are shown as closing simultaneously during segment changes, the closing of valves can be timed slightly apart (e.g., 100 milliseconds) to reduce pressure spikes. For example, between the vent and purge segment, isolation valve 130 can be closed shortly before vent valve 145. It should be noted, however, other valve timings can be utilized in various embodiments of the present invention. Additionally, several of the segments can be performed together (e.g., the fill/dispense stages can be performed at the same time, in which case both the inlet and outlet valves can be open in the dispense/fill segment). It should be further noted that specific segments do not have to be repeated for each cycle. For example, the purge and static purge segments may not be performed every cycle. Similarly, the vent segment may not be performed every cycle.

The opening and closing of various valves can cause pressure spikes in the fluid within multi-stage pump 100. Because outlet valve 147 is closed during the static purge segment, closing of purge valve 140 at the end of the static purge segment, for example, can cause a pressure increase in dispense chamber 185. This can occur because each valve may displace a small volume of fluid when it closes. More particularly, in many cases before a fluid is dispensed from chamber 185 a purge cycle and/or a static purge cycle is used to purge air from dispense chamber 185 in order to prevent sputtering or other perturbations in the dispense of the fluid from multi-stage pump 100. At the end of the static purge cycle, however, purge valve 140 closes in order to seal dispense chamber 185 in preparation for the start of the dispense. As purge valve 140 closes it forces a volume of extra fluid (approximately equal to the hold-up volume of purge valve 140) into dispense chamber 185, which, in turn, causes an increase in pressure of the fluid in dispense chamber 185 above the baseline pressure intended for the dispense of the fluid. This excess pressure (above the baseline) may cause problems with a subsequent dispense of fluid. These problems are exacerbated in low pressure applications, as the pressure increase caused by the closing of purge valve 140 may be a greater percentage of the baseline pressure desirable for dispense.

More specifically, because of the pressure increase that occurs due to the closing of purge valve 140 a "spitting" of fluid onto the wafer, a double dispense or other undesirable fluid dynamics may occur during the subsequent dispense segment if the pressure is not reduced. Additionally, as this pressure increase may not be constant during operation of multi-stage pump 100, these pressure increases may cause variations in the amount of fluid dispensed, or other characteristics of the dispense, during successive dispense segments. These variations in the dispense may in turn cause an increase in wafer scrap and rework of wafers. Embodiments of the present invention account for the pressure increase due to various valve closings within the system to achieve a desirable starting pressure for the beginning of the dispense segment, account for differing head pressures and other differences in equipment from system to system by allowing almost any baseline pressure to be achieved in dispense chamber 185 before a dispense.

In one embodiment, to account for unwanted pressure increases to the fluid in dispense chamber 185, during the static purge segment dispense motor 200 may be reversed to back out piston 192 a predetermined distance to compensate for any pressure increase caused by the closure of barrier valve 135, purge valve 140 and/or any other sources which may cause a pressure increase in dispense chamber 185.

Thus, embodiments of the present invention provide a multi-stage pump with gentle fluid handling characteristics. By compensating for pressure fluctuations in a dispense chamber before a dispense segment, potentially damaging pressure spikes can be avoided or mitigated. Embodiments of the present invention can also employ other pump control mechanisms and valve timings to help reduce deleterious effects of pressure on a process fluid.

Figure 4A:
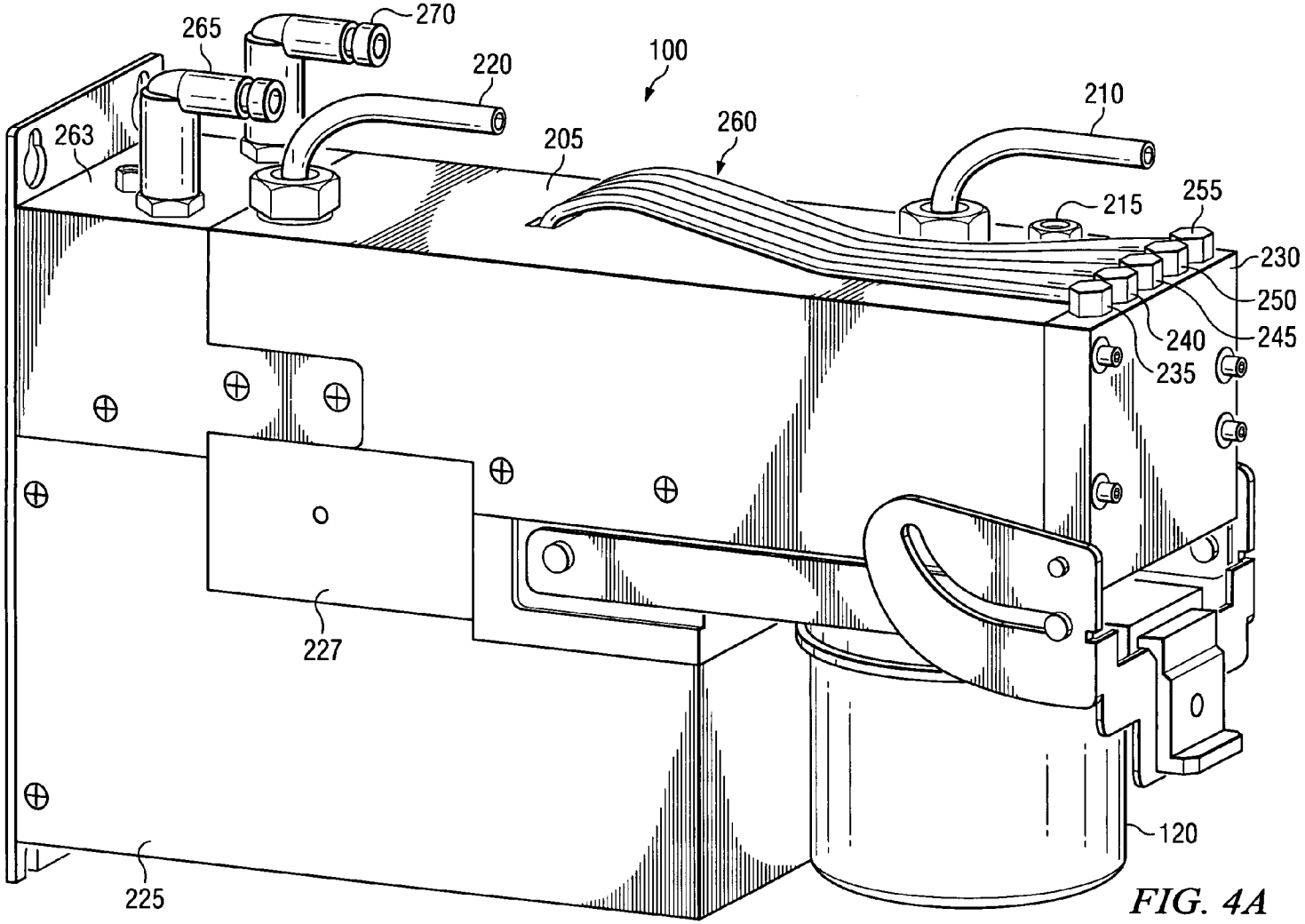
FIGS. 4A, 4B, 5A, 5C, and 5D are diagrammatic representations of various embodiments of a multi-stage pump.

FIG. 4A is a diagrammatic representation of one embodiment of a pump assembly for multi-stage pump 100. Multi-stage pump 100 can include a dispense block 205 that defines various fluid flow paths through multi-stage pump 100 and at least partially defines feed chamber 155 and dispense chamber 185. Dispense pump block 205, according to one embodiment, can be a unitary block of PTFE, modified PTFE or other material. Because these materials do not react with or are minimally reactive with many process fluids, the use of these materials allows flow passages and pump chambers to be machined directly into dispense block 205 with a minimum of additional hardware. Dispense block 205 consequently reduces the need for piping by providing an integrated fluid manifold.

Figure 5A:
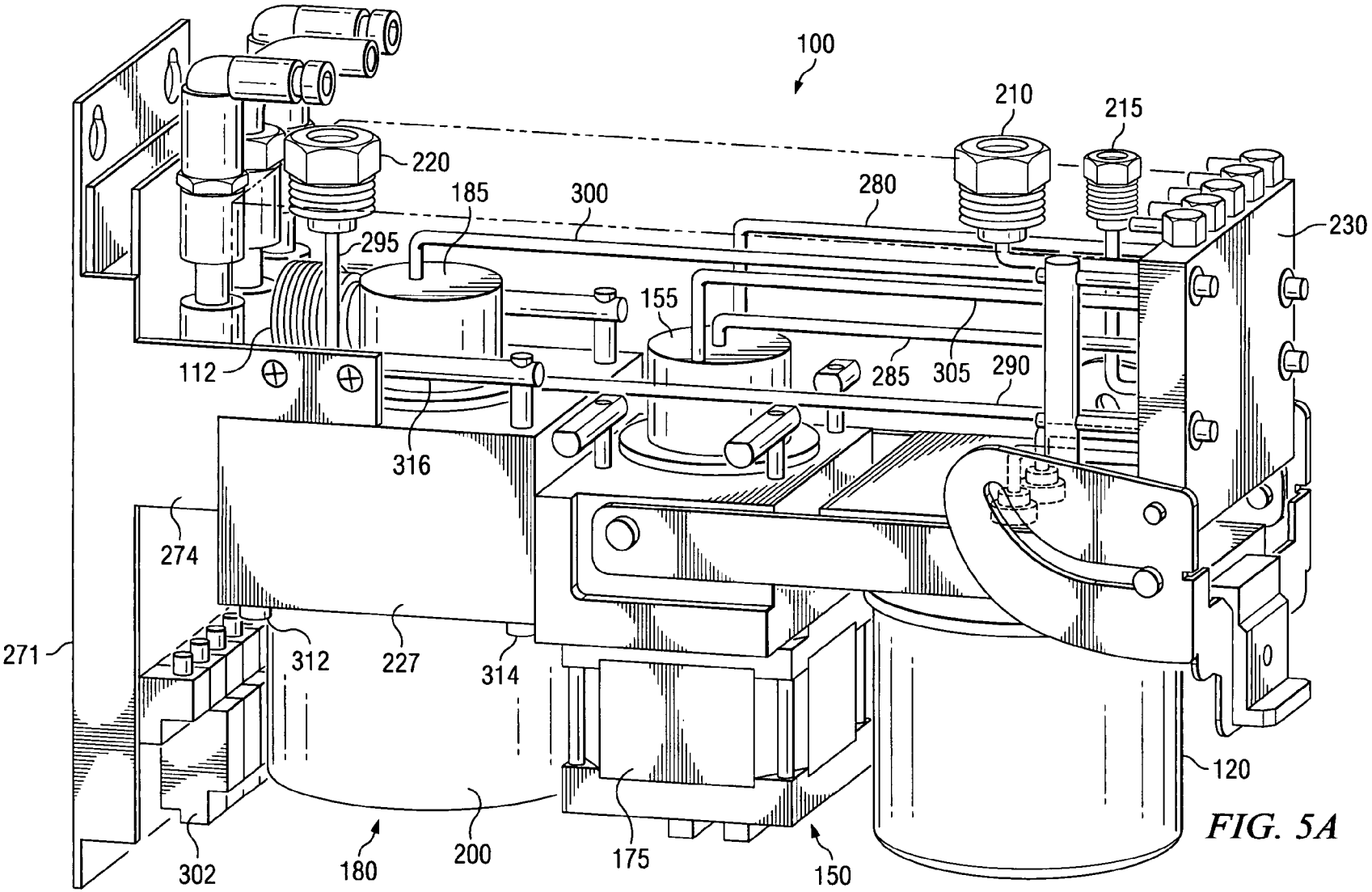
Figure 5B:
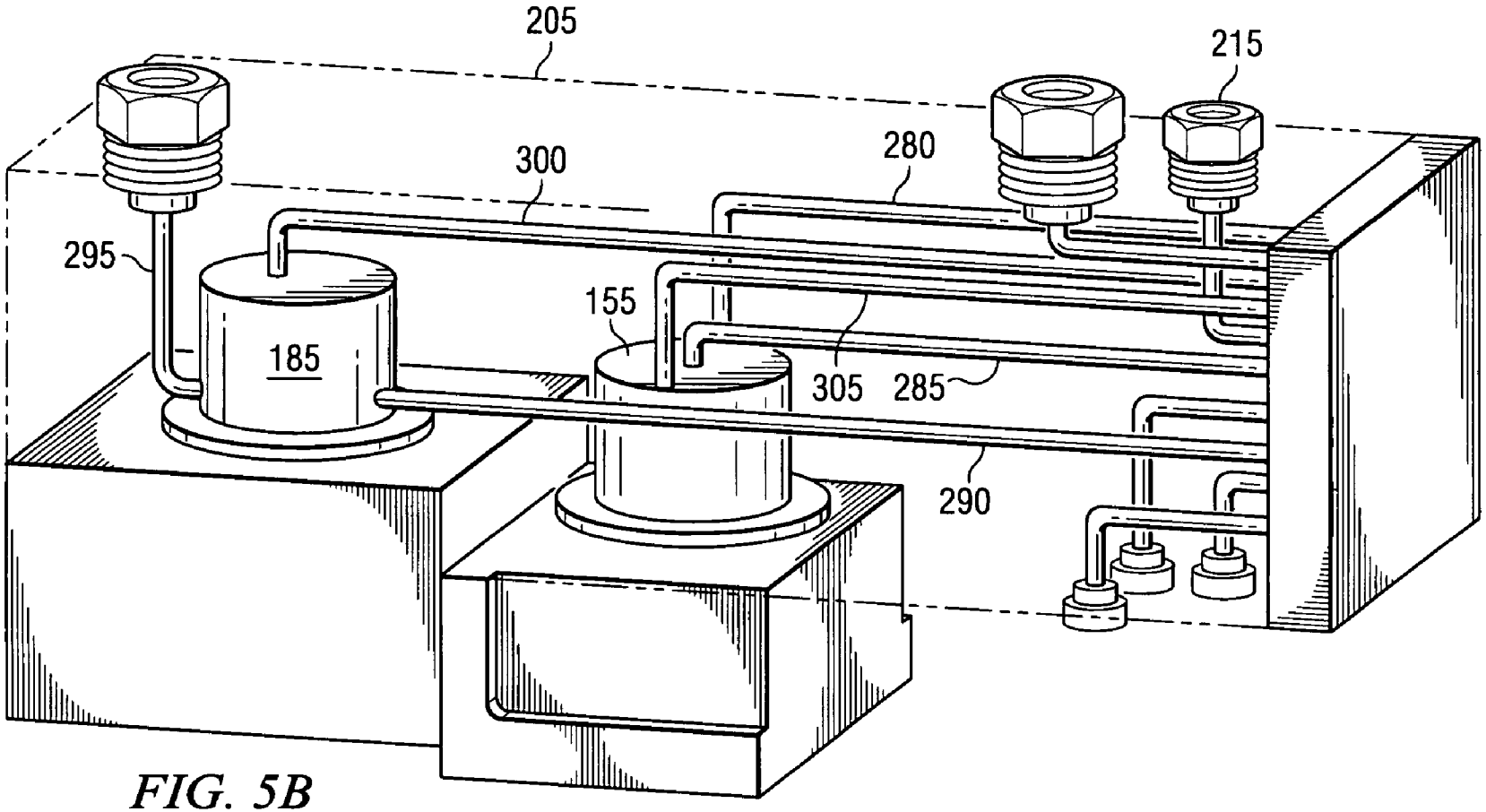
FIG. 5B is a diagrammatic representation of one embodiment of a dispense block.

Dispense block 205 can include various external inlets and outlets including, for example, inlet 210 through which the fluid is received, vent outlet 215 for venting fluid during the vent segment, and dispense outlet 220 through which fluid is dispensed during the dispense segment. Dispense block 205, in the example of FIG. 4A, does not include an external purge outlet as purged fluid is routed back to the feed chamber (as shown in FIG. 5A and FIG. 5B). In other embodiments of the present invention, however, fluid can be purged externally. U.S. Provisional Patent Application No. 60/741,667, entitled "O-RING-LESS LOW PROFILE FITTING AND ASSEMBLY THEREOF" by Iraj Gashgaee, filed Dec. 2, 2005, which is hereby fully incorporated by reference herein, describes an embodiment of fittings that can be utilized to connect the external inlets and outlets of dispense block 205 to fluid lines.

Dispense block 205 routes fluid to the feed pump, dispense pump and filter 120. A pump cover 225 can protect feed motor 175 and dispense motor 200 from damage, while piston housing 227 can provide protection for piston 165 and piston 192 and, according to one embodiment of the present invention, be formed of polyethylene or other polymer. Valve plate 230 provides a valve housing for a system of valves (e.g., inlet valve 125, isolation valve 130, barrier valve 135, purge valve 140 and vent valve 145 of FIG. 2) that can be configured to direct fluid flow to various components of multi-stage pump 100. According to one embodiment, each of inlet valve 125, isolation valve 130, barrier valve 135, purge valve 140 and vent valve 145 is at least partially integrated into valve plate 230 and is a diaphragm valve that is either opened or closed depending on whether pressure or vacuum is applied to the corresponding diaphragm. In other embodiments, some of the valves may be external to dispense block 205 or arranged in additional valve plates. According to one embodiment, a sheet of PTFE is sandwiched between valve plate 230 and dispense block 205 to form the diaphragms of the various valves. Valve plate 230 includes a valve control inlet for each valve to apply pressure or vacuum to the corresponding diaphragm. For example, inlet 235 corresponds to barrier valve 135, inlet 240 to purge valve 140, inlet 245 to isolation valve 130, inlet 250 to vent valve 145, and inlet 255 to inlet valve 125 (outlet valve 147 is external in this case). By the selective application of pressure or vacuum to the inlets, the corresponding valves are opened and closed.

A valve control gas and vacuum are provided to valve plate 230 via valve control supply lines 260, which run from a valve control manifold (in an area beneath top cover 263 or housing cover 225), through dispense block 205 to valve plate 230. Valve control gas supply inlet 265 provides a pressurized gas to the valve control manifold and vacuum inlet 270 provides vacuum (or low pressure) to the valve control manifold. The valve control manifold acts as a three way valve to route pressurized gas or vacuum to the appropriate inlets of valve plate 230 via supply lines 260 to actuate the corresponding valve(s). As discussed below in conjunction with FIGS. 9-16, a valve plate can be used that reduces the hold-up volume of the valve, eliminates volume variations due to vacuum fluctuations, reduces vacuum requirements and reduces stress on the valve diaphragm.

Figure 4B:
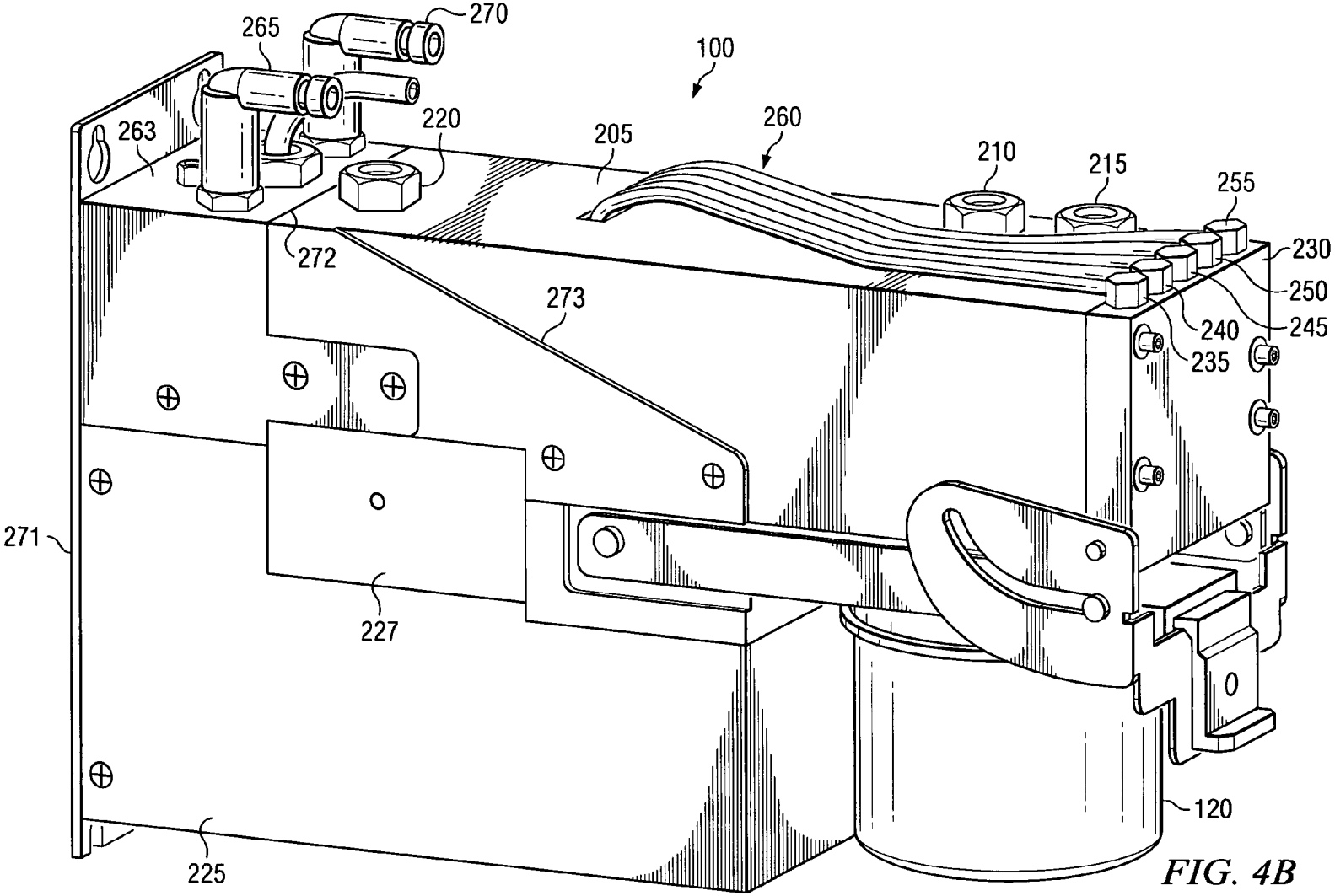

FIG. 4B is a diagrammatic representation of another embodiment of multistage pump 100. Many of the features shown in FIG. 4B are similar to those described in conjunction with FIG. 4A above. However, the embodiment of FIG. 4B includes several features to prevent fluid drips from entering the area of multi-stage pump 100 housing electronics. Fluid drips can occur, for example, when an operator connects or disconnects a tube from inlet 210, outlet 215 or vent 220. The "drip-proof" features are designed to prevent drips of potentially harmful chemicals from entering the pump, particularly the electronics chamber and do not necessarily require that the pump be "water-proof" (e.g., submersible in fluid without leakage). According to other embodiments, the pump can be fully sealed.

According to one embodiment, dispense block 205 can include a vertically protruding flange or lip 272 protruding outward from the edge of dispense block 205 that meets top cover 263. On the top edge, according to one embodiment, the top of top cover 263 is flush with the top surface of lip 272. This causes drips near the top interface of dispense block 205 and top cover 263 to tend to run onto dispense block 205, rather than through the interface. On the sides, however, top cover 263 is flush with the base of lip 272 or otherwise inwardly offset from the outer surface of lip 272. This causes drips to tend to flow down the corner created by top cover 263 and lip 272, rather than between top cover 263 and dispense block 205. Additionally, a rubber seal is placed between the top edge of top cover 263 and back plate 271 to prevent drips from leaking between top cover 263 and back plate 271.

Dispense block 205 can also include sloped feature 273 that includes a sloped surface defined in dispense block 205 that slopes down and away from the area of pump 100 housing electronics. Consequently, drips near the top of dispense block 205 are lead away from the electronics. Additionally, pump cover 225 can also be offset slightly inwards from the outer side edges of dispense block 205 so that drips down the side of pump 100 will tend to flow past the interface of pump cover 225 and other portions of pump 100.

According to one embodiment of the present invention, wherever a metal cover interfaces with dispense block 205, the vertical surfaces of the metal cover can be slightly inwardly offset (e.g., 1/64 of an inch or 0.396875 millimeters) from the corresponding vertical surface of dispense block 205. Additionally, multi-stage pump 100 can include seals, sloped features and other features to prevent drips from entering portions of multi-stage pump 100 housing electronics. Furthermore, as shown in FIG. 5A, discussed below, back plate 271 can include features to further "drip-proof" multi-stage pump 100.

FIG. 5A is a diagrammatic representation of one embodiment of multi-stage pump 100 with dispense block 205 made transparent to show the fluid flow passages defined there through. Dispense block 205 defines various chambers and fluid flow passages for multi-stage pump 100. According to one embodiment, feed chamber 155 and dispense chamber 185 can be machined directly into dispense block 205. Additionally, various flow passages can be machined into dispense block 205. Fluid flow passage 275 (shown in FIG. 5C) runs from inlet 210 to the inlet valve. Fluid flow passage 280 runs from the inlet valve to feed chamber 155, to complete the pump inlet path from inlet 210 to feed pump 150. Inlet valve 125 in valve housing 230 regulates flow between inlet 210 and feed pump 150. Flow passage 285 routes fluid from feed pump 150 to isolation valve 130 in valve plate 230. The output of isolation valve 130 is routed to filter 120 by another flow passage (not shown). These flow paths act as a feed stage outlet flow path to filter 120. Fluid flows from filter 120 through flow passages that connect filter 120 to the vent valve 145 and barrier valve 135. The output of vent valve 145 is routed to vent outlet 215 to complete a vent flow path while the output of barrier valve 135 is routed to dispense pump 180 via flow passage 290. Thus, the flow passage from filter 120 to barrier valve 135 and flow passage 290 act as feed stage inlet flow path. Dispense pump, during the dispense segment, can output fluid to outlet 220 via flow passage 295 (e.g., a pump outlet flow path) or, in the purge segment, to the purge valve through flow passage 300. During the purge segment, fluid can be returned to feed pump 150 through flow passage 305. Thus, flow passage 300 and flow passage 305 act as a purge flow path to return fluid to feed chamber 155. Because the fluid flow passages can be formed directly in the PTFE (or other material) block, dispense block 205 can act as the piping for the process fluid between various components of multi-stage pump 100, obviating or reducing the need for additional tubing. In other cases, tubing can be inserted into dispense block 205 to define the fluid flow passages. FIG. 5B provides a diagrammatic representation of dispense block 205 made transparent to show several of the flow passages therein, according to one embodiment.

Returning to FIG. 5A, FIG. 5A also shows multi-stage pump 100 with pump cover 225 and top cover 263 removed to show feed pump 150, including feed stage motor 190, dispense pump 180, including dispense motor 200, and valve control manifold 302. According to one embodiment of the present invention, portions of feed pump 150, dispense pump 180 and valve plate 230 can be coupled to dispense block 205 using bars (e.g., metal bars) inserted into corresponding cavities in dispense block 205. Each bar can include on or more threaded holes to receive a screw. As an example, dispense motor 200 and piston housing 227 can be mounted to dispense block 205 via one or more screws (e.g., screw 312 and screw 314) that run through screw holes in dispense block 205 to thread into corresponding holes in bar 316. It should be noted that this mechanism for coupling components to dispense block 205 is provided by way of example and any suitable attachment mechanism can be used.

Back plate 271, according to one embodiment of the present invention, can include inwardly extending tabs (e.g., bracket 274) to which top cover 263 and pump cover 225 mount. Because top cover 263 and pump cover 225 overlap bracket 274 (e.g., at the bottom and back edges of top cover 263 and the top and back edges pump cover 225) drips are prevented from flowing into the electronics area between any space between the bottom edge of top cover 263 and the top edge of pump cover 225 or at the back edges of top cover 263 and pump cover 225.

Manifold 302, according to one embodiment of the present invention can include a set of solenoid valves to selectively direct pressure/vacuum to valve plate 230. When a particular solenoid is on thereby directing vacuum or pressure to a valve, depending on implementation, the solenoid will generate heat. According to one embodiment, manifold 302 is mounted below a PCB board (which is mounted to back plate 271 and better shown in FIG. 5C) away from dispense block 205 and particularly dispense chamber 185. Manifold 302 can be mounted to a bracket that is, in turn, mounted to back plate 271 or can be coupled otherwise to back plate 271. This helps prevent heat from the solenoids in manifold 302 from affecting fluid in dispense block 205. Back plate 271 can be made of stainless steel machined aluminum or other material that can dissipate heat from manifold 302 and the PCB. Put another way, back plate 271 can act as a heat dissipating bracket for manifold 302 and the PCB. Pump 100 can be further mounted to a surface or other structure to which heat can be conducted by back plate 271. Thus, back plate 271 and the structure to which it is attached act as a heat sink for manifold 302 and the electronics of pump 100.

Figure 5C:
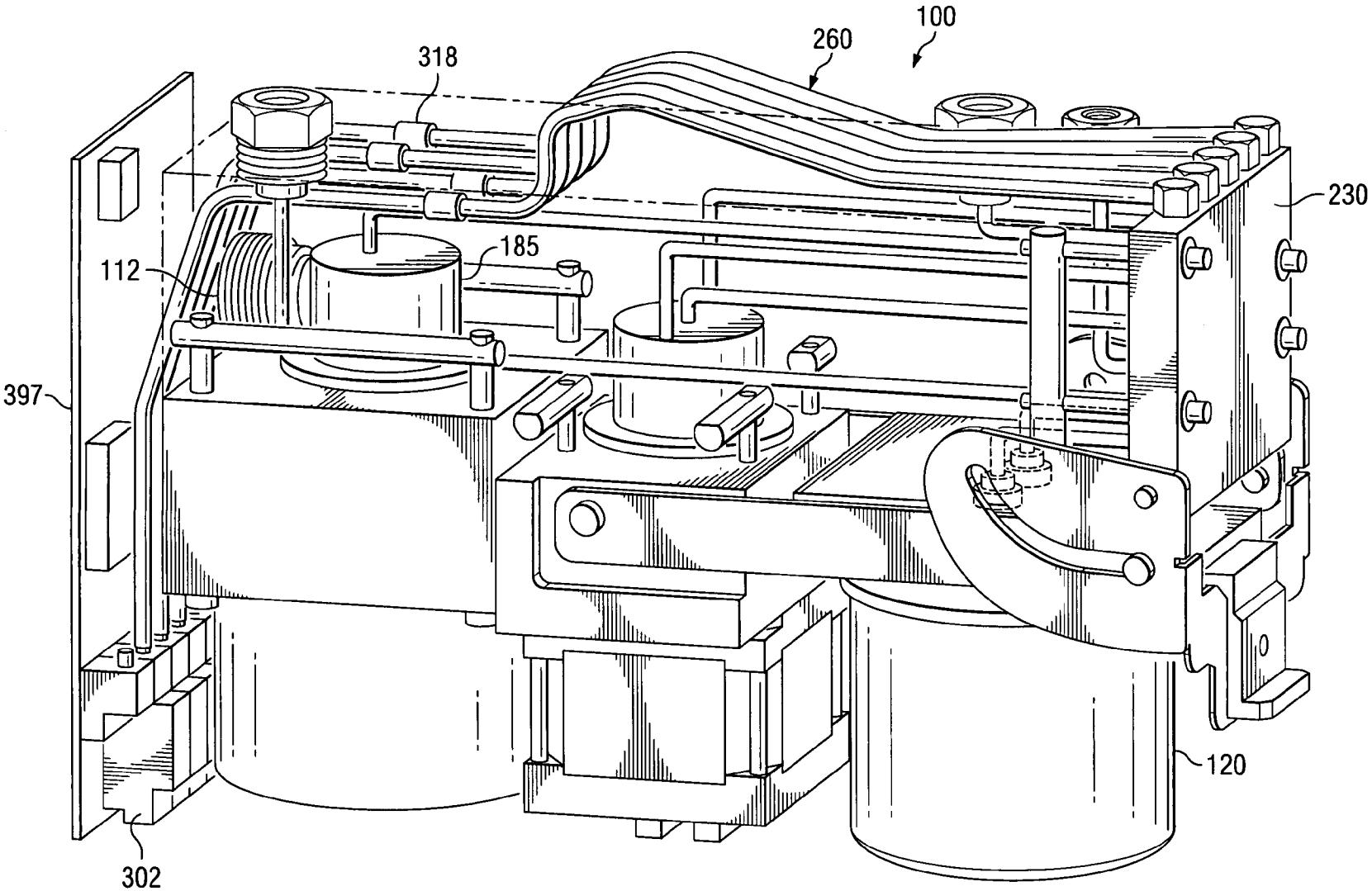

FIG. 5C is a diagrammatic representation of multi-stage pump 100 showing supply lines 260 for providing pressure or vacuum to valve plate 230. As discussed in conjunction with FIG. 4, the valves in valve plate 230 can be configured to allow fluid to flow to various components of multi-stage pump 100. Actuation of the valves is controlled by the valve control manifold 302 that directs either pressure or vacuum to each supply line 260. Each supply line 260 can include a fitting (an example fitting is indicated at 318) with a small orifice. This orifice may be of a smaller diameter than the diameter of the corresponding supply line 260 to which fitting 318 is attached. In one embodiment, the orifice may be approximately 0.010 inches in diameter. Thus, the orifice of fitting 318 may serve to place a restriction in supply line 260. The orifice in each supply line 260 helps mitigate the effects of sharp pressure differences between the application of pressure and vacuum to the supply line and thus may smooth transitions between the application of pressure and vacuum to the valve. In other words, the orifice helps reduce the impact of pressure changes on the diaphragm of the downstream valve. This allows the valve to open and close more smoothly and more slowly which may lead to smoother pressure transitions within the system which may be caused by the opening and closing of the valve and may in fact increase the longevity of the valve itself.

Figure 5D:
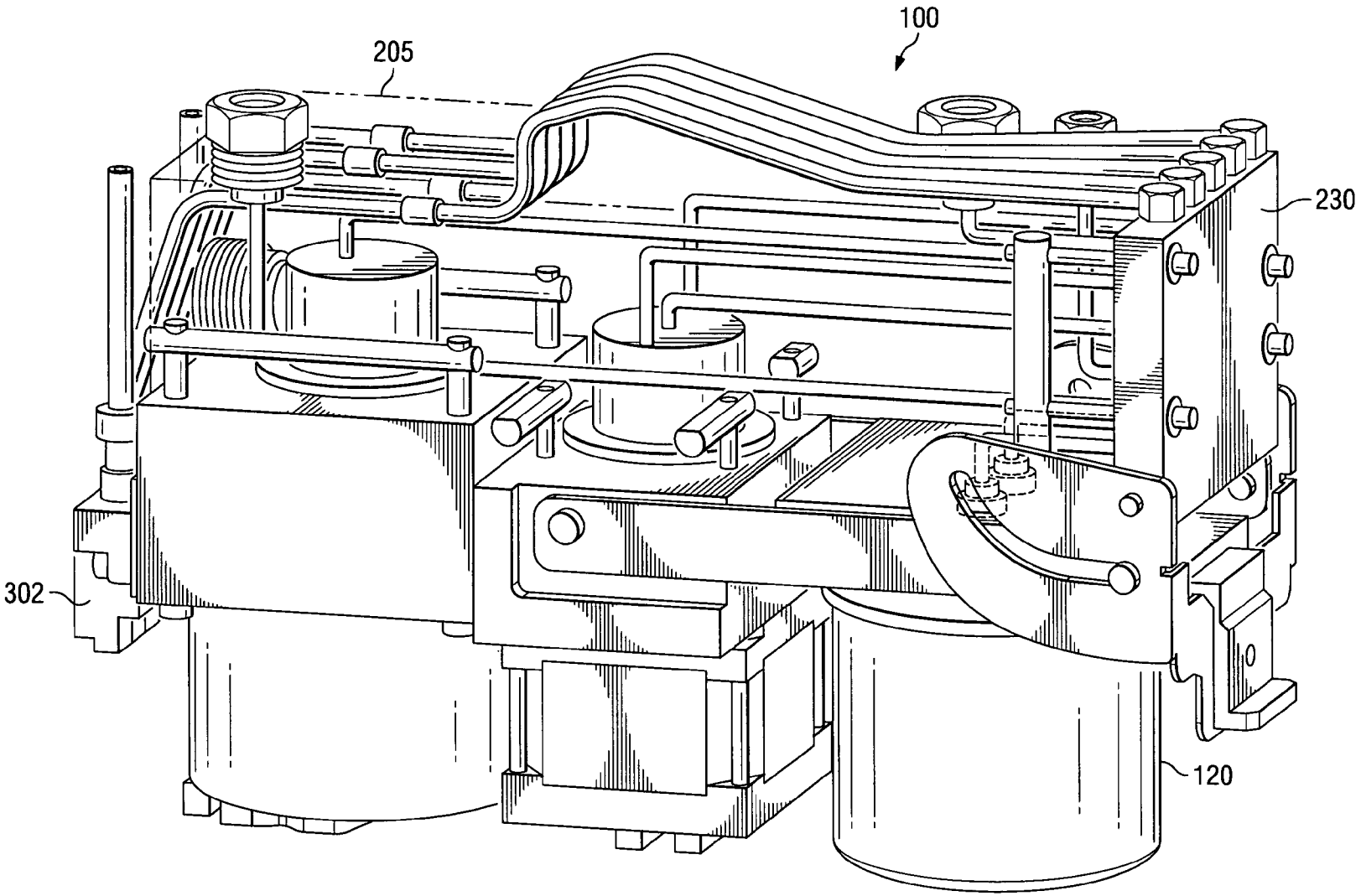

FIG. 5C also illustrates PCB 397. Manifold 302, according to one embodiment of the present invention, can receive signals from PCB board 397 to cause solenoids to open/close to direct vacuum/pressure to the various supply lines 260 to control the valves of multi-stage pump 100. Again, as shown in FIG. 5C, manifold 302 can be located at the distal end of PCB 397 from dispense block 205 to reduce the effects of heat on the fluid in dispense block 205. Additionally, to the extent feasible based on PCB design and space constraints, components that generate heat can be placed on the side of PCB away from dispense block 205, again reducing the effects of heat. Heat from manifold 302 and PCB 397 can be dissipated by back plate 271. FIG. 5D, on the other hand, is a diagrammatic representation of an embodiment of pump 100 in which manifold 302 is mounted directly to dispense block 205.

Figure 6:
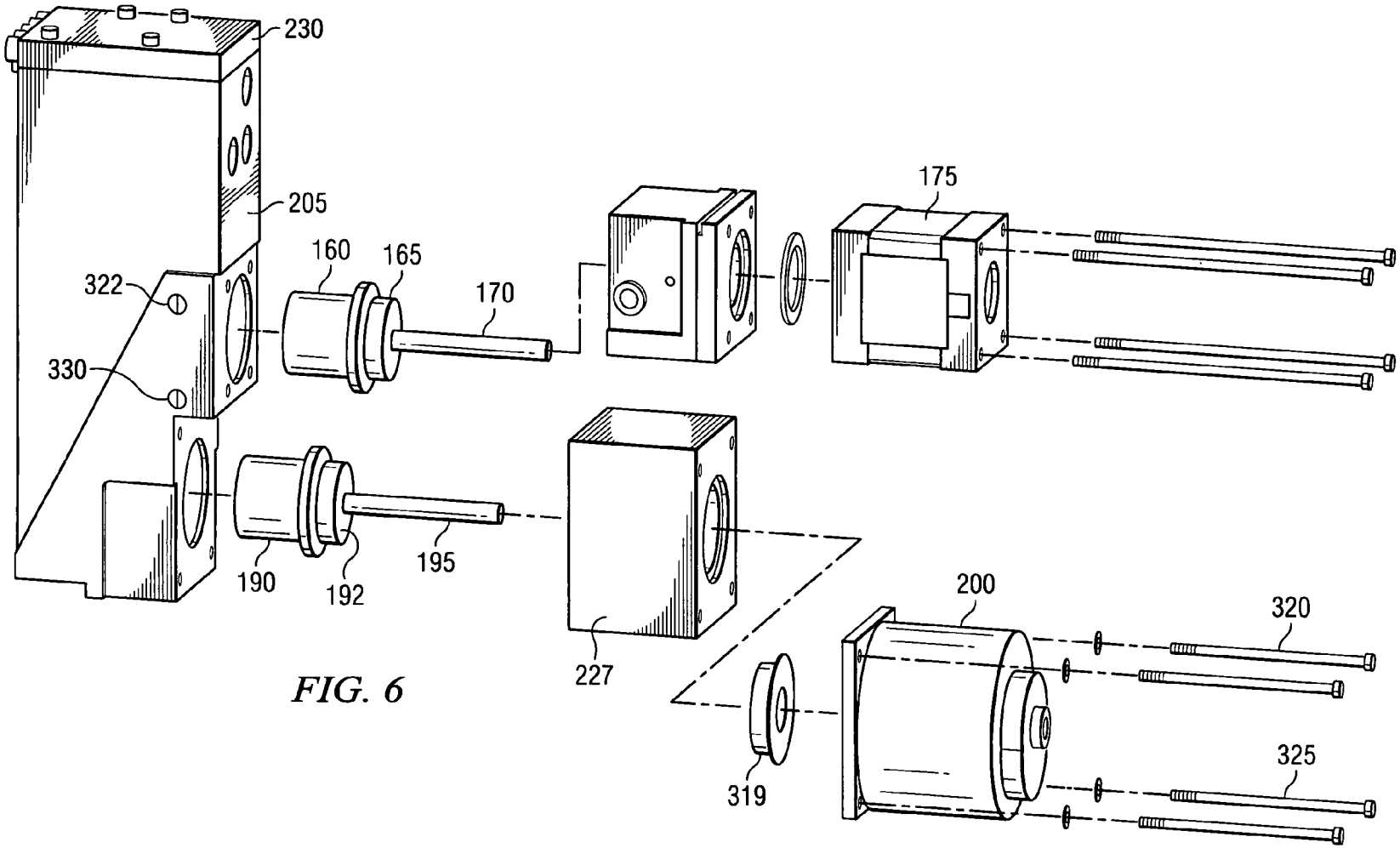
FIG. 6 is a diagrammatic representation of one embodiment of a partial assembly of a multi-stage pump.

FIG. 6 is a diagrammatic representation illustrating the partial assembly of one embodiment of multi-stage pump 100. In FIG. 6, valve plate 230 is already coupled to dispense block 205, as described above. For feed stage pump 150, diaphragm 160 with lead screw 170 can be inserted into the feed chamber 155, whereas for dispense pump 180, diaphragm 190 with lead screw 195 can be inserted into dispense chamber 185. Piston housing 227 is placed over the feed and dispense chambers with the lead screws running there through. In this case a single shaped block acts as a piston housing for the dispense stage piston and feed stage piston, however each stage can have separate housing components. Dispense motor 200 couples to lead screw 195 and can impart linear motion to lead screw 195 through a rotating female-threaded nut. Similarly, feed motor 175 is coupled to lead screw 170 and can also impart linear motion to lead screw 170 through a rotating female-threaded nut. A spacer 319 can be used to offset dispense motor 200 from piston housing 227. Screws in the embodiment shown, attach feed motor 175 and dispense motor 200 to multi-stage pump 100 using bars with threaded holes inserted into dispense block 205, as described in conjunction with FIG. 5. For example, screw 315 can be threaded into threaded holes in bar 320 and screw 325 can be threaded into threaded holes in bar 330 to attach feed motor 175.

Figure 7:
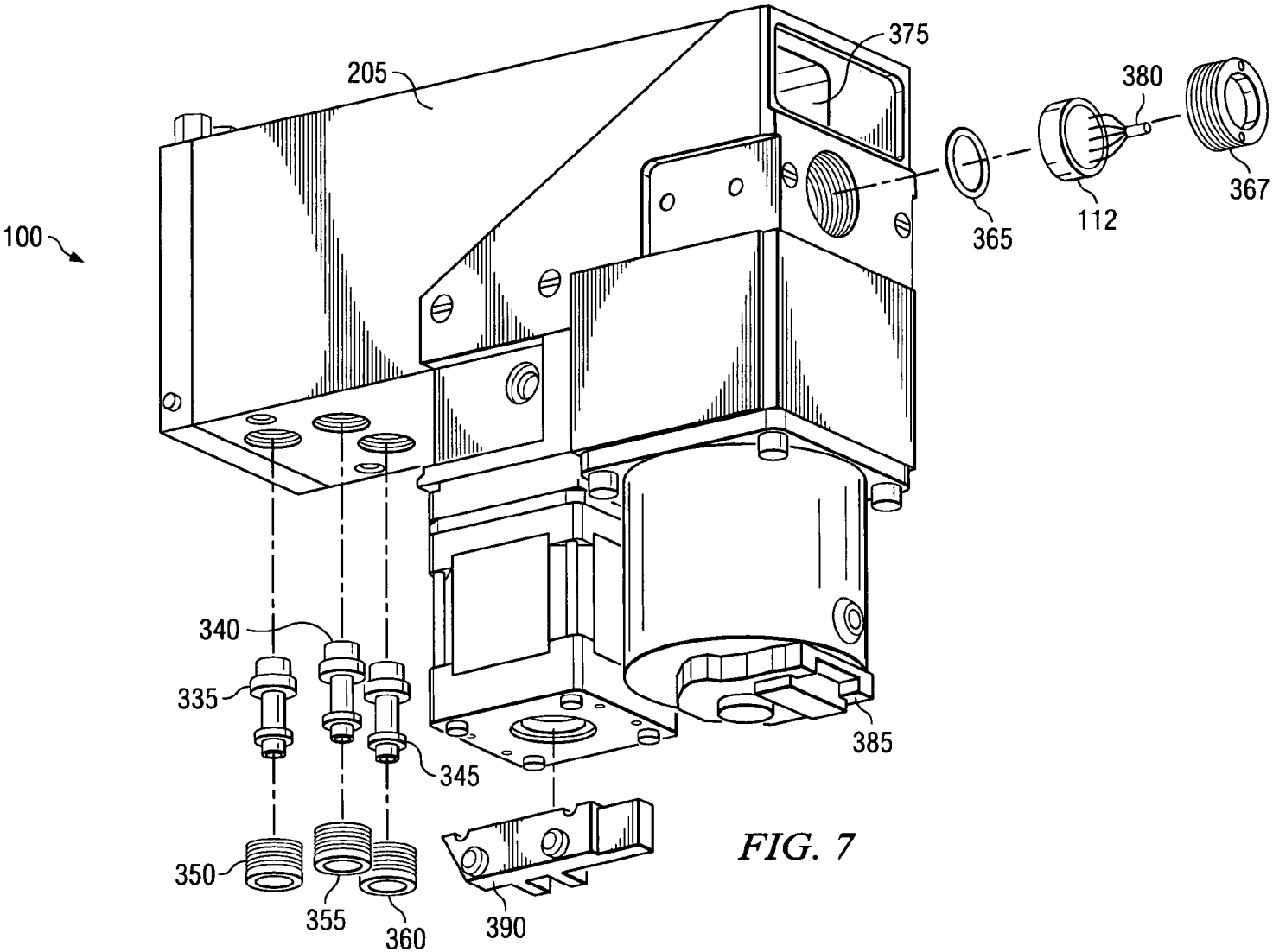
FIG. 7 is a diagrammatic representation of another embodiment of a partial assembly of a multi-stage pump.

FIG. 7 is a diagrammatic representation further illustrating a partial assembly of one embodiment of multi-stage pump 100. FIG. 7 illustrates adding filter fittings 335, 340 and 345 to dispense block 205. Nuts 350, 355, 360 can be used to hold filter fittings 335, 340, 345. U.S. Provisional Patent Application No. 60/741,667, entitled "O-RING-LESS LOW PROFILE FITTING AND ASSEMBLY THEREOF" by Iraj Gashgaee, filed Dec. 2, 2005, which is hereby fully incorporated by reference herein, describes an embodiment of low profile fittings that can be used between filter 120 and dispense block 205. However, it should be noted that any suitable fitting can be used and the fittings illustrated are provided by way of example. Each filter fitting leads to one of the flow passage to feed chamber, the vent outlet or dispense chamber (all via valve plate 230). Pressure sensor 112 can be inserted into dispense block 205, with the pressure sensing face exposed to dispense chamber 185. An o-ring 365 seals the interface of pressure sensor 112 with dispense chamber 185. Pressure sensor 112 is held securely in place by nut 367. The valve control lines (not shown) run from the outlet of the valve manifold (e.g., valve manifold 302) into dispense block 205 at opening 375 and out the top of dispense block 205 to valve plate 230 (as shown in FIG. 4). In other embodiments, the pressure sensor can be located to read pressure in the feed chamber or multiple pressure sensors can be used to determine the pressure in the feed chamber, the dispense chamber or elsewhere in the pump.

FIG. 7 also illustrates several interfaces for communications with a pump controller (e.g., pump controller 20 of FIG. 1). Pressure sensor 112 communicates pressure readings to controller 20 via one or more wires (represented at 380). Dispense motor 200 includes a motor control interface 385 to receive signals from pump controller 20 to cause dispense motor 200 to move. Additionally, dispense motor 200 can communicate information to pump controller 20 including position information (e.g., from a position line encoder). Similarly, feed motor 175 can include a communications interface 390 to receive control signals from and communicate information to pump controller 20.

Figure 8A:
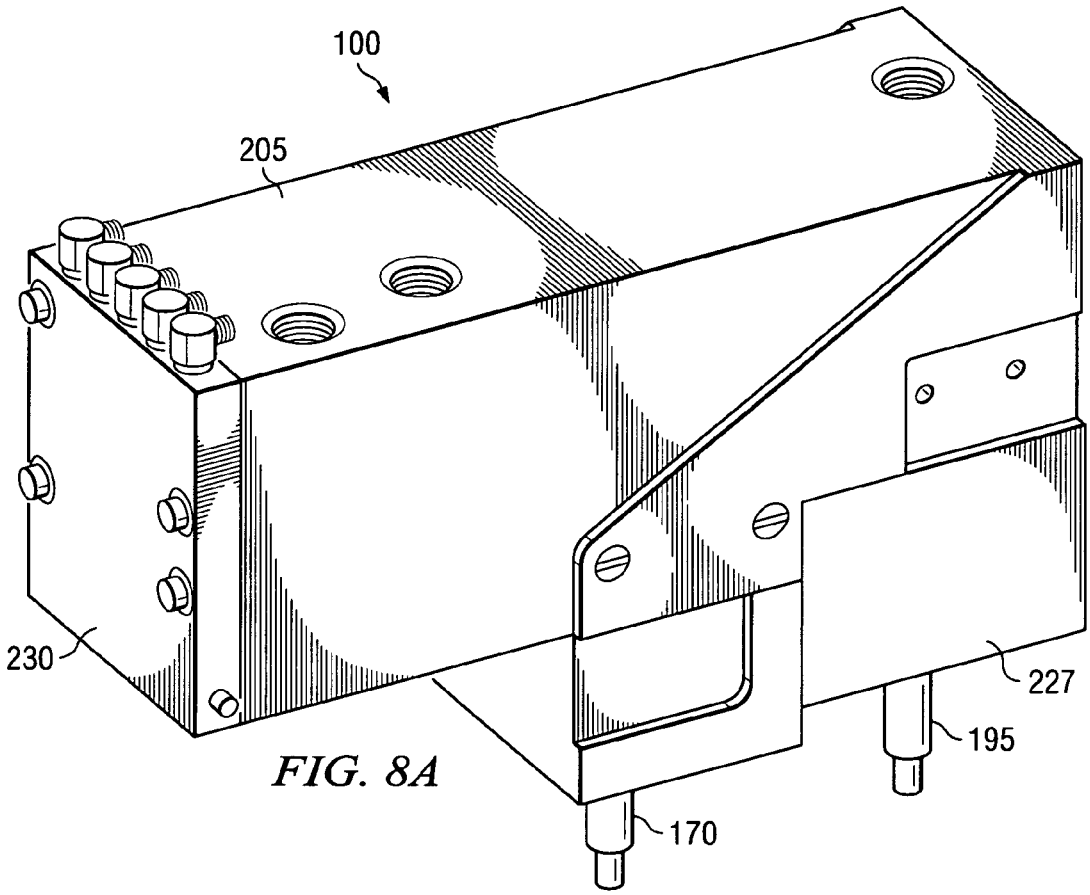
FIG. 8A is a diagrammatic representation of one embodiment of a portion of a multi-stage pump.
Figure 8B:
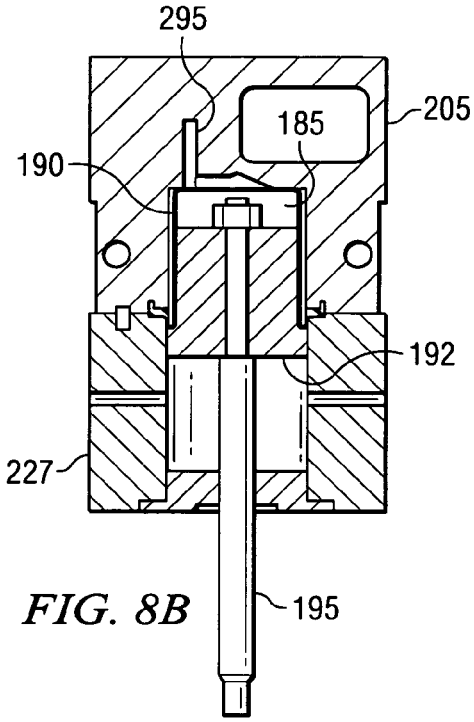
FIG. 8B is diagrammatic representation of a section of the embodiment of multi-stage pump of FIG. 8A including the dispense chamber.
Figure 8C:
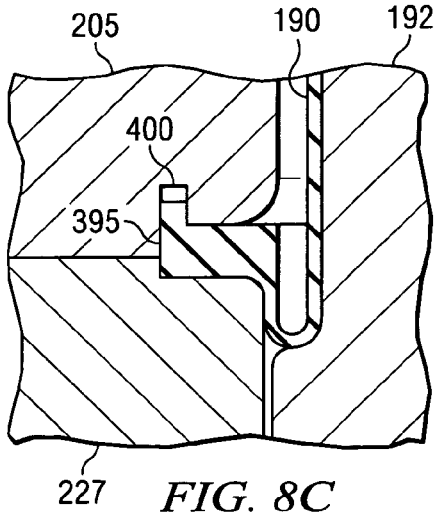
FIG. 8C is a diagrammatic representation of a section of the embodiment of multi-stage pump of FIG. 8B.

FIG. 8A illustrates a side view of a portion of multi-stage pump 100 including dispense block 205, valve plate 230, piston housing 227, lead screw 170 and lead screw 195. FIG. 8B illustrates a section view of FIG. 8A showing dispense block 205, dispense chamber 185, piston housing 227, lead screw 195, piston 192 and dispense diaphragm 190. As shown in FIG. 8B, dispense chamber 185 can be at least partially defined by dispense block 205. As lead screw 195 actuates, piston 192 can move up (relative to the alignment shown in FIG. 8B) to displace dispense diaphragm 190, thereby causing fluid in dispense chamber 185 to exit the chamber via outlet flow passage 295 or purge flow passage 300. In other embodiments, lead screw 195 can rotate as it moves up and down. It should be noted that the entrances and exits of the flow passages can be variously placed in dispense chamber 185 and FIG. 22*b* shows and embodiment in which purge flow passage 300 exits the top of dispense chamber 185. FIG. 8C illustrates a portion of FIG. 8B. In the embodiment shown in FIG. 8C, dispense diaphragm 190 includes a tong 395 that fits into a grove 400 in dispense block 205. The edge of dispense diaphragm 190, in this embodiment, is thus sealed between piston housing 227 and dispense block 205. According to one embodiment, dispense pump and/or feed pump 150 can be a rolling diaphragm pump.

It should be noted that the multi-stage pump 100 described in conjunction with FIGS. 1-8C is provided by way of example, but not limitation, and embodiments of the present invention can be implemented for other multi-stage pump configurations.

Figure 9:
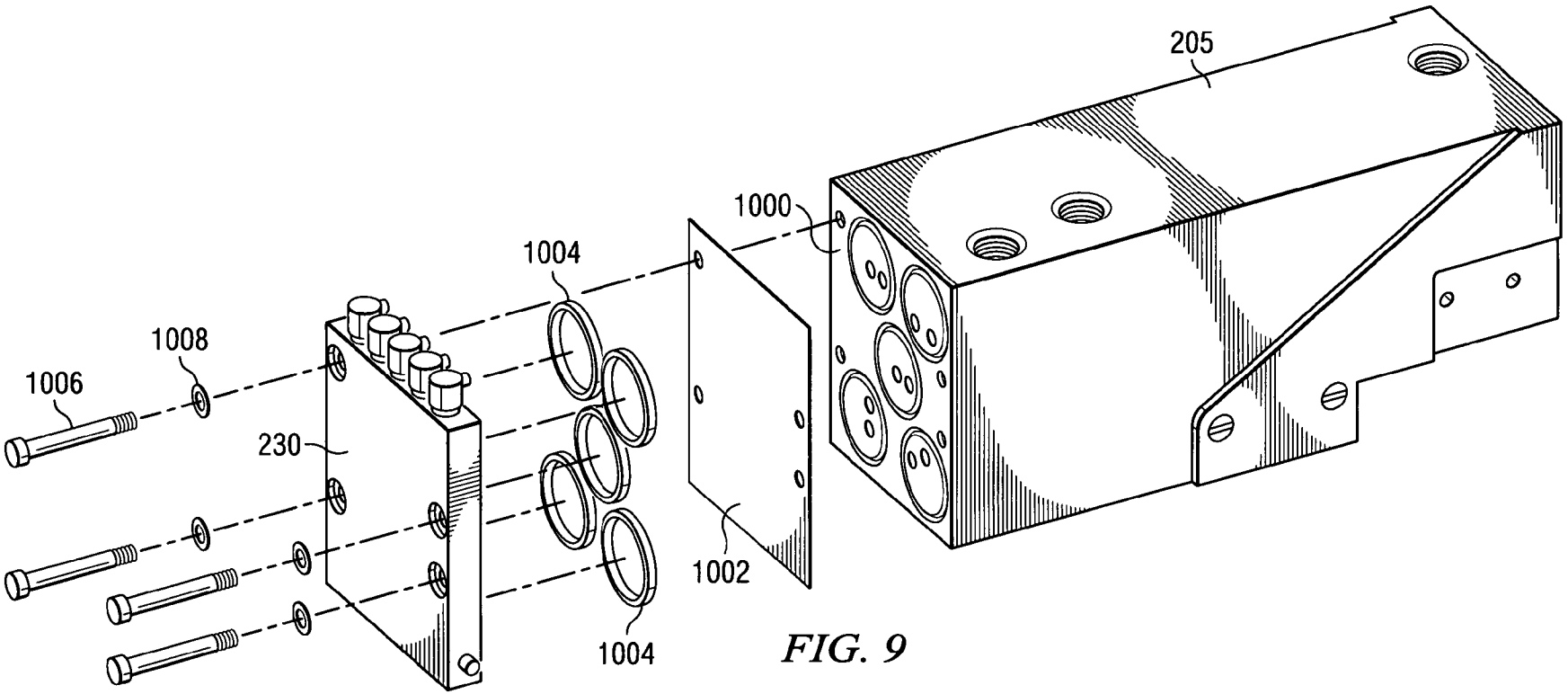
FIG. 9 is a diagrammatic representation illustrating the construction of one or more valves using an embodiment of a valve plate and dispense block.

FIG. 9 illustrates one embodiment of various components used in forming input valve 125, isolation valve 130, barrier valve 135, purge valve 140 and vent valve 145 according to one embodiment of the present invention. Output valve 147 is external to the pump in this embodiment. As shown in FIG. 9, dispense block 205 has an end surface 1000 upon which diaphragm 1002 is placed. O-rings 1004 are aligned with corresponding rings on end surface 1000 and press diaphragm 1002 partially into the rings in dispense block 205. Valve plate 230 also includes corresponding rings in which O-rings 1004 are at least partially seated. Valve plate 230 is connected to dispense block 205 using washers and screws (shown at 1006 and 1008). Thus, as shown in FIG. 9, the body of each valve can be formed of multiple pieces such as the dispense block (or other part of the pump body) and a valve plate. A sheet of elastomeric material, illustrated as diaphragm 1002, is sandwiched between valve plate 230 and dispense block 205 to form the diaphragms of the various valves. Diaphragm 1002, according to one embodiment of the present invention can be a single diaphragm used for each of input valve 125, isolation valve 130, barrier valve 135, purge valve 140 and vent valve 145. Diaphragm 1002 can be PTFE, modified PTFE, a composite material of different layer types or other suitable material that is non-reactive with the process fluid. According to one embodiment, diaphragm 1002 can be approximately 0.013 inches thick. It should be noted that in other embodiments, separate diaphragms can be used for each valve and other types of diaphragms can be used.

Figure 10A:
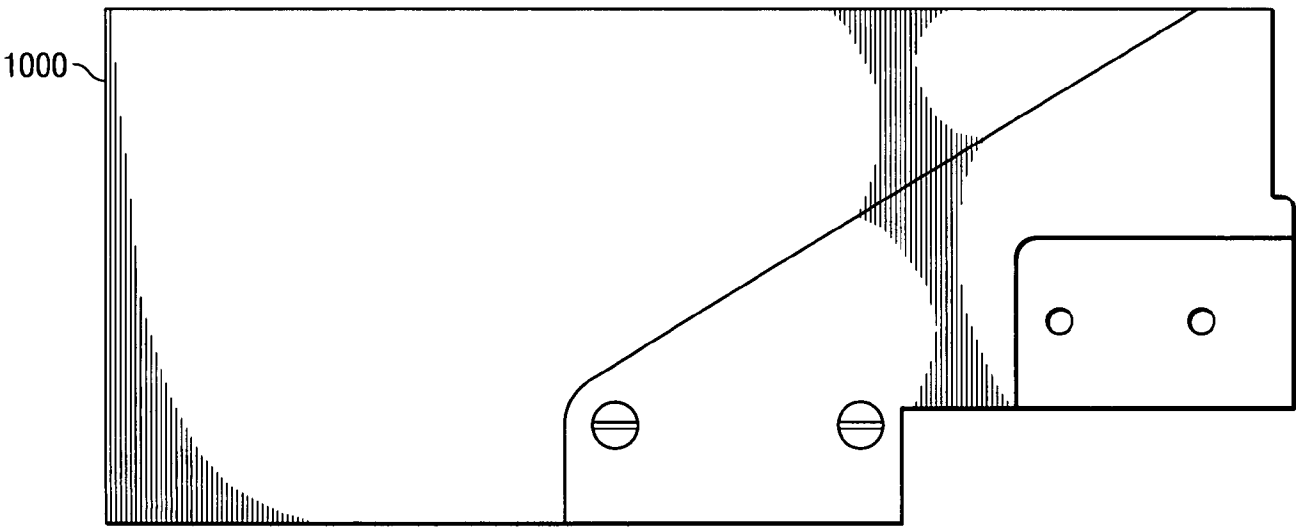
FIG. 10A is a diagrammatic representation of a side view of a dispense block and FIG. 10B is a diagrammatic representation of an end surface of the dispense block.
Figure 10B:
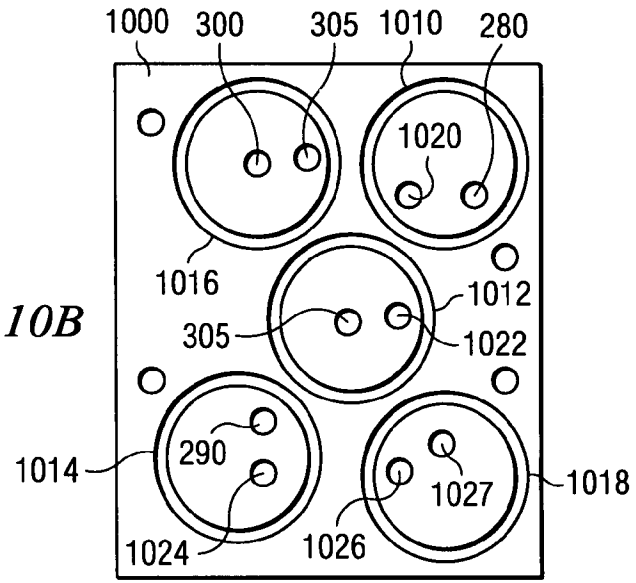

FIG. 10A illustrates one embodiment of a side view of dispense block 205 having end surface 1000. FIG. 10B illustrates one embodiment of end surface 1000 of dispense block 205. For each valve, in the embodiment shown, end surface 1000 includes an annular ring into which an O-Ring partially pushes a portion of the diaphragm. For example, ring 1010 corresponds to input valve 125, ring 1012 corresponds to isolation valve 130, ring 1014 corresponds to barrier valve 135, ring 1016 corresponds to purge valve 130 and ring 1018 corresponds to vent valve 145. FIG. 10B also illustrates the input/output flow passages for each valve. Flow passage 1020 leads from the inlet 210 (shown in FIG. 4) to inlet valve 125 and flow passage 280 leads from inlet valve 125 to the feed chamber; for isolation valve 130, flow passage 305 leads from the feed chamber to isolation valve 130 and flow passage 1022 leads from isolation valve 130 to the filter; for barrier valve 135, flow passage 1024 leads from the filter to barrier valve 135 and flow passage 290 leads from barrier valve 135 to the dispense chamber; for purge valve 140, flow passage 300 leads from the dispense chamber and flow passage 305 leads to the feed chamber; and for vent valve 145, flow passage 1026 leads from the filter and flow passage 1027 leads out of the pump (e.g., out vent 215, shown in FIG. 4). Several of the above-referenced flow passages can be seen running through dispense block 205 in FIGS. 5A-D, above.

Figure 11:
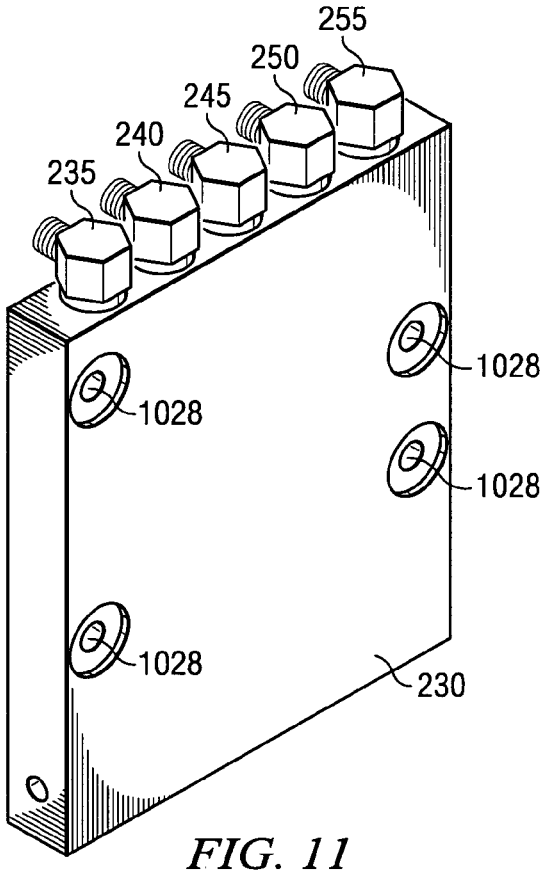
FIG. 11 is a diagrammatic representation of one embodiment of a valve plate.

FIG. 11 is a diagrammatic representation of one embodiment of the outer side of valve plate 230. As shown in FIG. 11, valve plate 230 includes various holes (e.g., represented at 1028) through which screws can be inserted to attached valve plate 230 to dispense block 205. Additionally, shown in FIG. 11 are the valve control inlets for each valve to apply pressure or vacuum to the corresponding diaphragm. For example, inlet 235 corresponds to barrier valve 135, inlet 240 to purge valve 140, inlet 245 to isolation valve 130, inlet 250 to vent valve 145, and inlet 255 to inlet valve 125. By the selective application of pressure or vacuum to the inlets, the corresponding valves are opened and closed.

Figure 12:
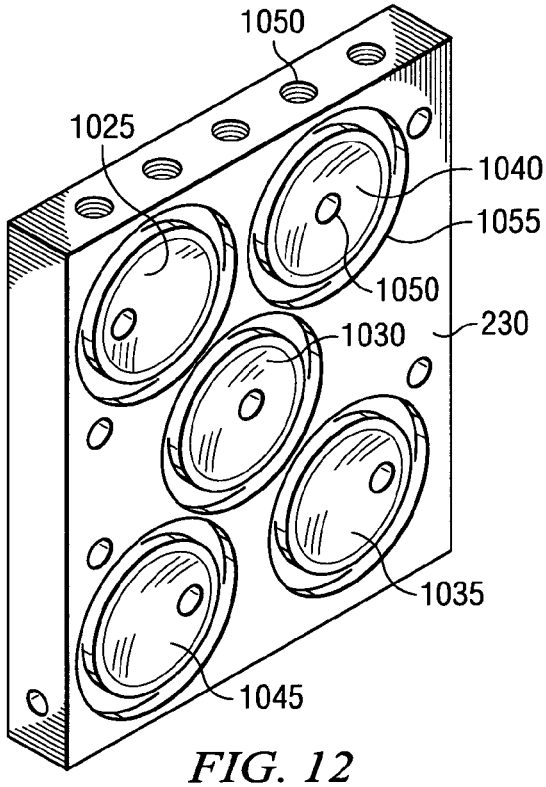
FIG. 12 is a diagrammatic representation of another view of an embodiment of a valve plate.

FIG. 12 is a diagrammatic representation of valve plate 230 showing the inner surface of valve plate 230 (i.e., the surface that faces dispense block 205). For each of inlet valve 125, isolation valve 130, barrier valve 135, purge valve 140 and vent valve 145, valve plate 230 at least partially defines a valve chamber into which a diaphragm (e.g., diaphragm 1002) is displaced when the valve opens. In the example of FIG. 12, chamber 1025 corresponds to inlet valve 125, chamber 1030 to isolation valve 130, chamber 1035 to barrier valve 135, chamber 1040 to purge valve 140 and chamber 1045 to vent valve 140. Each valve chamber preferably has an arced valve seat from the edge of the valve chamber to the center of the valve chamber towards which the diaphragm displaces. For example, if the edge of the valve chamber is circular (as shown in FIG. 12) and radius of the arced surface is constant, the valve chamber will have a semi-hemispherical shape.

Figure 13:
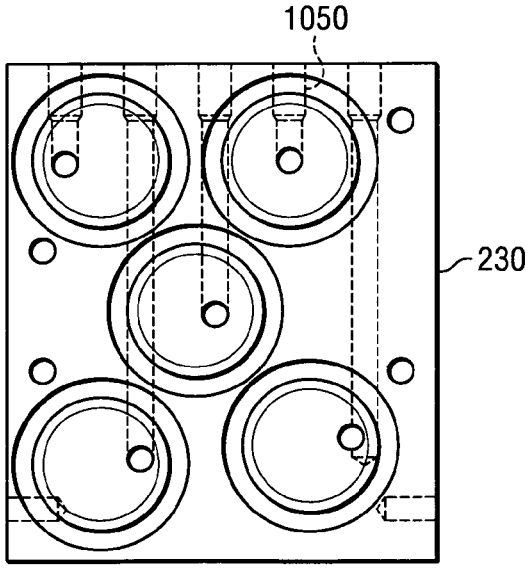
FIG. 13 is a diagrammatic representation of a view of an embodiment of a valve plate showing passages defined in the valve plate.

A flow passage is defined for each valve for the application of a valve control gas/vacuum or other pressure to cause the diaphragm to be displaced between an open position and closed position for a valve. As an example, flow passage 1050 runs from an input on valve control plate 230 to the corresponding opening in the arced surface of purge valve chamber 1040. By selective application of vacuum or low pressure through flow passage 1050, diaphragm 1002 can be displaced into chamber 1040, thereby causing purge valve 140 to open. An annular ring around each valve chamber provides for sealing with O-rings 1004. For example, annular ring 1055 is used to partially contain an o-ring to seal purge valve 140. FIG. 13 is a diagrammatic representation of valve plate 230 made transparent to show the flow passages, including flow passage 1050, for the application of pressure or vacuum to each valve.

Figure 14A:
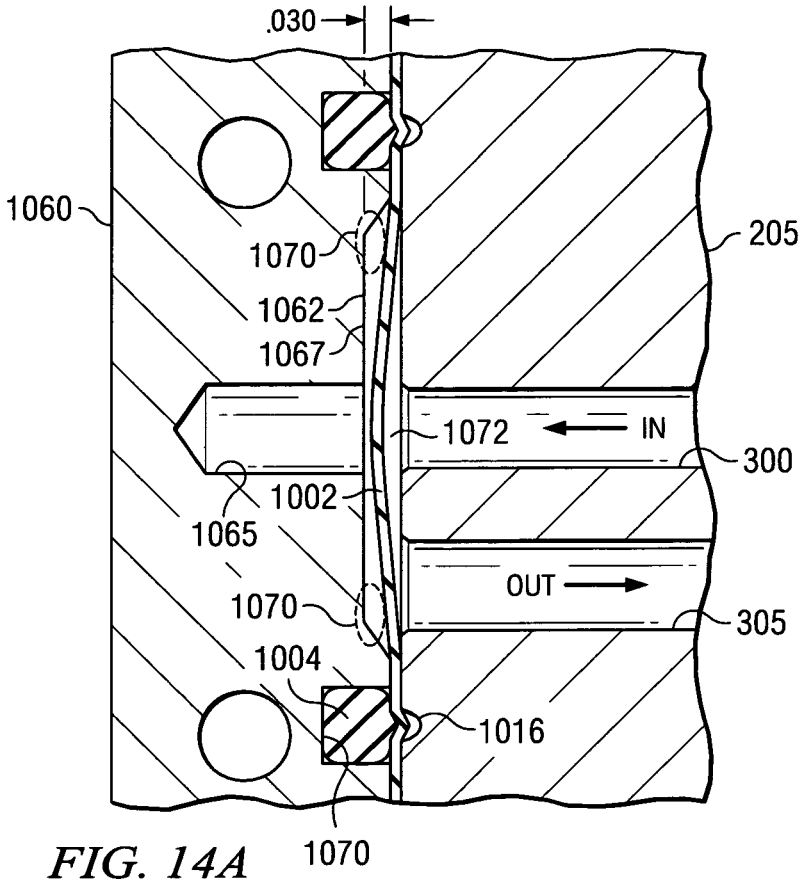
FIG. 14A is a diagrammatic representation of a valve plate having a flat valve chamber.

FIG. 14A is a diagrammatic representation of a valve plate design in which the displacement volume of the valve varies with the amount of pressure applied to diaphragm 1002. Shown in FIG. 14A is an embodiment of a purge valve. In the example of FIG. 14A, a valve plate 1060 is connected to dispense block 205. Diaphragm 1002 is sandwiched between valve plate 1060 and dispense block 205. Valve plate 1060 forms a valve chamber 1062 into which diaphragm 1002 is displaced when vacuum is applied through flow passage 1065. An annular ring 1070 surrounding valve chamber seats o-ring 1004. When valve plate 1060 is attached to dispense block 205, o-ring 1004 presses diaphragm 1002 into annular ring 1016, which further seals the purge valve.

In the embodiment of FIG. 14A, valve chamber 1062 has chamfered sides to a substantially flat surface (indicated at 1067) towards which diaphragm 1002 displaces. When vacuum is applied to diaphragm 1002 through flow passage 1065, diaphragm 1002 displaces towards surface 1067 in a generally semi-hemispherical shape. This means that there will be some dead space (i.e., unused space) between diaphragm 1002 and valve plate 1060. This unused space is indicated at area 1070. As the amount of pull applied through flow passage 1065 increases (i.e., by increasing the vacuum), there is less unused space, however diaphragm 1002 does not completely bottom out. Consequently, depending on the pressure used to displace diaphragm 1002, the displacement volume of diaphragm 1002 changes (e.g., the amount of volume in the bowl of the diaphragm, generally indicated at 1072, changes).

When positive pressure is applied through flow passage 1065, diaphragm 1002 moves to seal the inlet and outlet (in this case flow passage 300 from the dispense chamber and flow passage 305 to the feed chamber). The volume of fluid in area 1072 will therefore be moved out of purge valve 140. This will cause a pressure spike in the dispense chamber (or other enclosed space to which the fluid is moved). The amount of fluid displaced by the valve will depend on how much volume was held up in the valve. Because this volume varies with the amount of pressure applied, different pumps of the same design, but operating using different vacuum pressures, will show different pressure spikes in the dispense chamber or other enclosed space. Moreover, because diaphragm 1002 is plastic, the displacement of diaphragm 1002 for a given vacuum pressure will vary depending on temperature. Consequently, the volume of unused area 1070 will change depending on temperature. Because the displacement volume of the valve of FIG. 14A varies based on the vacuum applied and temperature, it is difficult to accurately compensate for the volume displaced by the pump opening and closing.

Figure 14B:
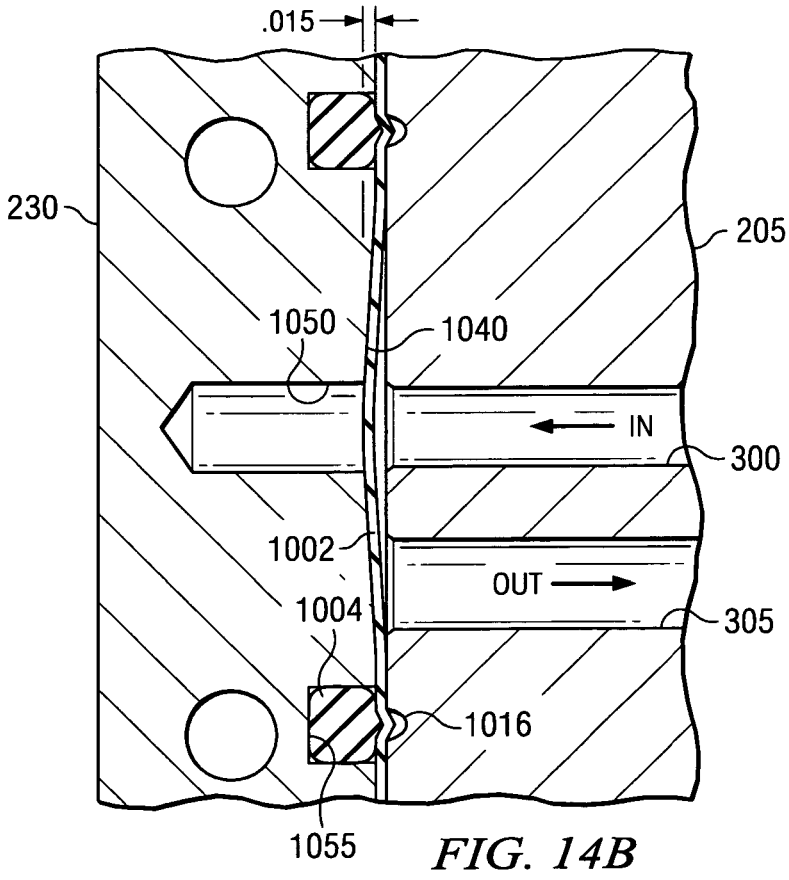
FIG. 14B is a diagrammatic representation of a valve plate having a hemispherical valve chamber.

Embodiments of the present invention reduce or eliminate the problems associated with a valve chamber having a flat surface. FIG. 14B is a diagrammatic representation of one embodiment of a purge valve using a valve plate design according to one embodiment of the present invention. Shown in FIG. 14B is an embodiment of purge valve 140. In the example of FIG. 14B, valve plate 230 is connected to dispense block 205. Diaphragm 1002 is sandwiched between valve plate 230 and dispense block 205. Valve plate 230 forms a valve chamber 1040 into which diaphragm 1002 can be displaced based on the application of vacuum (or low pressure) through flow passage 1050. An annular ring 1055 surrounding valve chamber 1040 seating o-ring 1004. When valve plate 230 is attached to dispense block 205, o-ring 1004 presses diaphragm 1002 into annular ring 1016, further sealing purge valve 140. This creates a seal and fixes diaphragm 1002. According to one embodiment, dispense block 205 can be PTFE or modified PTFE, diaphragm 1002 PFTE or modified PTFE and valve plate 230 machined aluminum. Other suitable materials can be used.

In the embodiment of FIG. 14B, the area of valve chamber 1040 into which diaphragm 1002 displaces is semi-hemispherical. When vacuum is applied to diaphragm 1002 through flow passage 1050, diaphragm 1002 displaces towards the hemispherical surface in a semi-hemispherical shape. By sizing the semi-hemisphere of valve chamber 1040 appropriately, the hemisphere formed by diaphragm 1002 will match the shape of valve chamber 1040. As shown in FIG. 14B, this means that the dead space between the semi-hemisphere of diaphragm 1002 and the surface of the valve chamber (e.g., area 1070 in FIG. 9A) is eliminated. Moreover, because diaphragm 1002 displaces in a semi-hemispherical shape corresponding to the semi-hemispherical shape of valve chamber 1040, diaphragm 1002 will always have the same shape, and hence displacement volume, in its displaced position (this is illustrated in FIG. 10, discussed below). Consequently, the amount of hold up volume in valve 140 will be approximately the same regardless of the amount of vacuum applied (in the operational range of the valve) or temperature. Therefore, the volume of fluid displaced when purge valve 140 closes is the same. This allows a uniform volumetric correction to be implemented to correct for pressure spikes due to the displaced volume when the valve closes. As an additional advantage, the semi-hemispherical shaped valve chamber allows the valve chamber to be shallower. Moreover, because the diaphragm conforms to the shape of the valve seat, the stress on the diaphragm is reduced.

The valve chamber can be sized to allow the diaphragm to displace sufficiently to allow fluid flow from the inlet to the outlet path (e.g., from flow path 300 to flow path 305 of FIG. 5B). Additionally, the valve chamber can be sized to minimize pressure drop while reducing displacement volume. For example, if the valve chamber is made too shallow, diaphragm 1002 may unduly constrict flow passage 305 for a particular application in the open position. However, as the depth of the valve chamber increases, it takes a stronger minimum vacuum to displace the diaphragm to its fully open position (i.e., the position in which the diaphragm is fully displaced into the valve chamber), leading to additional stress on the diaphragm. The valve chamber can be sized to balance the flow characteristics of the valve with the stress on the diaphragm.

It should also be noted that flow passage 1050 for the application of pressure/vacuum to the diaphragm does not have to be centered in the valve chamber, but may be off center (this is shown, for example, on the barrier valve chamber 1035 in FIG. 12). Additionally, the inlet and outlet flow passages to/from the valve can be positioned in any position that allows fluid to flow between them when the valve is open and to be restricted in the closed position. For example, the inlet and outlet flow passages to the valve can be positioned so that, when the valve closes, less of the fluid volume is displaced through a particular passage. In FIG. 14B, because the outlet flow passage 305 to the feed chamber is further from the center of the valve chamber (i.e., further from the center of the hemisphere) than inlet flow passage 300 from the dispense chamber, a smaller amount of fluid will be displaced through flow passage 305 than flow passage 300 when the valve is closed.

However, the positioning of these flow passages with respect to the valve can be reversed or otherwise changed in other embodiments so that less fluid is displaced back to the dispense chamber than displaced to the feed chamber when purge valve 140 closes. For inlet valve 125, on the other hand, the inlet flow passage can be closer to the center so that more fluid is displaced back to the fluid source than to the feed chamber when inlet valve 125 is closed (i.e., inlet valve 125 can have the inlet/outlet flow path arrangement shown in FIG. 14B). The inlets and outlets to various valves (e.g., barrier valve 135, outlet valve 147) can also be arranged, according to various embodiments of the present invention, to reduce the amount of fluid pushed into the dispense chamber when the valves close.

Other configurations of inlet and outlet flow passages can also be utilized. For example, both the inlet and outlet flow passage to a valve can be off center. As another example, the widths of the inlet and outlet flow passages can be different so that one flow passage is more restricted, again helping to cause more fluid to be displaced through one of the flow passages (e.g., the larger flow passage) when the valve closes.

Figure 15:
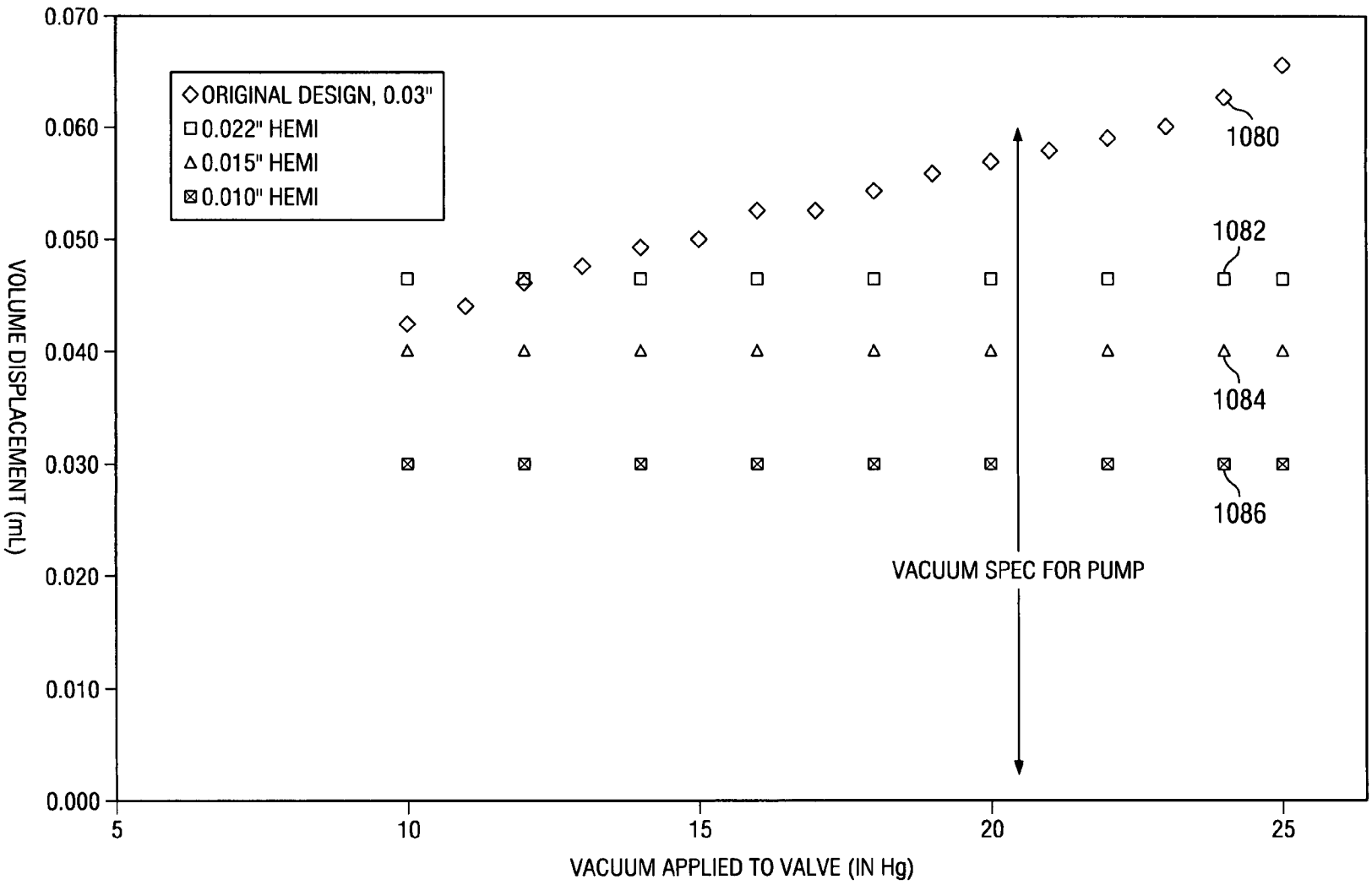
FIG. 15 is a graph illustrating how a hemispherically shaped valve chamber reduces displacement volume fluctuations due to vacuum.

FIG. 15 provides charts illustrating the displacement volume of various valve designs. Line 1080 is for valve design with a valve chamber having a flat valve chamber surface and a depth of 0.030 inches (e.g., the valve depicted in FIG. 14A), line 1082 is for a valve design having a semi-hemispherical valve chamber surface with a depth of 0.022 inches, line 1084 is for a valve design having a semi-hemispherical valve chamber surface with a depth of 0.015 inches (e.g., the valve depicted in FIG. 14B), line 1086 is for a valve having a semi-hemispherical valve chamber surface with a depth of 0.010 inches. The chart of FIG. 15 represents the amount of fluid volume displaced by the valve when the valve control pressure is switched from 35 psi pressure to vacuum. The x axis is the amount of vacuum applied in Hg (inches of mercury) and the y access is the volume displacement in mL. A minimum vacuum of 10 Hg is used to open the valves.

As can be seen from FIG. 15, the valve chamber with a flat valve chamber surface has a different displacement volume depending on the amount of vacuum applied (i.e., if 10 Hg is applied the displacement volume is approximately 0.042 mL, whereas if 20 Hg is applied the displacement volume is approximately 0.058 mL). The valves with hemispherical shaped valve chambers into which the diaphragm displaces, on the other hand, show an approximately constant displacement regardless of the vacuum applied. In this example, the 0.022 inch semi-hemisphere valve displaces 0.047 mL (represented by line 1082), the 0.015 inch semi-hemisphere valve displaces 0.040 mL (represented by line 1084) and the 0.010 inch semi-hemisphere valve displaces 0.030 mL (represented by line 1086). Thus, as can be seen in FIG. 15, a valve plate with semi-hemispherical valve chambers provides for repeatable displacement volumes as the vacuum pressure applied to the valve varies.

Figure 16A:
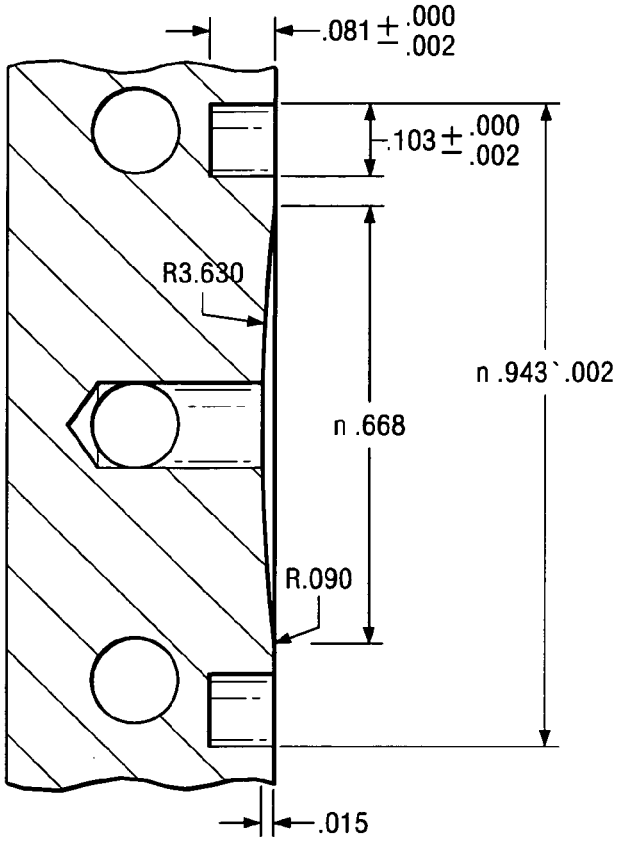
FIG. 16A is a diagrammatic representation of one embodiment of a portion of a valve plate.
Figure 16B:
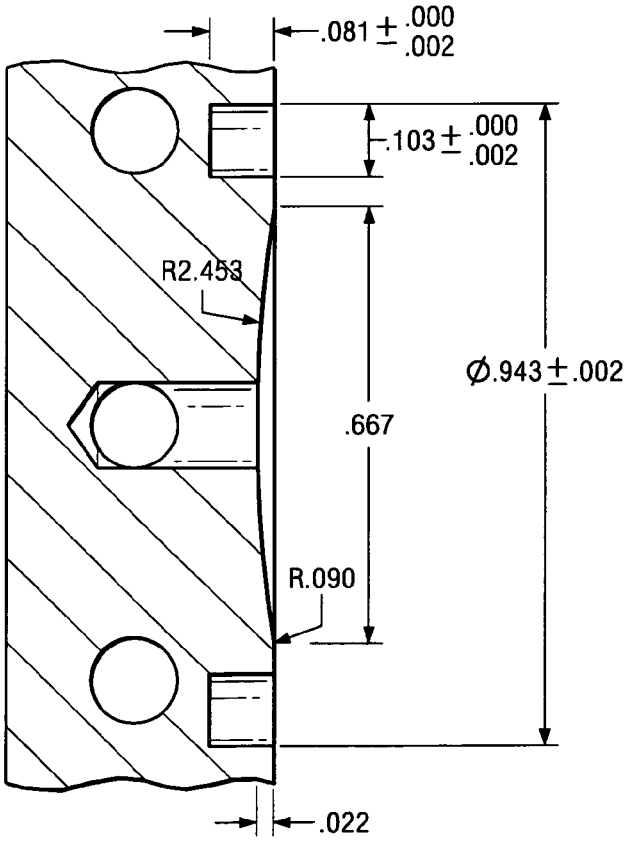
FIG. 16B is a diagrammatic representation of another embodiment of a portion of a valve plate.

The valves of valve plate 230 may have different dimensions. For example, the purge valve 140 can be smaller than the other valves or the valves can be otherwise dimensioned. FIG. 16A provides an example of dimensions for one embodiment of purge valve 140, showing a hemispherical surface 1090 towards the diaphragm displaces. As shown in FIG. 16A, the valve chamber has a hemispherical surface with a spherical depth of 0.015 inches corresponding to a sphere with a radius of 0.3.630 inches. FIG. 16B provides an example of dimensions for one embodiment of input valve 125, isolation valve 130, barrier valve 135 and vent valve 145. In this embodiment, the spherical depth of the valve chamber is 0.022 inches corresponding to a sphere with a radius of 2.453 inches.

The size of each valve can be selected to balance the desire to minimize the pressure drop across the valve (i.e., the desire to minimize the restriction caused by the valve in the open position) and the desire to minimize the amount of hold up volume of the valve. That is, the valves can be dimensioned to balance the desire for minimally restricted flow and to minimize pressure spikes when the valve opens/closes. In the examples of FIGS. 16A and 16B, purge valve 140 is the smallest valve to minimize the amount of holdup volume that returns to the dispense chamber when purge valve 140 closes. Additionally, the valves can be dimensioned to be fully opened when a threshold vacuum is applied. For example, purge valve 140 of FIG. 16A is dimensioned to be fully opened when 10 Hg of vacuum is applied. As the vacuum increases, purge valve 140 will not open any further. The dimensions provided in FIGS. 16A and 16B are provided by way of example only for a specific implementation and are not provided for limitation. Valves according embodiments of the present invention can have a wide variety of dimensions. Embodiments of valve plates are also described in U.S. Provisional Application No. 60/742,147, entitled "VALVE PLATE SYSTEM AND METHOD", by Inventors Gashgaee et al., filed Dec. 2, 2005 and U.S. patent application Ser. No. 11/602,457, entitled "FIXED VOLUME VALVE SYSTEM", by Inventors Gashgaee et al., filed Nov. 20, 2006, which are hereby fully incorporated by reference herein.

As discussed above, feed pump 150 according to one embodiment of the present invention can be driven by a stepper motor while dispense pump 180 can be driven by a brushless DC motor or PSMS motor. FIGS. 17-19 below describe embodiments of motors usable according to various embodiments of the present invention. Examples of control schemes for motors are described in U.S. Provisional Application No. 60/741,660, entitled "SYSTEM AND METHOD FOR POSITION CONTROL OF A MECHANICAL PISTON IN A PUMP", by Inventors Gonnella et al., filed Dec. 2, 2005 and U.S. Provisional Application No. 60/841,725, entitled "SYSTEM AND METHOD FOR POSITION CONTROL OF A MECHANICAL PISTON IN A PUMP", by Inventors Gonnella et al., filed Sep. 1, 2006, which are hereby fully incorporated by reference herein.

FIG. 17 is a schematic representation of a motor assembly 3000 with a motor 3030 and a position sensor 3040 coupled thereto, according to one embodiment of the invention. In the example shown in FIG. 17, a diaphragm assembly 3010 is connected to motor 3030 via a lead screw 3020. In one embodiment, motor 3030 is a permanent magnet synchronous motor ("PMSM"). In a brush DC motor, the current polarity is altered by the commutator and brushes. However, in a PMSM, the polarity reversal is performed by power transistors switching in synchronization with the rotor position. Hence, a PMSM can be characterized as "brushless" and is considered more reliable than brush DC motors. Additionally, a PMSM can achieve higher efficiency by generating the rotor magnetic flux with rotor magnets. Other advantages of a PMSM include reduced vibration, reduced noises (by the elimination of brushes), efficient heat dissipation, smaller foot prints and low rotor inertia. Depending upon how the stator is wounded, the back-electromagnetic force, which is induced in the stator by the motion of the rotor, can have different profiles. One profile may have a trapezoidal shape and another profile may have a sinusoidal shape. Within this disclosure, the term PMSM is intended to represent all types of brushless permanent magnet motors and is used interchangeably with the term brushless DC motors ("BLDCM").

PMSM 3030 can be utilized as feed motor 175 and/or dispense motor 200 as described above. In one embodiment, pump 100 utilizes a stepper motor as feed motor 175 and PMSM 3030 as dispense motor 200. Suitable motors and associated parts may be obtained from EAD Motors of Dover, N.H., USA or the like. In operation, the stator of BLDCM 3030 generates a stator flux and the rotor generates a rotor flux. The interaction between the stator flux and the rotor flux defines the torque and hence the speed of BLDCM 3030. In one embodiment, a digital signal processor (DSP) is used to implement all of the field-oriented control (FOC). The FOC algorithms are realized in computer-executable software instructions embodied in a computer-readable medium. Digital signal processors, alone with on-chip hardware peripherals, are now available with the computational power, speed, and programmability to control the BLDCM 3030 and completely execute the FOC algorithms in microseconds with relatively insignificant add-on costs. One example of a DSP that can be utilized to implement embodiments of the invention disclosed herein is a 16-bit DSP available from Texas Instruments, Inc. based in Dallas, Tex., USA (part number TMS320F2812PGFA).

BLDCM 3030 can incorporate at least one position sensor to sense the actual rotor position. In one embodiment, the position sensor may be external to BLDCM 3030. In one embodiment, the position sensor may be internal to BLDCM 3030. In one embodiment, BLDCM 3030 may be sensorless. In the example shown in FIG. 17, position sensor 3040 is coupled to BLDCM 3030 for real time feedback of BLDCM 3030's actual rotor position, which is used by the DSP to control BLDCM 3030. An added benefit of having position sensor 3040 is that it proves extremely accurate and repeatable control of the position of a mechanical piston (e.g., piston 192 of FIG. 2), which means extremely accurately and repeatable control over fluid movements and dispense amounts in a piston displacement dispense pump (e.g., dispense pump 180 of FIG. 2). In one embodiment, position sensor 3040 is a fine line rotary position encoder. In one embodiment, position sensor 3040 is a 2000 line encoder. Using a 2000 line encoder giving 8000 pulses to the DSP, it is possible to accurately measure to and control at 0.045 degrees of rotation.

BLDCM 3030 can be run at very low speeds and still maintain a constant velocity, which means little or no vibration. In other technologies such as stepper motors it has been impossible to run at lower speeds without introducing vibration into the pumping system, which was caused by poor constant velocity control. This variation would cause poor dispense performance and results in a very narrow window range of operation. Additionally, the vibration can have a deleterious effect on the process fluid. Table 1 below and FIGS. 18-19 compare a stepper motor and a BLDCM and demonstrate the numerous advantages of utilizing BLDCM 3030 as dispense motor 200 in multi-stage pump 100.

TABLE 1

| Item | Stepper Motor | BLDCM |
|---|---|---|
| Volume resolution (μl/step) | 1 | 0.1<br>10x improvement |
| Basic motion | Move, stop, wait, move, stop wait; Causes motor vibration and "dispense flicker" at low rates | Continuous motion, never stops |
| Motor current, Power | Current is set and power consumed for maximum conditions, whether required or not | Adaptable to load |
| Torque delivery | Low | High |
| Speed capability | 10-30x | 30,000x |

As can be seen from TABLE 1, compared to a stepper motor, a BLDCM can provide substantially increased resolution with continuous rotary motion, lower power consumption, higher torque delivery, and wider speed range. Note that, BLDCM resolution can be about 10 times more or better than what is provided by the stepper motor. For this reason, the smallest unit of advancement that can be provided by BLDCM is referred to as a "motor increment," distinguishable from the term "step", which is generally used in conjunction with a stepper motor. The motor increment is smallest measurable unit of movement as a BLDCM, according to one embodiment, can provide continuous motion, whereas a stepper motor moves in discrete steps.

FIG. 18 is a plot diagram comparing average torque output and speed range of a stepper motor and a BLDCM, according to one embodiment of the invention. As illustrated in FIG. 18, the BLDCM can maintain a nearly constant high torque output at any speed. In addition, the usable speed range of the BLDCM is wider (e.g., about 1000 times or more) than that of the stepper motor. In contrast, the stepper motor tends to have lower torque output which tends to undesirably fall off with increased speed (i.e., torque output is reduced at higher speed).

FIG. 19 is a plot diagram comparing average motor current and load between a stepper motor and a BLDCM, according to one embodiment of the invention. As illustrated in FIG. 6, the BLDCM can adapt and adjust to load on system and only uses power required to carry the load. In contrast, whether it is required or not, the stepper motor uses current that is set for maximum conditions. For example, the peak current of a stepper motor is 150 milliamps (mA). The same 150 mA is used to move a 1-lb. load as well as a 10-lb. load, even though moving a 1-lb. load does not need as much current as a 10-lb. load. Consequently, in operation, the stepper motor consumes power for maximum conditions regardless of load, causing inefficient and wasteful use of energy.

With the BLDCM, current is adjusted with an increase or decrease in load. At any particular point in time, the BLDCM will self-compensate and supply itself with the amount of current necessary to turn itself at the speed requested and produce the force to move the load as required. The current can be very low (under mA) when the motor is not moving. Because a BLDCM is self-compensating (i.e., it can adaptively adjust current according to load on system), it is always on, even when the motor is not moving. In comparison, the stepper motor could be turned off when the stepper motor is not moving, depending upon applications.

To maintain position control, the control scheme for the BLDCM needs to be run very often. In one embodiment, the control loop is run at 30 kHz. So, every 33 μs, the control loop checks to see if the BLDCM is at the right position. If so, try not to do anything. If not, it adjusts the current and tries to force the BLDCM to the position where it should be. This rapid self-compensating action enables a very precise position control, which is highly desirable in some applications. Running the control loop at a speed higher (e.g., 30 kHz) than normal (e.g., 10 kHz) could mean extra heat generation in the system. This is because the more often the BLDCM switches current, the more opportunity to generate heat.

According to one aspect of the invention, in some embodiments the BLDCM is configured to take heat generation into consideration. Specifically, the control loop is configured to run at two different speeds during a single cycle. During the dispense portion of the cycle, the control loop is run at a higher speed (e.g., 30 kHz). During the rest of the non-dispense portion of the cycle, the control loop is run at a lower speed (e.g., 10 kHz). This configuration can be particularly useful in applications where super accurate position control during dispense is critical. As an example, during the dispense time, the control loop runs at 30 kHz. It might cause a bit of extra heat, but provides an excellent position control. The rest of the time the speed is cut back to 10 kHz. By doing so, the temperature can be significantly dropped.

The dispense portion of the cycle could be customized depending upon applications. As another example, a dispense system may implement 20-second cycles. On one 20-second cycle, 5 seconds may be for dispensing, while the rest 15 seconds may be for logging or recharging, etc. In between cycles, there could be a 15-20 seconds ready period. Thus, the control loop of the BLDCM would run a small percentage of a cycle (e.g., 5 seconds) at a higher frequency (e.g., 30 kHz) and a larger percentage (e.g., 15 seconds) at a lower frequency (e.g., 10 kHz).

As one skilled in the art can appreciate, these parameters (e.g., 5 seconds, 15 seconds, 30 kHz, 10 kHz. etc.) are meant to be exemplary and non-limiting. Operating speed and time can be adjusted or otherwise configured to suit so long as they are within the scope and spirit of the invention disclosed herein. Empirical methodologies may be utilized in determining these programmable parameters. For example, 10 kHz is a fairly typical frequency to drive the BLDCM. Although a different speed could be used, running the control loop of the BLDCM slower than 10 kHz could run the risk of losing position control. Since it is generally difficult to regain the position control, it is desirable for the BLDCM to hold the position.

Reducing speed as much as possible during the non-dispense phase of the cycle without undesirably compromising the position control is achievable in embodiments disclosed herein via a control scheme for the BLDCM. The control scheme is configured to increase the frequency (e.g., 30 kHz) in order to gain some extra/increased position control for critical functions such as dispensing. The control scheme is also configured to reduce heat generation by allowing non-critical functions to be run at a lower frequency (e.g., 10 kHz). Additionally, the custom control scheme is configured to minimize any position control losses caused by running at the lower frequency during the non-dispense cycle.

The control scheme is configured to provide a desirable dispense profile, which can be characterized by pressure. The characterization can be based on deviation of the pressure signal. For example, a flat pressure profile would suggest smooth motion, less vibration, and therefore better position control. Contrastingly, deviating pressure signals would suggest poor position control. As far as position control is concerned, the difference between running the BLDCM at 10 kHz and at 15 kHz can be insignificant. However, if the speed drops below 10 kHz (e.g., 5 kHz), it may not be fast enough to retain position control. For example, one embodiment of the BLDCM is configured for dispensing fluids. When the position loop runs under 1 ms (i.e., at about 10 kHz or more), no effects are visible to the human eye. However, when it gets up to the 1, 2, or 3 ms range, effects in the fluid become visible. As another example, if the timing of the valve varies under 1 ms, any variation in the results of the fluid may not be visible to the human eye or by other process monitors. In the 1, 2, or 3 ms range, however, the variations can be visible. Thus, the control scheme preferably runs time critical functions (e.g., timing the motor, valves, etc.) at about 10 kHz or more.

Another consideration concerns internal calculations in the dispense system. If the dispense system is set to run as slow as 1 kHz, then there is not any finer resolution than 1 ms and no calculations that need to be finer than 1 ms can be performed. In this case, 10 kHz would be a practical frequency for the dispense system. As described above, these numbers are meant to be exemplary. It is possible to set the speed lower than 10 kHz (e.g., 5 or even 2 kHz).

Similarly, it is possible to set the speed higher than 30 kHz, so long as it satisfies the performance requirement. The exemplary dispense system disclosed herein uses an encoder which has a number of lines (e.g., 2000 lines to give 8000 pulses to the DSP). The time between each line is the speed. Even if the BLDCM is running fairly slowly, these are very fine lines so they can come very fast, basically pulsing to the encoder. If the BLDCM runs one revolution per a second, that means 2000 lines and hence 8000 pulses in that second. If the widths of the pulses do not vary (i.e., they are right at the target width and remain the same over and over), it is an indication of a very good speed control. If they oscillate, it is an indication of a poorer speed control, not necessarily bad, depending on the system design (e.g., tolerance) and application.

Another consideration concerns the practical limit on the processing power of a digital signal processor (DSP). As an example, to dispense in one cycle, it may take almost or just about 20 ms to perform all the necessary calculations for the position controller, the current controllers, and the like. Running at 30 kHz gives about 30 ms, which is sufficient to do those calculations with time left to run all other processes in the controllers. It is possible to use a more powerful processor that can run faster than 30 kHz. However, operating at a rate faster than 30 ms results a diminishing return. For example, 50 kHz only gives about 20 ms ($1/50000$ Hz=0.00002 s=20 μs). In this case, a better speed performance can be obtained at 50 kHz, but the system has insufficient time to conduct all the processes necessary to run the controllers, thus causing a processing problem. What is more, running 50 kHz means that the current will switch that much more often, which contributes to the aforementioned heat generation problem.

In summary, to reduce the heat output, one solution is to configure the BLDCM to run at a higher frequency (e.g., 30 kHz) during dispensing and drop down or cut back to a lower frequency (e.g., 10 kHz) during non-dispensing operations (e.g., recharge). Factors to consider in configuring the custom control scheme and associated parameters include position control performance and speed of calculation, which relates to the processing power of a processor, and heat generation, which relates to the number of times the current is switched after calculation. In the above example, the loss of position performance at 10 kHz is insignificant for non-dispense operations, the position control at 30 kHz is excellent for dispensing, and the heat generation is significantly reduced. By reducing the heat generation, embodiments of the invention can provide a technical advantage in preventing temperature changes from affecting the fluid being dispensed. This can be particularly useful in applications involving dispensing sensitive and/or expensive fluids, in which case, it would be highly desirable to avoid any possibility that heat or temperature change may affect the fluid. Heating a fluid can also affect the dispense operation. One such effect is called the natural suck-back effect. The suck-back effect explains that when the dispense operation warms and expands the fluid out of the nozzle, it starts to cool and as it starts to cool, it can lose a little bit. When the dispense operation retracts, the fluid in the nozzle starts to increase the volume. Therefore, with the suck-back effect the volume may not be precise and may be inconsistent.

Figures 20B, 20C:
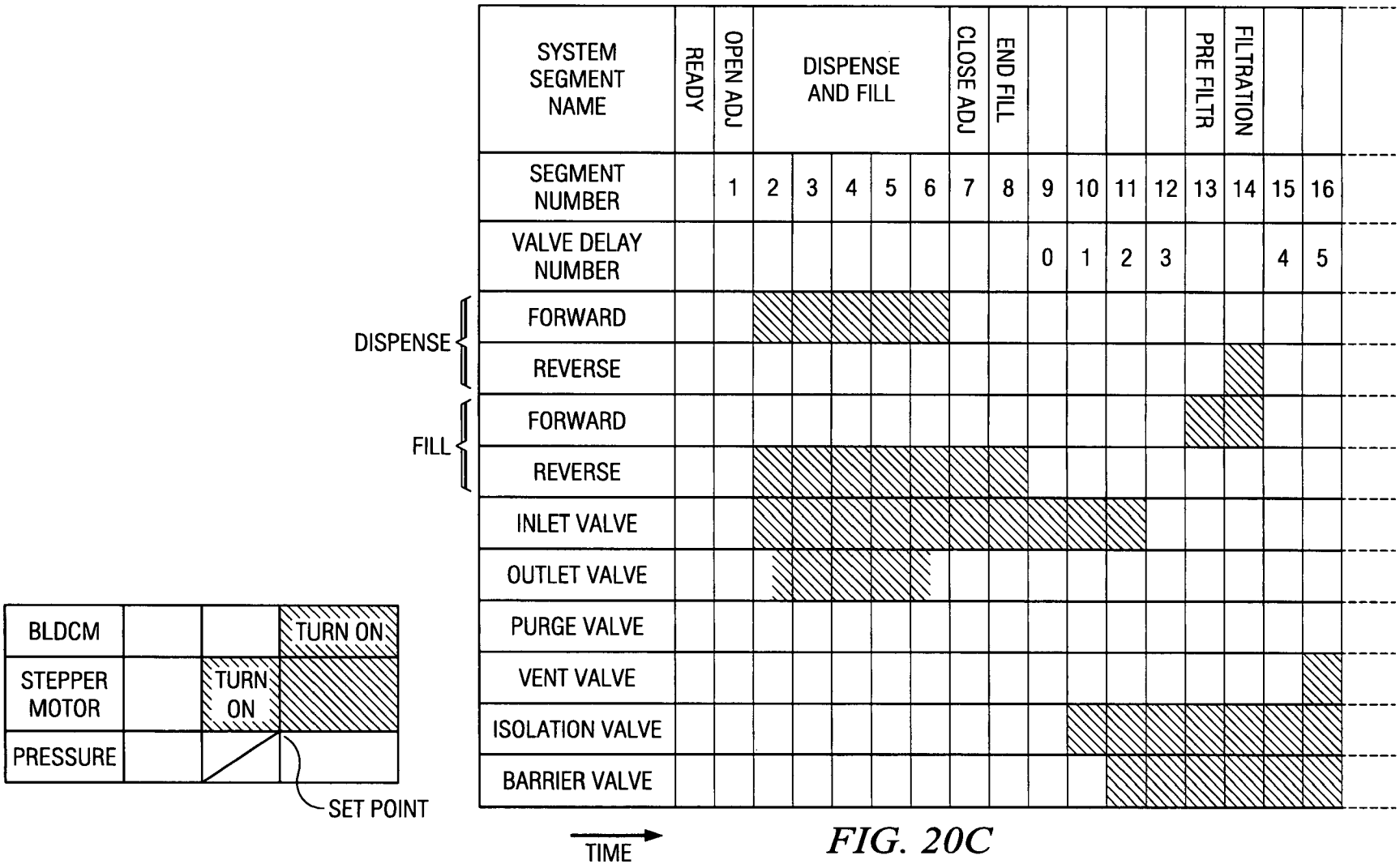
Figure 20D:
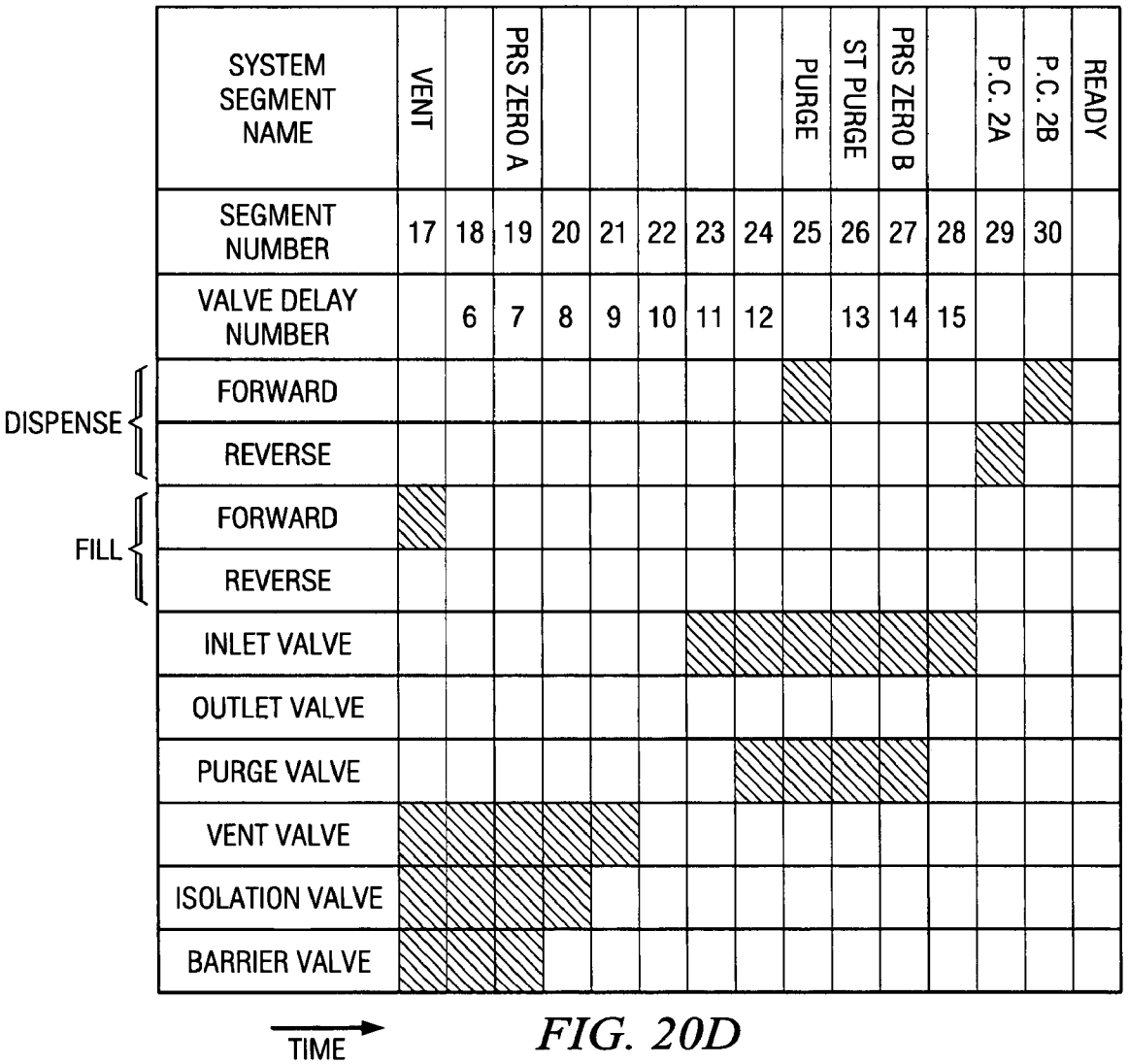
Figure 20E:
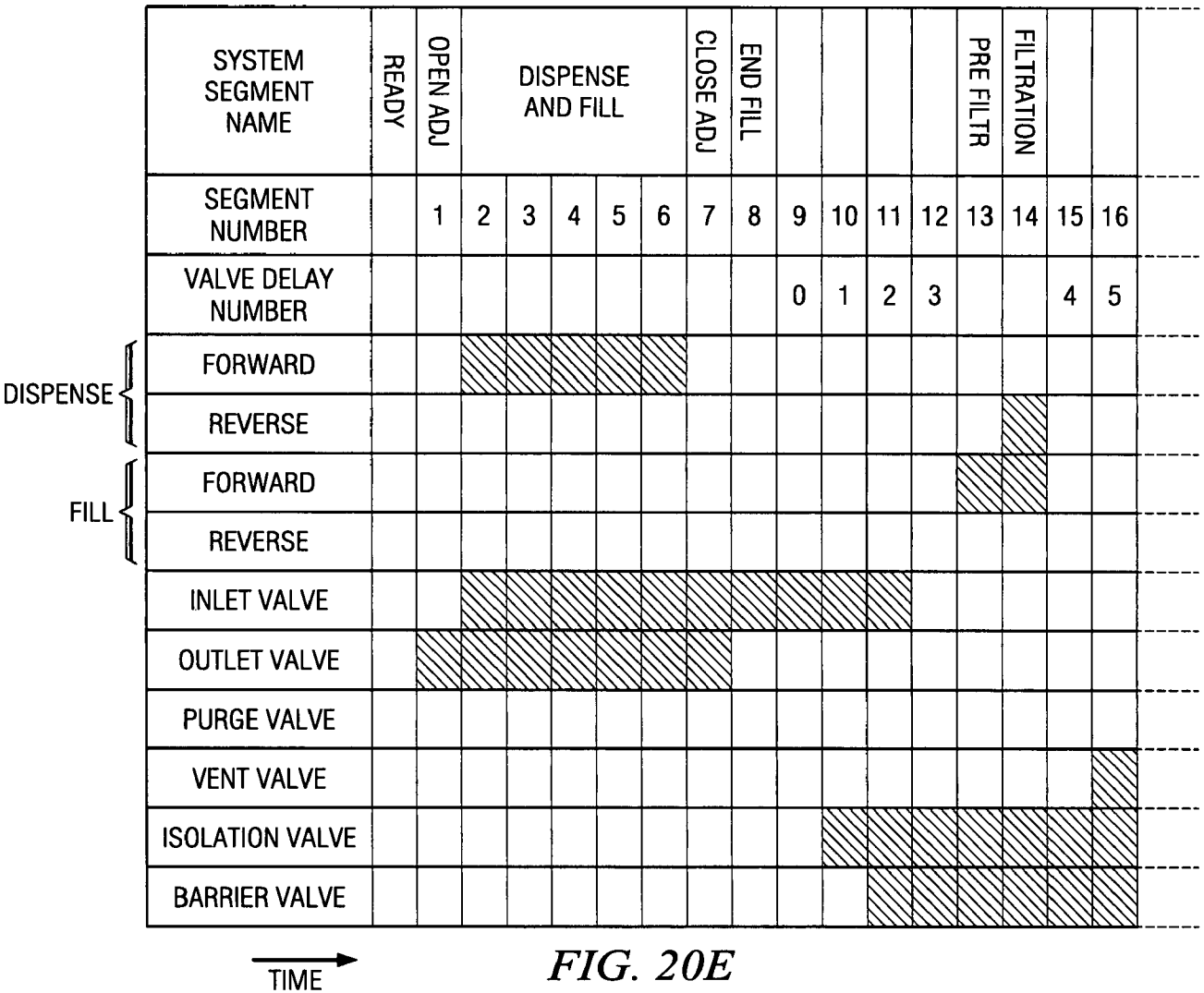
Figure 20F:
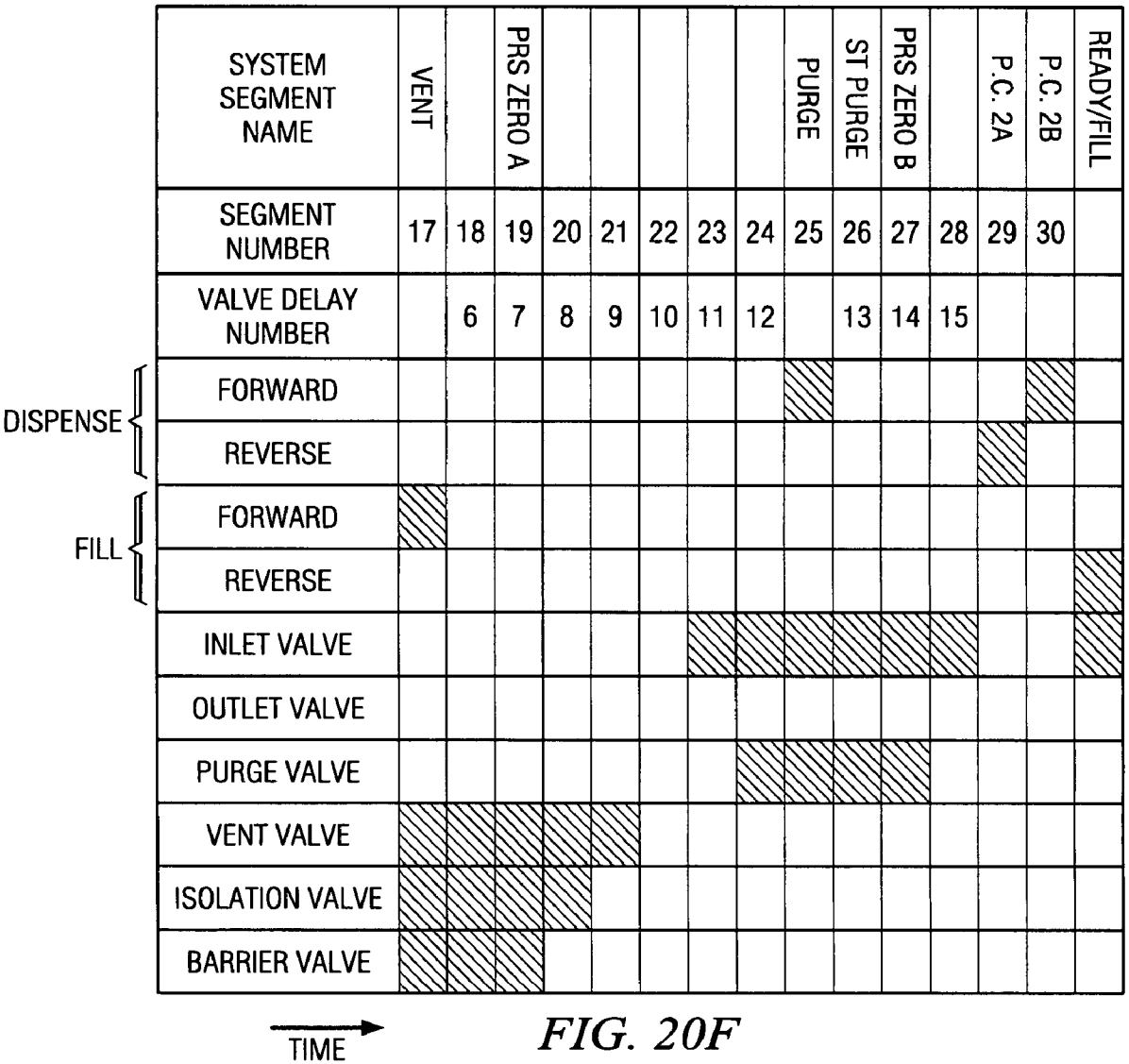
Figures 1, 21A:
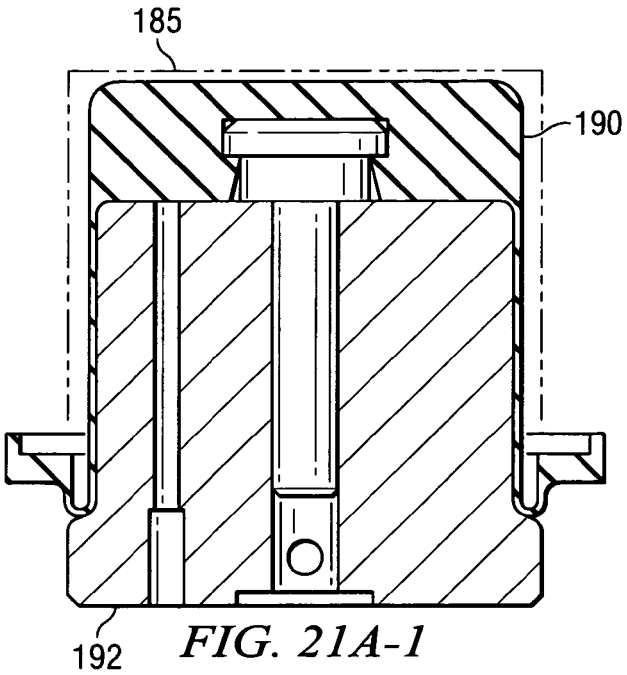
Figures 2, 21A:
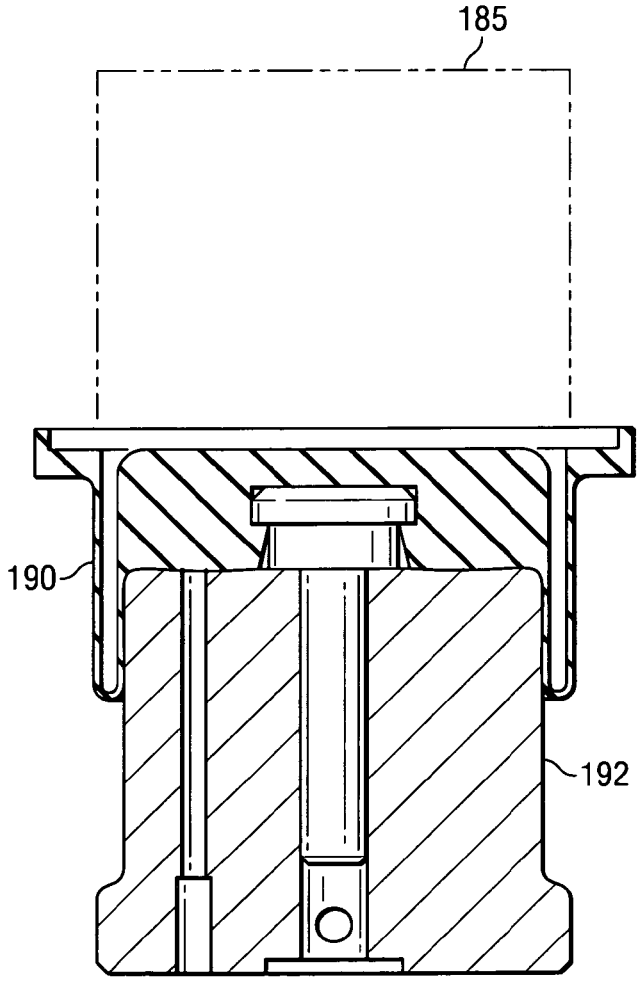

FIG. 20A is a chart diagram illustrating cycle timing of a stepper motor and a BLDCM in various stages, according to one embodiment of the invention. Following the above example, the stepper motor implements feed motor 175 and the BLDCM implements dispense motor 200. The shaded area in FIG. 21A indicates that the motor is in operation. According to one embodiment of the present invention, the stepper motor and the BLDCM can be configured in a manner that facilitates pressure control during the filtration cycle. One example of the pressure control timing of the stepper motor and the BLDCM is provided in FIG. 20B where the shaded area indicates that the motor is in operation.

FIG. 20B illustrates an exemplary configuration of feed motor 175 and dispense motor 200. More specifically, once the set point is reached, the BLDCM (i.e., dispense motor 200) can start reversing at the programmed filtration rate. In the meantime, the stepper motor (i.e., feed motor 175) rate varies to maintain the set point of pressure signal. This configuration provides several advantages. For instance, there are no pressure spikes on the fluid, the pressure on the fluid is constant, no adjustment is required for viscosity changes, no variation from system to system, and vacuum will not occur on the fluid.

FIGS. 20C-20F provide other example valve and motor timing diagrams. For the valves, the black sections indicate that the valve is open in various segments of the dispense cycle. For the dispense and feed motors, the black sections indicated when the motor is an forward or reverse state. Using the example of 30 segment dispense cycle, FIGS. 20C and 20E indicate example motor and valve timings during segments 1-16 and FIGS. 20C and 20F indicate example motor and valve timings during segments 1-17 of the dispense cycle. It should be noted that the multi-stage pump can utilize other valve and motor timings, more or less segments and other control schemes. It should also be noted that the segments can have varying amounts of time. U.S. Provisional Patent Application No. 60/742,168 entitled "SYSTEM AND METHOD FOR VALVE SEQUENCING IN A PUMP" by Inventors Gonnella et al., filed Dec. 2, 2005 and U.S. patent application Ser. No. 11/602,465, entitled "SYSTEM AND METHOD FOR VALVE SEQUENCING IN A PUMP" by Inventors Gonnella et al., filed Nov. 20, 2006, which are hereby fully incorporated by reference herein, describe various embodiments of valve and motor timings.

Multi-stage pumps, according to various embodiments of the present invention, can be significantly smaller than previous multi-stage pumps, while providing gentler fluid handling characteristics and a wider range of operation. Various features of the multi-stage pump contribute to the smaller size.

Some previous pump designs relied on flat diaphragms in the feed and dispense chambers to move exert pressure on the process fluid. Hydraulic fluid was typically used to assert pressure on one side of the diaphragm to cause the diaphragm to move, thereby displacing the process fluid. The hydraulic fluid could either be put under pressure by a pneumatic piston or a stepper motor driven piston. In order to get the displacement volume required by dispense pumps, the diaphragm had to have a relatively large surface area, and therefore diameter.

Figure 21B:
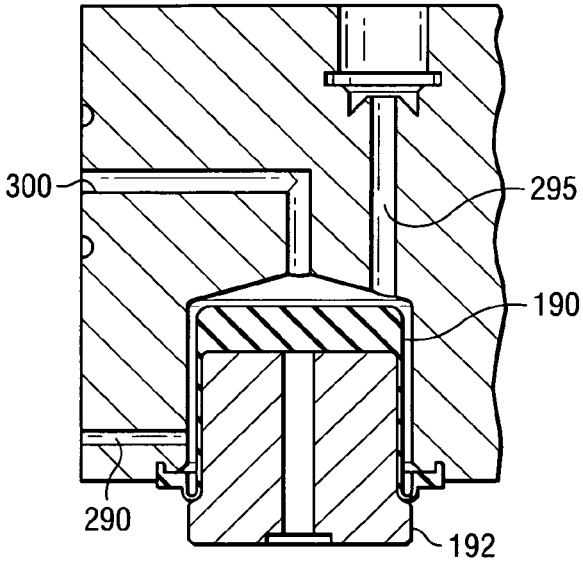
Figure 21C:
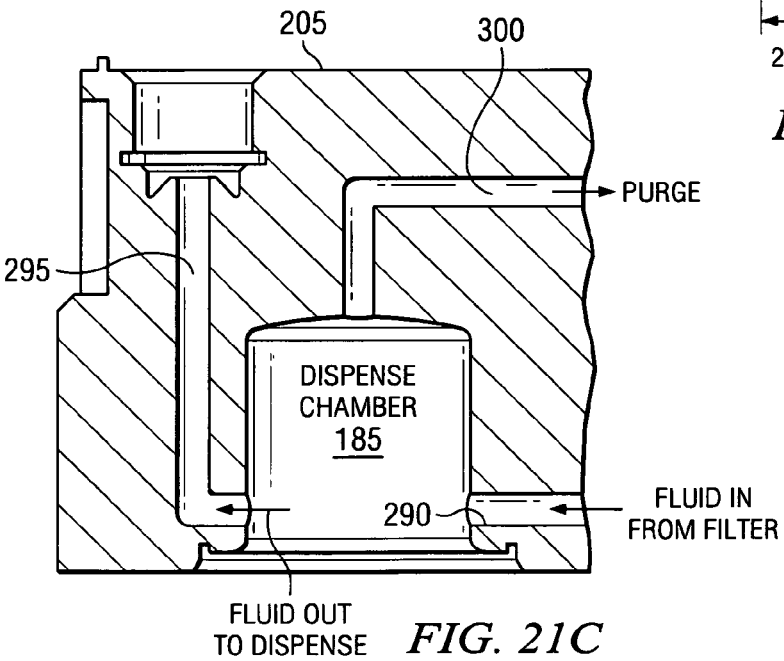

As discussed above in conjunction with FIGS. 21*a*-21*c*, diaphragm 190 of dispense pump 180 and diaphragm 160 of feed pump 150, on the other hand, can be rolling diaphragms. The use of rolling diaphragms significantly reduces the required diameters of feed chamber 155 and dispense chamber 185 compared to the use of a flat diaphragm. Moreover, rolling diaphragms can be directly moved by a motor driven piston rather than hydraulic fluid. This eliminates the need for a hydraulic chamber on the obverse side of the diaphragm from the feed/dispense chamber and the need for associated hydraulic lines. Thus, the use of rolling diaphragms allows the dispense and feed chambers to be much narrower and shallower and does away with the need for hydraulics.

For example, previous pumps that used flat diaphragms to achieve a 10 ml displacement, required a pump chamber with a 4.24 square inch (27.4193 square centimeter) cross section. A pump chamber using a rolling diaphragm can achieve a similar displacement with a 1.00 square inch (6.4516 square centimeter) diaphragm. Even taking into account the space between the piston and chamber wall for the diaphragm to roll and the sealing flange, the rolling diaphragm pump only requires a footprint of 1.25 square inches (8.064 square centimeters). Additionally, the rolling diaphragm is able handle much higher pressures than the flat diaphragm due to the reduced wetted surface area. Consequently, the rolling diaphragm pump does not require reinforcement, such as metal encasement, to handle pressures for which the flat diaphragm requires reinforcement.

Additionally, the use of a rolling diaphragm allows the flow passages into and out of feed chamber 155 and dispense chamber 185 to be advantageously placed to reduce size. As discussed in conjunction with FIG. 21*c*, for example, the openings to the inlet, outlet and purge flow passages from dispense chamber 185 can be positioned anywhere in the chambers. It should also be noted that the use of rolling diaphragms also reduces the cost of the pump by eliminating hydraulics.

Another feature of embodiments of the present invention that reduces size is the use of a single piece dispense block that defines the various flow passages from inlet to outlet, including the pump chambers. Previously, there were multiple (e.g., five or more) blocks that defined the flow passages and chambers. Because dispense block 205 is a single block, seals are reduced and the complexity of the assembly is reduced.

Yet another feature of embodiments of the present invention that helps reduce the size is that all the pump valves (e.g., input, isolation, barrier, vent and purge) are in a single valve plate. Previously, valves were split between valve plates and the various dispense blocks. This provided for more interfaces that could cause fluid leaks.

Figure 22A:
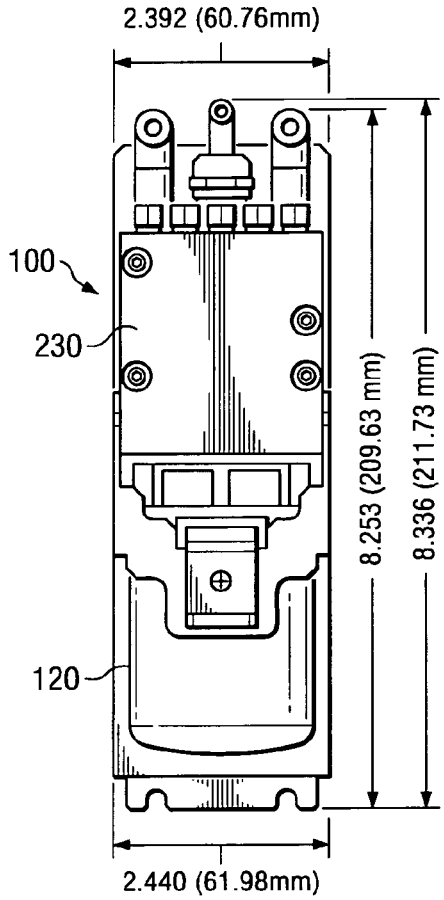
FIGS. 22A-C provides dimensions for an example embodiment of a multi-stage pump.
Figure 22C:
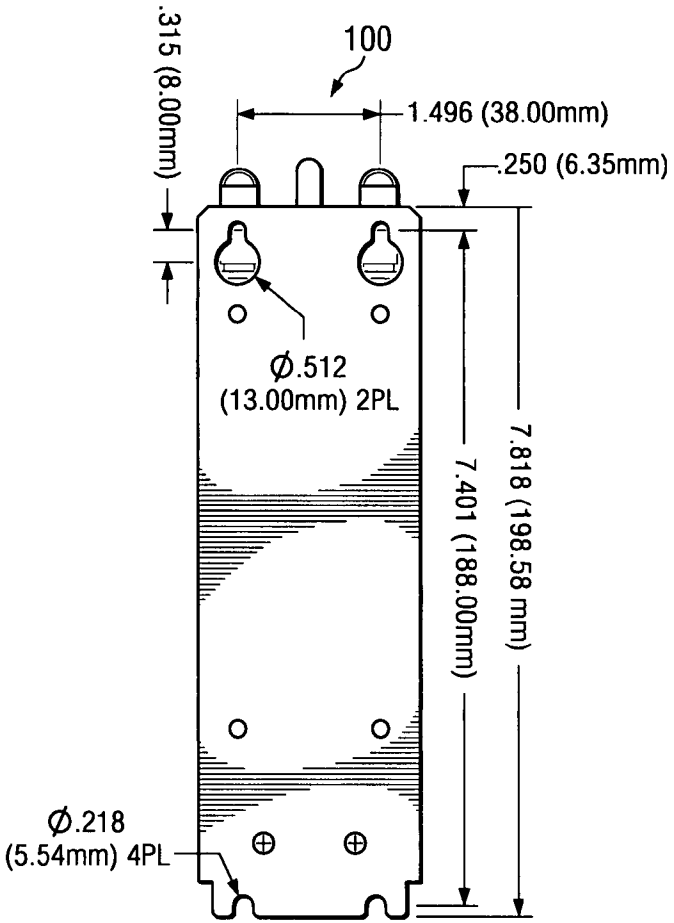
Figure 22B:
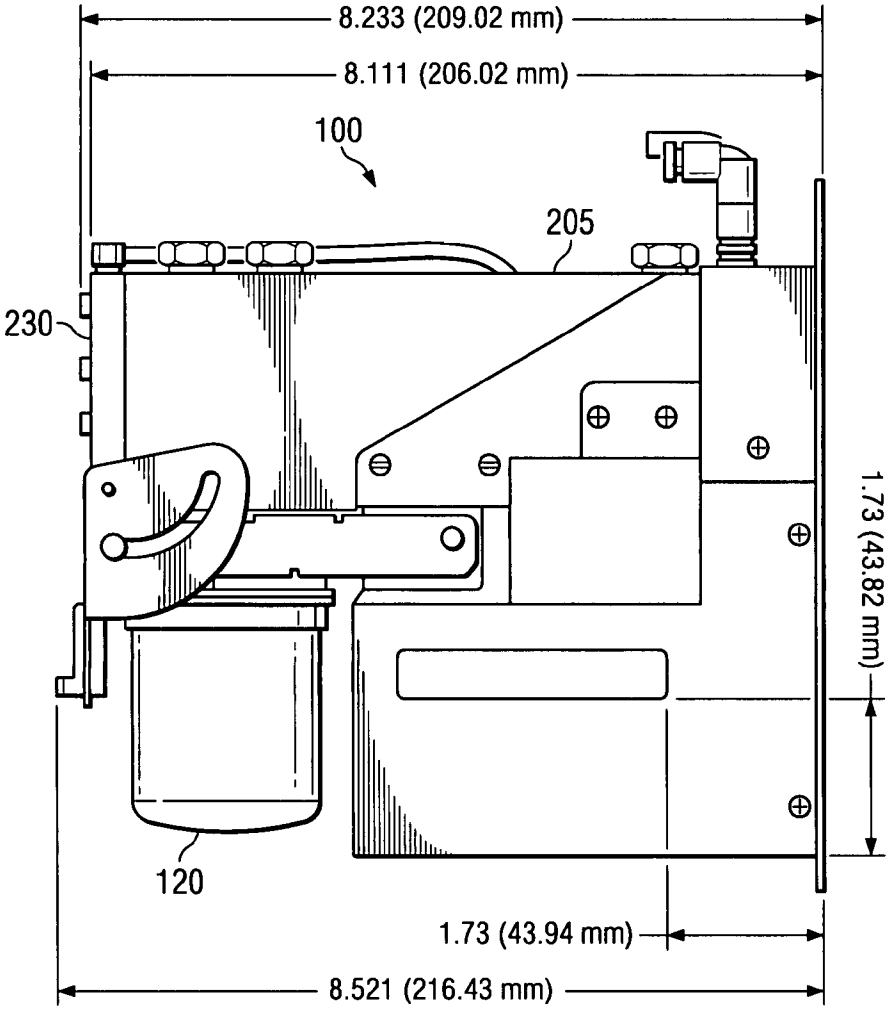

FIG. 22 provides example dimensions of an embodiment of a multi-stage pump that can produce up to a 10 mL dispense.

Moreover, in previous pumps the various PTFE plates were held together by external metal plates that were clamped or screwed together. Screwing or otherwise attaching component to PTFE is difficult because PTFE is a relatively weak material. Embodiments of the present invention solve this problem by the use of bars (e.g., inserts) with perpendicular female threaded holes as described in conjunction with FIGS. 5 and 6. The bars provide a mechanism for screwing in other components with the strength of metal.

Figure 23:
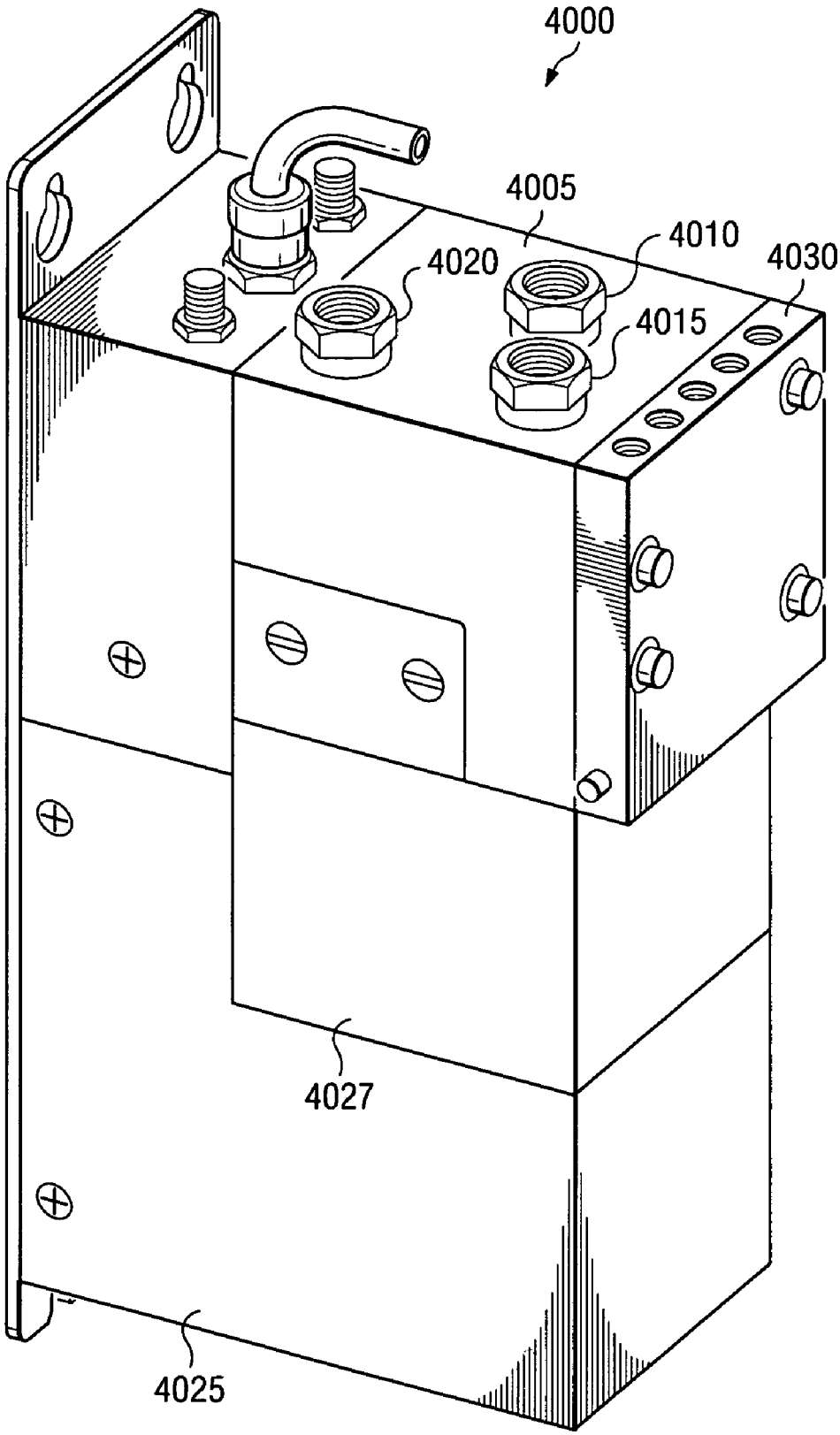
FIG. 23 is a diagrammatic representation of a single stage pump.

Although described in terms of a multi-stage pump, embodiments of the present invention can also be utilized in a single stage pump. FIG. 23 is a diagrammatic representation of one embodiment of a pump assembly for a pump 4000. Pump 4000 can be similar to one stage, say the dispense stage, of multi-stage pump 100 described above and can include a rolling diaphragm pump driven by a stepper, brushless DC or other motor. Pump 4000 can include a dispense block 4005 that defines various fluid flow paths through pump 4000 and at least partially defines a pump chamber. Dispense pump block 4005, according to one embodiment, can be a unitary block of PTFE, modified PTFE or other material. Because these materials do not react with or are minimally reactive with many process fluids, the use of these materials allows flow passages and the pump chamber to be machined directly into dispense block 4005 with a minimum of additional hardware. Dispense block 4005 consequently reduces the need for piping by providing an integrated fluid manifold.

Dispense block 4005 can include various external inlets and outlets including, for example, inlet 4010 through which the fluid is received, purge/vent outlet 4015 for purging/venting fluid, and dispense outlet 4020 through which fluid is dispensed during the dispense segment. Dispense block 4005, in the example of FIG. 23, includes the external purge outlet 4010 as the pump only has one chamber. U.S. Patent Application No. 60/741,667, entitled "O-RING-LESS LOW PROFILE FITTING AND ASSEMBLY THEREOF" by Iraj Gashgaee, filed Dec. 2, 2005, and U.S. patent application Ser. No. 11/602,513, entitled "O-RING-LESS LOW PROFILE FITTINGS AND FITTING ASSEMBLIES", by Inventor Iraj Gashgaee, filed Nov. 20, 2006, which are hereby fully incorporated by reference herein, describes an embodiment of fittings that can be utilized to connect the external inlets and outlets of dispense block 4005 to fluid lines.

Dispense block 4005 routes fluid from the inlet to an inlet valve (e.g., at least partially defined by valve plate 4030), from the inlet valve to the pump chamber, from the pump chamber to a vent/purge valve and from the pump chamber to outlet 4020. A pump cover 4225 can protect a pump motor from damage, while piston housing 4027 can provide protection for a piston and, according to one embodiment of the present invention, be formed of polyethylene or other polymer. Valve plate 4030 provides a valve housing for a system of valves (e.g., an inlet valve, and a purge/vent valve) that can be configured to direct fluid flow to various components of pump 4000. Valve plate 4030 and the corresponding valves can be formed similarly to the manner described in conjunction with valve plate 230, discussed above. According to one embodiment, each of the inlet valve and the purge/vent valve is at least partially integrated into valve plate 4030 and is a diaphragm valve that is either opened or closed depending on whether pressure or vacuum is applied to the corresponding diaphragm. In other embodiments, some of the valves may be external to dispense block 4005 or arranged in additional valve plates. According to one embodiment, a sheet of PTFE is sandwiched between valve plate 4030 and dispense block 4005 to form the diaphragms of the various valves. Valve plate 4030 includes a valve control inlet (not shown) for each valve to apply pressure or vacuum to the corresponding diaphragm.

As with multi-stage pump 100, pump 4000 can include several features to prevent fluid drips from entering the area of multi-stage pump 100 housing electronics. The "drip proof" features can include protruding lips, sloped features, seals between components, offsets at metal/polymer interfaces and other features described above to isolate electronics from drips. The electronics and manifold and PCB board can be configured similarly to the manner described above to reduce the effects of heat on fluid in the pump chamber.

Thus, similar features as used in a multi-stage pump to reduce form factor and the effects of heat and to prevent fluid from entering the electronics housing can be used in a single stage pump.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the scope of this invention as claimed.

What is claimed is:

1. A multi-stage pump configured to dispense photoresist chemicals comprising:

a pump inlet flow path;

a pump outlet flow path;

a feed pump in fluid communication with the pump inlet flow path comprising:

a feed stage diaphragm movable in a feed chamber, wherein the feed stage diaphragm is a rolling diaphragm;

a feed piston contacting the feed stage diaphragm throughout a full range of motion wherein movement of the feed piston causes the feed stage diaphragm to roll and unroll in a gap between the feed piston and a wall of the feed chamber;

a feed motor coupled to the feed piston to reciprocate the feed piston; and a feed stage outlet flow path in fluid communication with the feed chamber;

a dispense stage inlet flow path in fluid communication with a dispense chamber;

a filter in fluid communication with the feed stage outlet flow path and the dispense stage inlet flow path such that fluid flowing from the feed pump to a dispense pump passes through the filter;

the dispense pump in fluid communication with the feed pump and the pump outlet flow path, the dispense pump comprising:

a dispense diaphragm movable in the dispense chamber, wherein the dispense diaphragm comprises a dispense rolling diaphragm;

a dispense piston contacting the dispense diaphragm throughout a full range of motion, wherein movement of the dispense piston causes the dispense diaphragm to roll and unroll in a gap between the dispense piston and wall of the dispense chamber; and a dispense motor coupled to the dispense piston to reciprocate the dispense piston;

a dispense block formed of a single piece of material defining at least a portion of the feed chamber and at least a portion of the dispense chamber; and a set of valves to selectively allow fluid flow through the multi-stage pump.

2. The multi-stage pump of claim 1, wherein the feed motor is a first brushless DC motor and the dispense motor is a second brushless DC motor.

3. The multi-stage pump of claim 1, wherein the feed motor is a stepper motor and the dispense motor is a brushless DC motor.

4. The multi-stage pump of claim 3, further comprising:

a first lead screw connected to the feed piston and movable by the feed motor; and a second lead screw connected to the dispense piston and movable by the dispense motor.

5. The multi-stage pump of claim 1, further comprising a vent flow path in fluid communication with to the filter.

6. The multi-stage pump of claim 5, further comprising a purge flow path in fluid communication with the dispense chamber.

7. The multi-stage pump of claim 6, wherein the purge flow path leads from the dispense chamber to the feed chamber.

8. The multi-stage pump of claim 7, wherein the dispense block further fully defines a first and second portion of the pump inlet flow path, a first and second portion of the feed stage outlet flow path, a first and second portion of the dispense stage inlet flow path, a first and second portion of the vent flow path, a first and second portion of the purge flow path and at least a portion of the pump outlet flow path.

9. The multi-stage pump of claim 8, wherein:

the first portion of the pump inlet flow path leads from an inlet to an inlet valve and the second portion of the pump inlet flow path leads from the inlet valve to the feed chamber;

the first portion of the feed stage outlet flow path leads from the feed chamber to an isolation valve and the second portion of the feed stage outlet flow path leads from the isolation valve to the filter;

the first portion of the dispense stage inlet flow path leads from the filter to a barrier valve and the second portion of the dispense stage inlet flow path leads from the barrier valve to the dispense chamber;

the first portion of the vent flow path leads from the filter to a vent valve and the second portion of the vent flow path leads from the vent valve to a vent outlet;

the first portion of the purge flow path leads from the dispense chamber to a purge valve and the second portion of the purge flow path leads from the purge valve to the feed chamber.

10. The multi-stage pump of claim 9, further comprising a valve plate coupled to a single face of the dispense block, the valve plate and dispense block defining valve chambers for the inlet valve, isolation valve, barrier valve and purge valve, wherein the valve chambers are disposed on a single side of the valve plate facing the dispense block.

11. The multi-stage pump of claim 10, further comprising a sheet of elastomeric material coupled between the valve plate and the dispense block.

12. The multi-stage pump of claim 1, further comprising a pressure sensor positioned to read pressure in the dispense chamber.

13. A multi-stage pump configured to dispense photoresist chemicals comprising:

a pump inlet flow path;

a pump outlet flow path;

a single piece dispense block defining at least a portion of a dispense chamber in fluid communication with the pump outlet flow path and at least a portion of a feed chamber in fluid communication with the pump inlet flow path;

a filter in fluid communication with the feed chamber and the dispense chamber;

a feed stage diaphragm movable in the feed chamber, wherein the feed stage diaphragm is a rolling diaphragm;

a feed piston to move the feed stage diaphragm, wherein the feed piston is configured to contact the feed stage diaphragm through a full range of motion and wherein movement of the feed piston causes the feed stage diaphragm to roll and unroll in a gap between the feed piston and a wall of the feed chamber;

a feed motor coupled to the feed piston to reciprocate the feed piston, wherein the feed motor is a stepper motor;

a dispense diaphragm movable in the dispense chamber, wherein the dispense diaphragm is a rolling diaphragm;

a dispense piston to move the dispense diaphragm, wherein the dispense piston is configured to contact the dispense diaphragm through a full range of motion and wherein movement of the dispense piston causes the dispense diaphragm to roll and unroll in a gap between the dispense piston and a wall of the dispense chamber;

a dispense motor coupled to the dispense piston to reciprocate the dispense piston, wherein the dispense motor is a brushless DC motor; and a valve plate coupled to the dispense block, the valve plate and dispense block defining valve chambers for an inlet valve, isolation valve, barrier valve and purge valve, wherein the valve plate defines the valve chambers on a single side of the valve plate and wherein the valve plate is coupled to an end face of the dispense block.

14. The multi-stage pump of claim 13, wherein the dispense block further defines a first and second portion of the pump inlet flow path, a first and second portion of a feed stage outlet flow path, a first and second portion of a dispense stage inlet flow path, a first and second portion of a vent flow path, a first and second portion of a purge flow path and at least a portion of the pump outlet flow path.

15. The multi-stage pump of claim 14, wherein:

the first portion of the pump inlet flow path leads from an inlet to the inlet valve and the second portion of the pump inlet flow path leads from the inlet valve to the feed chamber;

the first portion of the feed stage outlet flow path leads from the feed chamber to the isolation valve and the second portion of the feed stage outlet flow path leads from the isolation valve to the filter;

the first portion of the dispense stage inlet flow path leads from the filter to the barrier valve and the second portion of the dispense stage inlet flow path leads from the barrier valve to the dispense chamber;

the first portion of the vent flow path leads from the filter to a vent valve and the second portion of the vent flow path leads from the vent valve to a vent outlet;

the first portion of the purge flow path leads from the dispense chamber to the purge valve and the second portion of the purge flow path leads from the purge valve to the feed chamber.

16. The multi-stage pump of claim 13, further comprising a sheet of elastomeric material coupled between the valve plate and the dispense block.

17. The multi-stage pump of claim 13, further comprising a pressure sensor positioned to read pressure in the dispense chamber.

18. A method for a multi stage pump configured to dispense photo resist chemicals, the method comprising:

forming a dispense block of a single piece of material, the dispense block at least partially defining a feed chamber, a dispense chamber, a pump inlet flow path and a pump outlet flow path;

mounting a dispense rolling diaphragm between the dispense block and a dispense pump piston housing;

mounting a feed stage rolling diaphragm between the dispense block and a feed pump piston housing;

coupling a feed pump piston to a feed motor via a feed pump lead screw;

positioning the feed pump piston so that the feed pump piston contacts the feed stage rolling diaphragm throughout a full range of motion of the feed pump piston;

positioning a dispense pump piston so that the dispense pump piston contacts the dispense rolling diaphragm throughout a full range of motion of the dispense pump piston;

coupling the dispense pump piston to a dispense motor via a dispense pump lead screw;

coupling the feed motor to the feed pump piston housing;

coupling the dispense motor to the dispense pump piston housing; and coupling a filter to the dispense block such that the filter is in fluid communication with the dispense chamber and the feed chamber.

19. The method of claim 18, wherein the feed motor and dispense motors are brushless DC motors.

20. The method of claim 18, wherein the feed motor is a stepper motor and the dispense motor is a brushless DC motor.

21. The method of claim 18, wherein the dispense block further defines a first and second portion of the pump inlet flow path, a first and second portion of a feed stage outlet flow path, a first and second portion of a dispense stage inlet flow path, a first and second portion of a vent flow path, a first and second portion of a purge flow path and at least a portion of the pump outlet flow path.

22. The method of claim 21, wherein:

the first portion of the pump inlet flow path leads from an inlet to an inlet valve and the second portion of the pump inlet flow path leads from the inlet valve to the feed chamber;

the first portion of the feed stage outlet flow path leads from the feed chamber to an isolation valve and the second portion of the feed stage outlet flow path leads from the isolation valve to the filter;

the first portion of the dispense stage inlet flow path leads from the filter to a barrier valve and the second portion of the dispense stage inlet flow path leads from the barrier valve to the dispense chamber;

the first portion of the vent flow path leads from the filter to a vent valve and the second portion of the vent flow path leads from the vent valve to a vent outlet;

the first portion of the purge flow path leads from the dispense chamber to a purge valve and the second portion of the purge flow path leads from the purge valve to the feed chamber.

23. The method of claim 22, further comprising coupling a valve plate to the dispense block, wherein the valve plate at least partially defines one or more valves.

24. The method of claim 23, wherein the valve plate partially defines the inlet valve, the vent valve, the isolation valve, the barrier valve, and the purge valve all on one side of the valve plate.

25. The method of claim 24, further comprising selectively directing vacuum pressure to the inlet valve, the vent valve, the isolation valve, the barrier valve, and the purge valve.

26. The method of claim 18, comprising:

inserting a set of metal rods with screw holes into the dispense block, wherein the screw holes are aligned such that each metal rod is orthogonal to screws screwed in the screw holes of that metal rod; and screwing screws into the screw holes to couple one or more components to the dispense block.

27. The method of claim 26, wherein the one or more components comprise the dispense piston housing and the dispense motor.

28. The method of claim 26, wherein the one or more components comprise the feed piston housing and the feed motor.

29. A pump configured to dispense photo resist chemicals, the pump comprising:

a pump inlet flow path to receive fluid from an external fluid source;

a pump outlet flow path to direct fluid to a nozzle;

a purge flow path;

a single piece dispense block defining a first portion and second portion of the pump inlet flow path, at least a portion of a pump outlet flow path, a first portion and second portion of the purge flow path and at least a portion of a pump chamber in fluid communication with the pump outlet flow path and the pump inlet flow path and the purge flow path;

a rolling diaphragm movable in the pump chamber;

a piston to move the rolling diaphragm, wherein the piston contacts the rolling diaphragm throughout a full range of motion and wherein the rolling diaphragm rolls and unrolls in a gap between the piston and a wall of the pump chamber when the piston moves;

a motor coupled to the piston to reciprocate the piston; and a valve plate coupled to the dispense block, wherein the valve plate and dispense block define an inlet valve chamber in communication with the first and second portions of the pump inlet flow path and a purge valve chamber in communication with the first and second portions of the purge flow path and an outlet valve chamber in communication with the at least a portion of the pump outlet flow path, wherein the valve plate and dispense block define the inlet valve chamber and the outlet valve chamber on a single side of the valve plate and wherein the valve plate is coupled to an end face of the dispense block;

a sheet of elastomeric material between the dispense block and valve late forming valve diaphragms for each of an inlet valve, an outlet valve and a purge valve.

30. The pump of claim 29, wherein the dispense block further defines a first and second portion of the pump inlet flow path, a first and second portion of a purge flow path and at least a portion of the pump outlet flow path.

31. The pump of claim 29, wherein:

the first portion of the pump inlet flow path leads from an inlet to the inlet valve and the second portion of the pump inlet flow path leads from the inlet valve to the pump chamber;

the first portion of the purge flow path leads from the pump chamber to the purge valve and the second portion of the purge flow path leads from the purge valve to a purge outlet.

* * * * *